US005591061A

United States Patent [19]

Ikeda et al.

[11] Patent Number: 5,591,061

[45] Date of Patent: Jan. 7, 1997

[54] APPARATUS FOR MANUFACTURING ELECTRON SOURCE AND IMAGE FORMING APPARATUS

[75] Inventors: Sotomitsu Ikeda, Atsugi; Masato Yamanobe, Machida; Hisaaki Kawade, Yokohama; Toshikazu Ohnishi, Sagamihara; Tatsuya Iwasaki, Atsugi, all of Japan

[73] Assignee: Canon Kabushiki Kaisha, Tokyo, Japan

[21] Appl. No.: 499,579

[22] Filed: Jul. 7, 1995

[30] Foreign Application Priority Data

| | | | |
|---|---|---|---|
| Jul. 12, 1994 | [JP] | Japan | 6-160085 |
| Jul. 12, 1994 | [JP] | Japan | 6-160088 |
| Sep. 21, 1994 | [JP] | Japan | 6-251548 |
| Jun. 22, 1995 | [JP] | Japan | 7-177943 |
| Jun. 26, 1995 | [JP] | Japan | 7-182048 |

[51] Int. Cl.[6] ..... H01J 9/02; H01J 9/42

[52] U.S. Cl. ..... 445/3; 445/6; 445/51

[58] Field of Search ..... 445/3, 6, 50, 51

[56] References Cited

FOREIGN PATENT DOCUMENTS

| | | | |
|---|---|---|---|
| 276530 | 11/1989 | Japan | 445/50 |
| 56822 | 2/1990 | Japan | 445/50 |
| 10325 | 1/1992 | Japan | 445/50 |

OTHER PUBLICATIONS

M. Hartwell, et al., "Strong Electron Emission From Patterned Tin–Indium Oxide Thin Films," Int. Electron Devices Meeting, 1975, pp. 519–521.

M. Elinson, et al., "The Emission of Hot Electrons and The Field Emission of Electrons from Tin Oxide," Radio Engineering and Electronic Physics, 1965, pp. 1290–1296.

H. Araki, et al., "Electroforming and Electron Emission of Carbon Thin Films," J. Vac. Soc. Japan, vol. 26, 1983, pp. 22–29.

G. Dittmer, "Electrical Conduction and Electron Emission of Discontinuous Thin Films," Thin Solid Films, 9 (1972) pp. 317–328.

C. A. Spindt, et al., "Physical Properties of Thin–Film Field Emission Cathodes with Molybdenum Cones," J. Appl. Phys., vol. 47, (1976), pp. 5248–5263.

C. A. Mead, "Operation of Tunnel–Emission Devices," J. Appl. Phys., 32, pp. 646–652.

Dyke and Dolan, "Field Emission," Advances in Electronics and Electron Physics, vol. VIII, (1956), pp. 90–185.

"The Experimental Physics Course No. 14: Surface/Fine Particle" (ed. Koreo Kinoshita; Kyoritu Publication, Sep. 1, 1986).

"Ultrafine Particle—Creative Science and Technology", ed. Chikara Hayashi, Ryoji Ueda, Akira Tazaki; Mita Publication, 1988, p. 2.

*Primary Examiner*—Kenneth J. Ramsey

*Attorney, Agent, or Firm*—Fitzpatrick, Cella, Harper & Scinto

[57] ABSTRACT

An electron-emitting device has a pair of device electrodes and an electroconductive thin film including an electron emitting region arranged between the electrodes. The device is manufactured via an activation process for increasing the emission current of the device. The activation process includes steps of a) applying a voltage (Vact) to the electroconductive thin film having a gap section under initial conditions, b) detecting the electric performance of the electroconductive thin film and c) modifying, if necessary, the initial conditions as a function of the detected electric performance of the electroconductive thin film.

45 Claims, 28 Drawing Sheets

APPARATUS FOR MANUFACTURING ELECTRON SOURCE AND IMAGE FORMING APPARATUS

BACKGROUND OF THE INVENTION

1. Field of the Invention

This invention relates to an apparatus for manufacturing an electron source and an image forming apparatus.

2. Related Background Art

There have been known two types of electron-emitting device; the thermoelectron emission type and the cold cathode electron emission type. Of these, the cold cathode emission type refers to devices including field emission type (hereinafter referred to as the FE type) devices, metal/insulation layer/metal type (hereinafter referred to as the MIN type) electron-emitting devices and surface conduction electron-emitting devices. Examples of FE type device include those proposed by W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5284 (1976).

Examples of MIN device are disclosed in papers including C. A. Mead, "The tunnel-emission amplifier", J. Appl. Phys., 32, 646 (1961).

Examples of surface conduction electron-emitting device include one proposed by M. I. Elinson, Radio Eng. Electron Phys., 10 (1965).

A surface conduction electron-emitting device is realized by utilizing the phenomenon that electrons are emitted out of a small thin film formed on a substrate when an electric current is forced to flow in parallel with the film surface. While Elinson proposes the use of $SnO_2$ thin film for a device of this type, the use of Au thin film is proposed in [G. Dittmer: "Thin Solid Films", 9, 317 (1972)] whereas the use of $In_2O_3/SnO_2$ and that of carbon thin film are discussed respectively in [M. Hartwell and C. G. Fonstad: "IEEE Trans. ED Conf.", 519 (1975)] and [H. Araki et al.: "Vacuum", Vol. 26, No. 1, p. 22 (1983)].

FIG. 34 of the accompanying drawings schematically illustrates a typical surface conduction electron-emitting device proposed by M. Hartwell. In FIG. 26, reference numeral 1 denotes a substrate. Reference numeral 4 denotes an electroconductive thin film normally prepared by producing an H-shaped thin metal oxide film by means of sputtering, part of which eventually makes an electron-emitting region 5 when it is subjected to an electrically energizing process referred to as "energization forming" as described hereinafter. In FIG. 26, the thin horizontal area of the metal oxide film separating a pair of device electrodes has a length L of 0.5 to 1 [mm] and a width W of 0.1 [mm].

It should be noted, however, that a surface conduction electron-emitting device does not necessarily have a H-shaped film prepared in a single operation. Alternatively, a pair of electrodes may be arranged in parallel with each other like the pillars of H in the first place and thereafter an electroconductive thin film may be formed to link the electrodes. The material and the thickness of the thin film may be different from those of the electrodes.

Conventionally, an electron emitting region 5 is produced in a surface conduction electron-emitting device by subjecting the electroconductive thin film 4 of the device to an electrically energizing preliminary process, which is referred to as "energization forming". In the energization forming process, a constant DC voltage or a slowly rising DC voltage that rises typically at a rate of 1 V/min. is applied to given opposite ends of the electroconductive thin film 4 to partly destroy, deform or transform the film and produce an electron-emitting region 5 which is electrically highly resistive. Thus, the electron-emitting region 5 is part of the electroconductive thin film 4 that typically contains a gap or gaps therein so that electrons may be emitted from the gap. Note that, once subjected to an energization forming process, a surface conduction electron-emitting device comes to emit electrons from its electron emitting region 5 whenever an appropriate voltage is applied to the electroconductive thin film 4 to make an electric current run through the device.

Since a surface conduction electron-emitting device has a particularly simple structure and can be manufactured in a simple manner, a large number of such devices can advantageously be arranged on a large area without difficulty. As a matter of fact, a number of studies have been made to fully exploit this advantage of surface conduction electron-emitting devices. For example, there have been proposed various types of image forming apparatus including a self-emission type flat image forming apparatus.

In a typical example of electron source comprising a large number of surface conduction electron-emitting devices, the devices may be arranged in parallel rows and the positive and negative electrodes of the devices of each row may be connected to respective common wirings (ladder arrangement) as shown in FIG. 14 or a matrix of wirings may be formed and the devices may be connected to the respective wirings as shown in FIG. 10.

In order for an image forming apparatus comprising a number of electron-emitting devices to stably provide clear and bright images, the devices are required to operate uniformly and efficiently for electron emission. The efficiency of a surface conduction electron-emitting device is defined by the ratio of the electric current flowing between the paired electrodes of the device (hereinafter referred to "device current") to the electric current produced by electrons emitted into the vacuum of the image forming apparatus (hereinafter referred to as "electron emission current") when a certain voltage is applied to the device electrodes. If all the electron-emitting devices of the electron source operate uniformly and efficiently for electron emission in, for instance, an image forming apparatus comprising a fluorescent body as its image forming member, such an apparatus can make a high definition image forming apparatus or television set that can be very flat and consumes power only at a reduced rate. By turn, the drive circuit and other components of such an energy saving apparatus may be manufactured at low cost.

SUMMARY OF THE INVENTION

As a result of intensive research efforts, the inventors of the present invention discovered that, if a certain voltage is applied to a surface conduction electron-emitting device in an atmosphere that contains organic substances after producing an electron emitting region therein by energization forming as described above, the electric current brought into being by electrons emitted from that region remarkably increases. This operation is termed "activation". The above phenomenon is attributable to an activated filmy deposit of carbon or a carbon compound produced in the vicinity of the electron emitting region as a result of the voltage application.

When an electron source as shown in FIG. 14 or FIG. 10 is subjected to an activation process, a pulse voltage may be applied simultaneously to all the devices of a same row or sequentially to the devices of a same row on a one by one basis to form a filmy deposit of an activated substance one each device.

However, with the above described technique of activation, where a pulse voltage is applied for a predetermined period of time under given conditions, the electron-emitting devices can show different extends of activation probably as a function of minute differences in the manufacturing conditions of the devices such as deviations in the film thickness of the electroconductive thin film and differences in the partial pressures of the organic substances in the manufacturing environment depending on the relative positions of the devices. Then, the net result will be that the devices of the electron source do not operate uniformly and the distribution of brightness of the image forming apparatus shows an remarkable unevenness. While these problems may be solved to some extent by correcting the operation of each device when it is driven, such a corrective measure will require a large memory device for storing corrective information for each device and, consequently, the image forming apparatus comprising a large number of electron-emitting devices will inevitably become large and costly.

Additionally, an activated filmy deposit can be formed in unnecessary areas of the electron-emitting device to electrically connect the positive and negative electrodes during the activation process. Then, an electric current (leak current) that is not good for electron emission may flow between the electrodes to reduce the efficiency of electron emission and raise the rate of power consumption of the device. Then, the device may generate heat in the inside of the electron source so that the latter may have to be provided with a heat radiation mechanism for discharging the heat accumulated in the inside, which by turn may require a power consuming drive circuit. All in all, these and other negative factors can severely restrict the design of the image forming apparatus. While such factors may be prevented from entering the scene by completing the activation process before the route for the leak current grows remarkably and carrying out an additional operation of stabilization for removing any possible route of leak current, then the activation process has to be terminated before the device is processed to allow a sufficiently large electron emission current Ie.

In view of the above described technological problems, it is an object of the present invention to provide an apparatus for manufacturing an electron source that operates uniformly for electron emission with a low power consumption rate and an image forming apparatus having such an electron source.

According to an aspect of the invention, there is provided a method of manufacturing an electron-emitting device having a pair of device electrodes and an electroconductive thin film including an electron emitting region arranged between the electrodes, characterized in that it comprises an activation process for increasing the emission current of the device and said activation process includes steps of a) applying a voltage (Vact) to the electroconductive thin film having a gap section under initial conditions, b) detecting the electric performance of said electroconductive thin film and c) modifying, if necessary, said initial conditions as a function of the detected electric performance of the electroconductive thin film.

According to another aspect of the invention, there is provided an apparatus for carrying out an activation process on an electron-emitting device having a pair of device electrodes and an electroconductive thin film including an electron emitting region arranged between the electrodes in order to increase the emission current of the device, characterized in that it comprises a) means for applying a voltage (Vact) to the electroconductive thin film having a gap section under initial conditions, b) means for detecting the electric performance of said electroconductive thin film and c) means for modifying, if necessary, said initial conditions as a function of the detected electric performance of the electroconductive thin film.

DESCRIPTION OF THE PREFERRED EMBODIMENTS

In an apparatus according to the invention for manufacturing a surface conduction electron-emitting device, an electron source comprising a plurality of such surface conduction electron-emitting devices and an image forming apparatus provided with such an electron source, said apparatus comprises in order to activate the surface conduction electron-emitting device:

(a) means for detecting the electric performance of the electron-emitting device, while carrying out an activation process on the device;

(b) means for establishing conditions for the activation process; and (c) means for determining the continuation of the activation process, modifying, if necessary, the conditions of the activation process or terminating the activation process as a function of the electric performance of the electroconductive thin film detected by said means (a).

The means (a) typically detects the relationship between at least two of the electric current (device current) If running between the device electrodes, the electric current (emission current) Ie realized by electrons emitted into the vacuum from the device to get to an anode and the voltage (device voltage) Vf applied to the device electrodes.

The means (b) typically establishes, among others, the waveform of the pulse voltage to be applied to the device for activation and the parameters of the activation atmosphere. The pulse voltage is typically expressed in terms of the pulse width, the pulse interval and the waveform, which may be triangular, rectangular or trapezoidal. The activation atmosphere is expressed in terms of the organic substance(s) contained in the activation atmosphere, the partial pressure of each activation gas used for the activation process as well as the etching gas temporarily introduced into the activation system such as hydrogen.

Figure 1A:
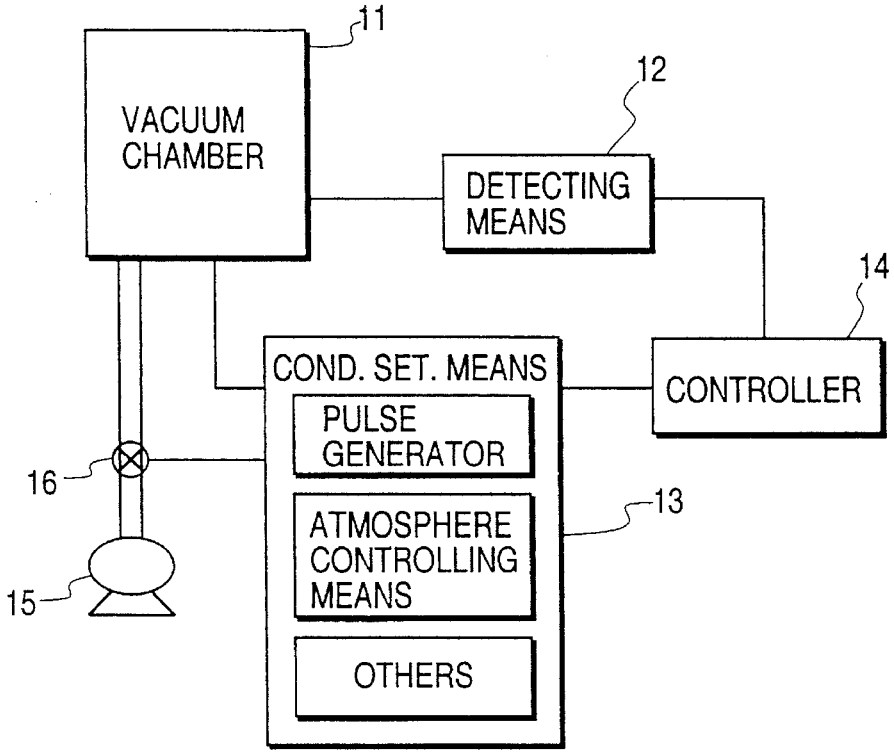
FIG. 1A is a block diagram of a manufacturing apparatus according to the invention, showing a possible configuration thereof.

The block diagram of FIG. 1A illustrates the relationship among the above listed means.

In a method according to the invention for manufacturing a surface conduction electron-emitting device, an electron source comprising a plurality of such surface conduction electron-emitting devices and an image forming apparatus provided with such an electron source, said method comprises steps of:

(A) establishing initial conditions and starting an activation process, which is called a starting sequence;

(B) carrying out an activation process, following a predetermined regular sequence of operations;

(C) interrupting, if necessary, or concurring with said regular sequence to detect the performance of the electron-emitting device or the electron source;

(D) selecting the continuation or the modification of the conditions of said regular sequence or the termination of the activation process on the basis of the information obtained in step (C) above; and (E) modifying the conditions of said regular sequence if such modification is selected in step (D) above; or (F) carrying out a sequence of operations for terminating the activation process if such termination is selected in step (D), which is called a closing sequence.

Figure 2:
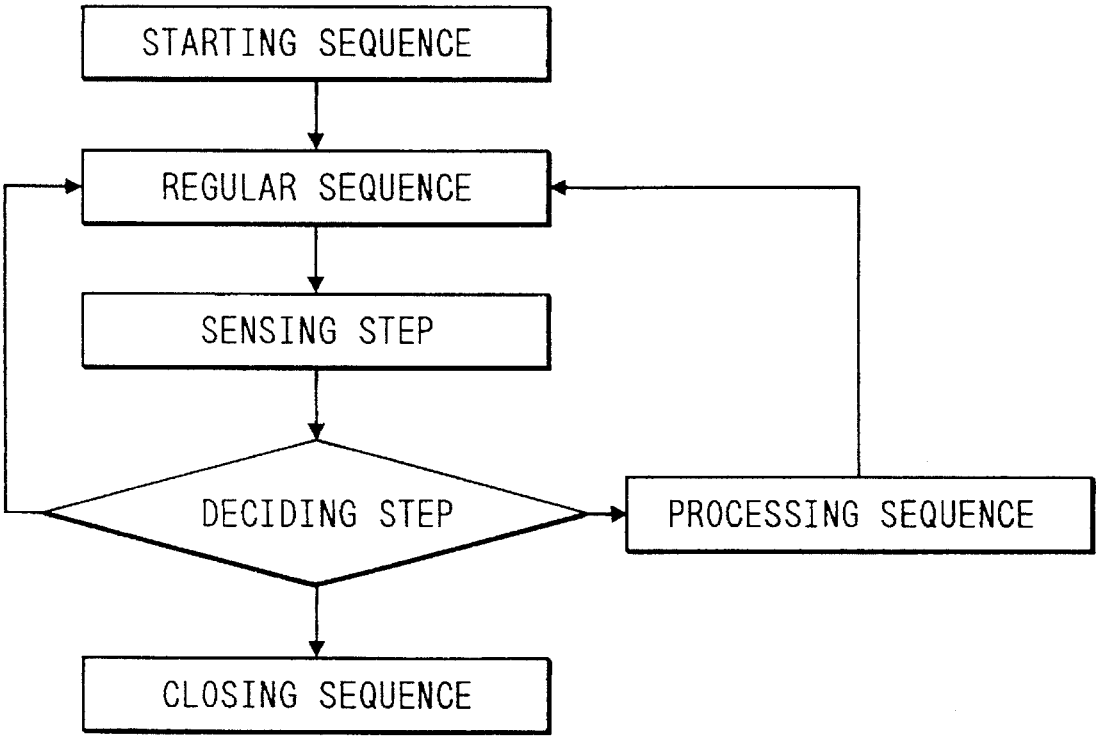
FIG. 2 is a flow chart, illustrating a manufacturing method according to the invention.

FIG. 2 illustrates the relationship among the above listed steps.

Step (A) listed above specifically includes operations of initializing an oscillator for generating a pulse voltage for the activation process, initializing a program for a switching arrangement if a pulse voltage is applied to each electron-emitting device or each group of electron-emitting devices and initializing a program for introducing or determinating the timing of introducing an organic gas into the apparatus, evacuating the apparatus and baking, if necessary, the apparatus.

The regular sequence of Step (B) include the operation of continuously applying a constant pulse voltage in a predetermined atmosphere or varying the height and the width of the pulse as a function of a program and that of periodically changing the atmosphere.

Step (C) is to detect the relationship between Ie and Vf and/or the relationship between If and Vf in each electron-emitting device or each group of electron-emitting devices and includes operations of periodically inserting a measuring pulse into the activation pulse of the regular sequence to detect the above relationships and using a triangular, trapezoidal or step-like (see FIG. 7B) pulse concurrently with said regular sequence.

The relationship between If and Vf and/or the relationship between Ie and Vf may be expressed for the full ranges of If, Ie and Vf or in terms of the respective values of If and Ie for a specifically given value of Vf depending on the pulse for which they are used.

Step (D) include operations of determining the value of the device current If (Vf2) for a particular value of the device voltage (Vf2) lower than the wave height Vact of the activation pulse, the threshold voltages for Ie and If, the difference between the threshold voltages, the value of Ie (Vact) and other values from the relationships detected in Step (C) and selecting the continuation of the regular sequence or the termination of a specific operation or the entire activation process depending on the conditions produced thereto.

Step (E) is to modify the waveform of the activation pulse and/or the atmosphere for the regular sequence according to the outcome of Step (D) above or temporarily carry out some other operation(s) that are different from the corresponding ones of the regular sequence. Note that Step (E) returns to the regular sequence once its operations are completed.

Step (F) is to stop the activation pulse, the introduction of organic substances, the evacuation of the apparatus and other operations in order to terminate the activation process.

The above steps may have to be more accurately defined for each activation step.

For instance, when a plurality of electron-emitting devices are manufacturing by means of the above described apparatus and method, the devices will show a same and equal emission current if the activation process is conducted, while sensing Ie (Vact), until Ie (Vact) gets to a predetermined level, when the activation process is terminated. The same is true for manufacturing an electron source comprising a plurality of electron-emitting devices arranged and wired to show a ladder-like or matrix-shaped arrangement and an image forming apparatus provided with such an electron source.

While the electric performance of an electron-emitting device changes with the advancement of the activation process, it should be noted that Ie may typically increase until it shows a maximum value somewhere in the middle of the activation process and thereafter it falls with time. If such is the case, a device having a maximum possible Ie can be prepared by monitoring the device current I, calculating dIe/dt and terminating the activation process when dIt/dt=0 is obtained. With this technique, the device can be optimized in terms of Ie.

In a similar manner, other parameters such as $\eta$=Ie/If.

An electron-emitting device showing only a very low leak current can be prepared by carrying out an activation process, while monitoring the value of If (Vmid) when Vmid=Vact/2, and by temporarily applying a relatively high pulse voltage whenever the leak current of the device exceeds, for example, If(Vact)/200. If an electron source having a matrix wiring arrangement that can be driven to operate by a simple matrix drive method is used in an image forming apparatus, all the devices of the same row or column of the device selected for electron emission are subjected to a voltage (half selection voltage) equal to a half of the voltage (drive voltage) applied to the selected device. If, then, the value of If (Vmid) is large, an ineffective electric current can flow through those devices to consume electric power at an enhanced rate and the drive circuit of the electron source will have to be subjected to an excessively large load and generate heat as it is driven continuously. It will be understood that the above described method and apparatus of the present invention can effectively get rid of these problems.

Now, a process of manufacturing a surface conduction electron-emitting device will be described in detail.

Figure 3A:
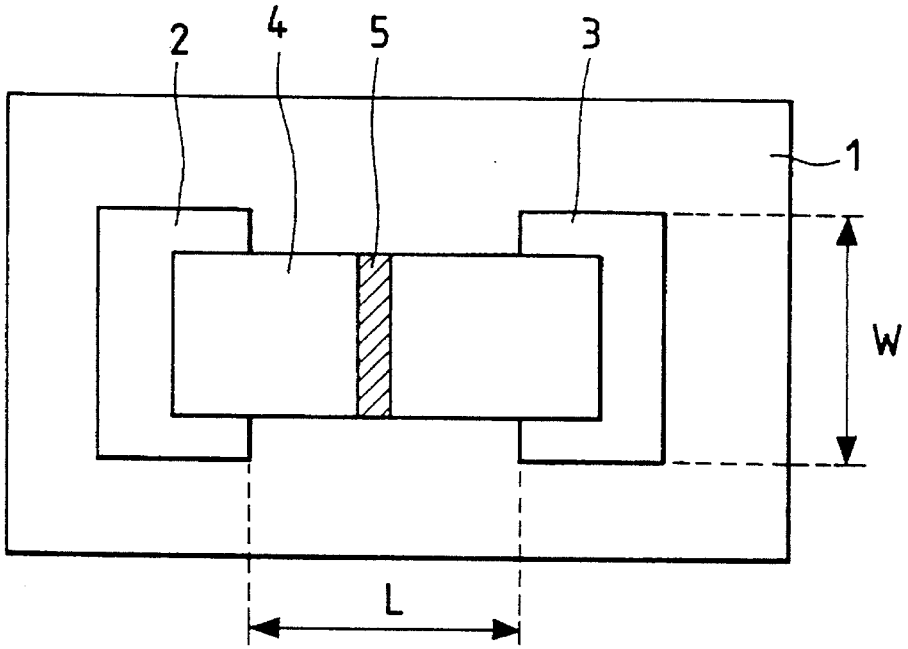
FIGS. 3A and 3B are schematic views of a surface conduction electron-emitting device, to which the present invention is applicable.
Figure 3B:
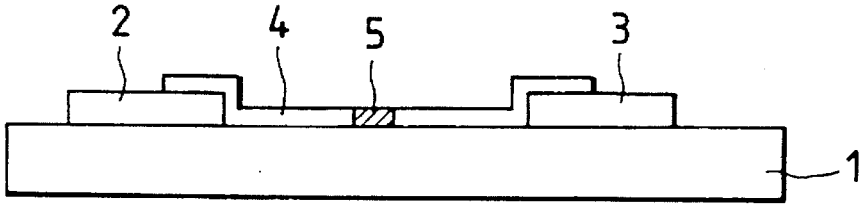

FIGS. 3A and 3B are schematic plan and sectional side views showing the basic configuration of a surface conduction electron-emitting device to which the present invention is applicable.

Referring to FIGS. 3A and 3B, the device comprises a substrate 1, a pair of device electrodes 2 and 3, an electroconductive thin film 4 and an electron-emitting region 5.

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina as well as Si.

While the oppositely arranged device electrodes 2 and 3 may be made of any highly conducting material, preferred candidate materials include metals such as Ni, Cr, Au, Mo, W, Pt, Ti, Al, Cu, and Pd and their alloys, printable conducting materials made of a metal or a metal oxide selected from Pd, Ag, $RuO_2$, Pd—Ag and glass, transparent conducting materials such as $In_2O_3$—$SnO_2$ and semiconductor materials such as polysilicon.

The distance L separating the device electrodes, the length W of the device electrodes, the contour of the electroconductive film 4 and other factors for designing a surface conduction electron-emitting device according to the invention may be determined depending on the application of the device.

The distance L separating the device electrodes 2 and 3 is preferably between hundreds nanometers and hundreds micrometers and, still preferably, between several micrometers and tens of several micrometers depending on the voltage to be applied to the device electrodes and the field strength available for electron emission.

The length W of the device electrodes 2 and 3 is preferably between several micrometers and hundreds of several micrometers depending on the resistance of the electrodes and the electron-emitting characteristics of the device. The film thickness d of the device electrodes 2 and 3 is between tens of several nanometers and several micrometers.

A surface conduction electron-emitting device according to the invention may have a configuration other than the one illustrated in FIGS. 3A and 3B and, alternatively, it may be prepared by laying a thin film 4 including an electron-emitting region on a substrate 1 and then a pair of oppositely disposed device electrodes 2 and 3 on the thin film.

The electroconductive thin film 4 is preferably a fine particle film in order to provide excellent electron-emitting characteristics. The thickness of the electroconductive thin film 4 is determined as a function of the stepped coverage of the electroconductive thin film on the device electrodes 2 and 3, the electric resistance between the device electrodes 2 and 3 and the parameters for the forming operation that will be described later as well as other factors and preferably between a tenth of a nanometer and hundreds of several nanometers and more preferably between a nanometer and fifty nanometers. The electroconductive thin film 4 normally shows a resistance per unit surface area Rs between $10^2$ and $10^7$ $\Omega/cm^2$. Note that Rs is the resistance defined by R=Rs (l/w), where t, w and l are the thickness, the width and the length of the thin film respectively. Also note that, while the forming process is described by way of an energization forming process for the purpose of the present invention, it is not limited thereto and may include a process where a gap is formed in the thin film to produce a high resistance region there.

The elctroconductive thin film 4 is made of fine particles of a material selected from metals such as Pd, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such TiC, ZrC, HfC, TaC, SiC and WC, nitrides such as TiN, ZrN and HfN, semiconductors such as Si and Ge and carbon.

The term a "fine particle film" as used herein refers to a thin film constituted of a large number of fine particles that may be loosely dispersed, tightly arranged or mutually and randomly overlapping (to form an island structure under certain conditions).

The diameter of fine particles to be used for the purpose of the present invention is between a tenth of a nanometer and hundreds of several nanometers and preferably between a nanometer and twenty nanometers.

Since the term "fine particle" is frequently used herein, it will be described in greater depth below.

A small particle is referred to as a "fine particle" and a particle smaller than a fine particle is referred to as an "ultrafine particle". A particle smaller than an "ultrafine particle" and constituted by several hundred atoms is referred to as a "cluster".

However, these definitions are not rigorous and the scope of each term can vary depending on the particular aspect of the particle to be dealt with. An "ultrafine particle" may be referred to simply as a "fine particle" as in the case of this patent application.

"The Experimental Physics Course No. 14: Surface/Fine Particle" (ed., Koreo Kinoshita; Kyoritu Publication, Sep. 1, 1986) describes as follows.

"A fine particle as used herein referred to a particle having a diameter somewhere between 2 to 3 μm and 10 nm and an ultrafine particle as used herein means a particles having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundred atoms is called a cluster." (Ibid., p. 195, 11.22—26)

Additionally, "Hayashi's Ultrafine Particle Project" of the New Technology Development Corporation defines an "ultrafine particle" as follows, employing a smaller lower limit for the particle size.

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to $10^8$ atoms. From the viewpoint of atom, an ultrafine particle is a huge or ultrahuge particle." (Ultrafine Particle—Creative Science and Technology: ed., Chikara Hayashi, Ryoji Ueda, Akira Tazaki; Mita Publication, 1988, p. 2, 11.1—4)

Taking the above general definitions into consideration, the term a "fine particle" as used herein refers to an agglomerate of a large number of atoms and/or molecules having a diameter with a lower limit between 0.1 nm and 1 nm and an upper limit of several micrometers.

The electron-emitting region 5 is part of the electroconductive thin film 4 and comprises an electrically highly resistive gap, although its performance is dependent on the thickness and the material of the electroconductive thin film 4 and the energization forming process which will be described hereinafter. The electron emitting region 5 may contain in the inside electroconductive fine particles having a diameter between several times of a tenth of a nanometer and tens of several nanometers. The material of such electroconductive fine particles may be selected from all or part of the materials that can be used to prepare the thin film 4 including the electron emitting region. The electron emitting region 5 and part of the thin film 4 surrounding the electron emitting region 5 may contain carbon and carbon compounds.

A surface conduction type electron emitting device according to the invention and having an alternative profile, or a step type surface conduction electron-emitting device, will now be described.

Figure 4:
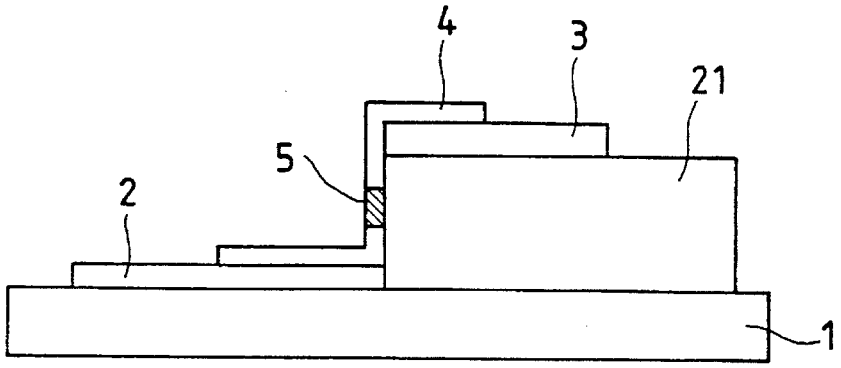
FIG. 4 is a schematic view of another surface conduction electron-emitting device, to which the present invention is applicable.

FIG. 4 is a schematic sectional side view of a step type surface conduction electron emitting device, to which the present invention is applicable.

In FIG. 4, those components that are same or similar to those of FIGS. 3A and 3B are denoted respectively by the same reference symbols. Reference symbol 21 denotes a step-forming section. The device comprises a substrate 1, a pair of device electrodes 2 and 3 and an electroconductive thin film 4 including an electron emitting region 5, which are made of materials same as a flat type surface conduction electron-emitting device as described above, as well as a step-forming section 21 made of an insulating material such as $SiO_2$ produced by vacuum deposition, printing or sputtering and having a film thickness corresponding to the distance L separating the device electrodes of a flat type surface conduction electron-emitting device as described above, or between several hundred nanometers and tens of several micrometers. Preferably, the film thickness of the step-forming section 21 is between tens of several nanometers and several micrometers, although it is selected as a function of the method of producing the step-forming section used there, the voltage to be applied to the device electrodes and the field strength available for electron emission.

As the electroconductive thin film 4 including the electron emitting region is formed after the device electrodes 2 and 3 and the step-forming section 21, it may preferably be laid on the device electrodes 2 and 3. While the electron-emitting region 5 is formed in the step-forming section 21 in FIG. 2, its location and contour are dependent on the conditions under which it is prepared, the energization forming conditions and other related conditions and not limited to those shown there.

Figure 5A:
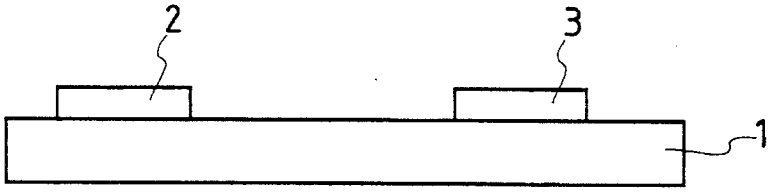
FIGS. 5A through 5C are schematic views of still another surface conduction electron-emitting device, illustrating different steps of manufacturing it, to which the present invention is applicable.
Figure 5B:
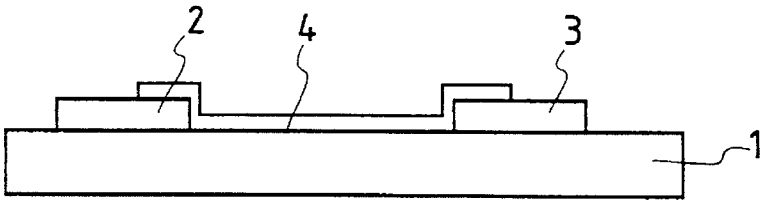
Figure 5C:
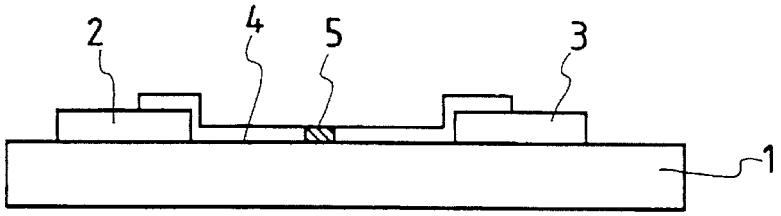

While various methods may be conceivable for manufacturing a surface conduction electron-emitting device, FIGS. 5A through 5C illustrate a typical one of such methods.

Now, a method of manufacturing a flat type surface conduction electron-emitting device according to the invention will be described by referring to FIGS. 3A and 3B and 5A through 5C.

1) After thoroughly cleansing a substrate 1 with detergent and pure water, a material is deposited on the substrate 1 by means of vacuum deposition, sputtering or some other appropriate technique for a pair of device electrodes 2 and 3, which are then produced by photolithography (FIG. 5A).

2) An organic metal thin film is formed on the substrate 1 carrying thereon the pair of device electrodes 2 and 3 by applying an organic metal solution and leaving the applied solution for a given period of time. The organic metal solution may contain as a principal ingredient any of the metals listed above for the electroconductive thin film 4. Thereafter, the organic metal thin film is heated, baked and subsequently subjected to a patterning operation, using an appropriate technique such as lift-off or etching, to produce an electroconductive thin film 4 (FIG. 5B). While an organic metal solution is used to produce a thin film in the above description, an electroconductive thin film 4 may alternatively be formed by vacuum deposition, sputtering, chemical vapor phase deposition, dispersed application, dipping, spinner or some other technique.

Figure 6A:
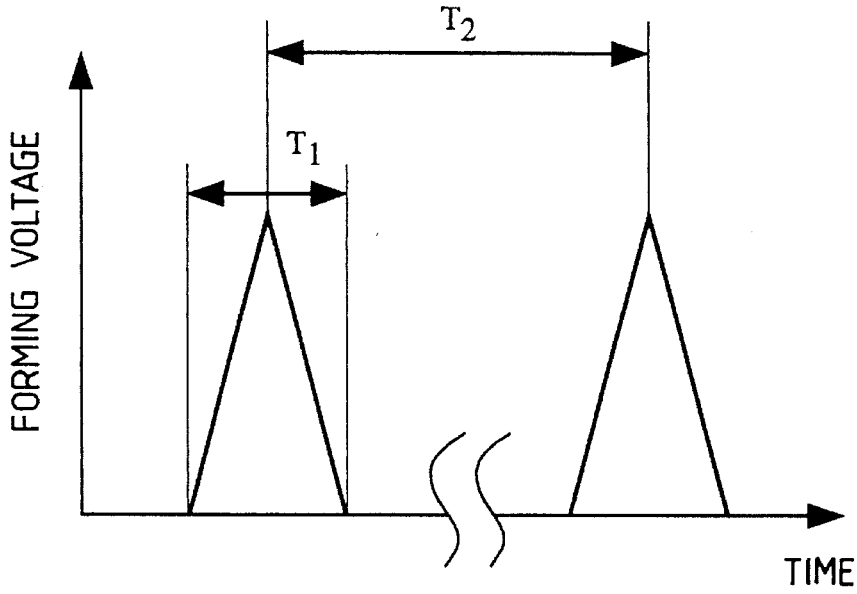
FIGS. 6A and 6B are graphs showing pulse voltage waveforms that can be used for the energization forming process of manufacturing a surface conduction electron-emitting device.
Figure 6B:
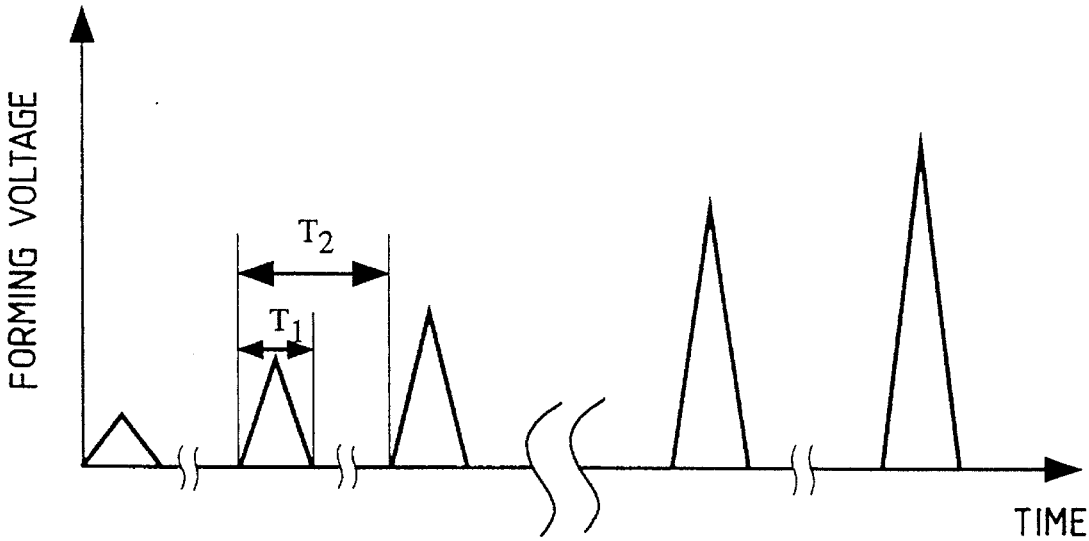

3) Thereafter, the device electrodes 2 and 3 are subjected to a process referred to as "forming". Here, an energization forming process will be described as a choice for forming. More specifically, the device electrodes 2 and 3 are electrically energized by means of a power source (not shown) until an electron emitting region 5 is produced in a given area of the electroconductive thin film 4 to show a modified structure that is different from that of the electroconductive thin film 4. In other words, the electroconductive thin film 4 is locally and structurally destroyed, deformed or transformed to produce an electron emitting region 5 as a result of an energization forming process. FIGS. 6A and 6B show two different pulse voltages that can be used for energization forming.

The voltage to be used for energization forming preferably has a pulse waveform. A pulse voltage having a constant height or a constant peak voltage may be applied continuously as shown in FIG. 6A or, alternatively, a pulse voltage having an increasing height or an increasing peak voltage may be applied as shown in FIG. 6B.

In FIG. 6B, the pulse voltage has a pulse width T1 and a pulse interval T2, which are typically between 1 μsec. and 10 msec. and between 10 μsec. and 100 msec. respectively. The height of the triangular wave (the peak voltage for the energization forming operation) may be appropriately selected depending on the profile of the surface conduction electron-emitting device. The voltage is typically applied for tens of several minutes. Note, however, that the pulse waveform is not limited to triangular and a rectangular or some other waveform may alternatively be used.

FIG. 6B shows a pulse voltage whose pulse height increases with time. In FIG. 6B, the pulse voltage has an width T1 and a pulse interval T2 that are substantially similar to those of FIG. 6A. The height of the triangular wave (the peak voltage for the energization forming operation) is increased at a rate of, for instance, 0.1 V per step.

The energization forming operation will be terminated by measuring the current running through the device electrodes when a voltage that is sufficiently low and cannot locally destroy or deform the electroconductive thin film 2 is applied to the device during an interval T2 of the pulse voltage. Typically the energization forming operation is terminated when a resistance greater than 1M ohms is observed for the device current running through the electroconductive thin film 4 while applying a voltage of approximately 0.1 V to the device electrodes.

4) After the energization forming operation, the device is subjected to an activation process. An activation process is a process by means of which the device current If and the emission current Ie are changed remarkably.

In an activation process, a pulse voltage may be repeatedly applied to the device in an atmosphere of the gas of an organic substance as in the case of energization forming process. The atmosphere may be produced by utilizing the organic gas remaining in a vacuum chamber after evacuating the chamber by means of an oil diffusion pump or a rotary pump or by sufficiently evacuating a vacuum chamber by means of an ion pump and thereafter introducing the gas of an organic substance into the vacuum. The gas pressure of the organic substance is determined as a function of the profile of the electron-emitting device to be treated, the profile of the vacuum chamber, the type of the organic substance and other factors. Organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methylethylketone, methylamine, ethylamine, phenol, formic acid, acetic acid and propionic acid. As a result of an activation process, carbon or a carbon compound is deposited on the device out of the organic substances existing in the atmosphere to remarkably change the device current Ie and the emission current Ie.

Besides the above listed organic substances, inorganic substances such as carbon monoxide (CO) may also be used for the activation process.

For the purpose of the present invention, carbon and a carbon compound refer to graphite and noncrystalline carbon (amorphous carbon, a mixture of amorphous carbon and fine graphite crystal) and the thickness of the deposit of such carbon or a carbon compound is preferably less than 50 nm and more preferably less than 30 nm.

An activation process is typically conducted in a manner as described below.

FIG. 1A is a block diagram of an apparatus designed to carry out an activation process on a surface conduction electron-emitting device or an electron source comprising a plurality of surface conduction electron-emitting devices. Referring to FIG. 1A, there is shown a vacuum chamber 11 in which a surface conduction electron-emitting device or an electron source to be subjected to an activation process is placed. A vacuum pump 15 and other pieces of equipment necessary for the process are connected to the vacuum chamber.

Reference numeral 12 denotes test equipment for testing the electric performance of the electron-emitting device or the electron source. The equipment comprises a number of components such as an ammeter, a high voltage power source and various analyzers. The electric performance may be tested in terms of the relationships between If and Vf and between Ie and Vf, the value of If or Ie corresponding to a particular value of Vf, the ratio of Ie/If and their time differentials on the electron-emitting device or the electron source, whichever appropriate. The averages for all the electron-emitting devices of the electron source may also be determined if necessary.

Reference numeral 13 denotes condition set-up means for, among others, setting up the voltage to be applied to the device. Said means comprises a pulse generator for generating a pulse voltage, switching means for selecting a device to which the voltage is applied, control means for synchronizing the operation of the pulse generator and that of the switching means, activation pulse voltage application means constituted by a current amplifier and other necessary members, atmosphere sensing means such as a pressure gauge or a Q-mass spectrometer, means for introducing gas into the vacuum chamber including a mass flow controller and a solenoid valve and driver means for setting up a desired atmosphere by regulating the mass flow controller and the solenoid valve as well as other necessary means.

Figure 1B:
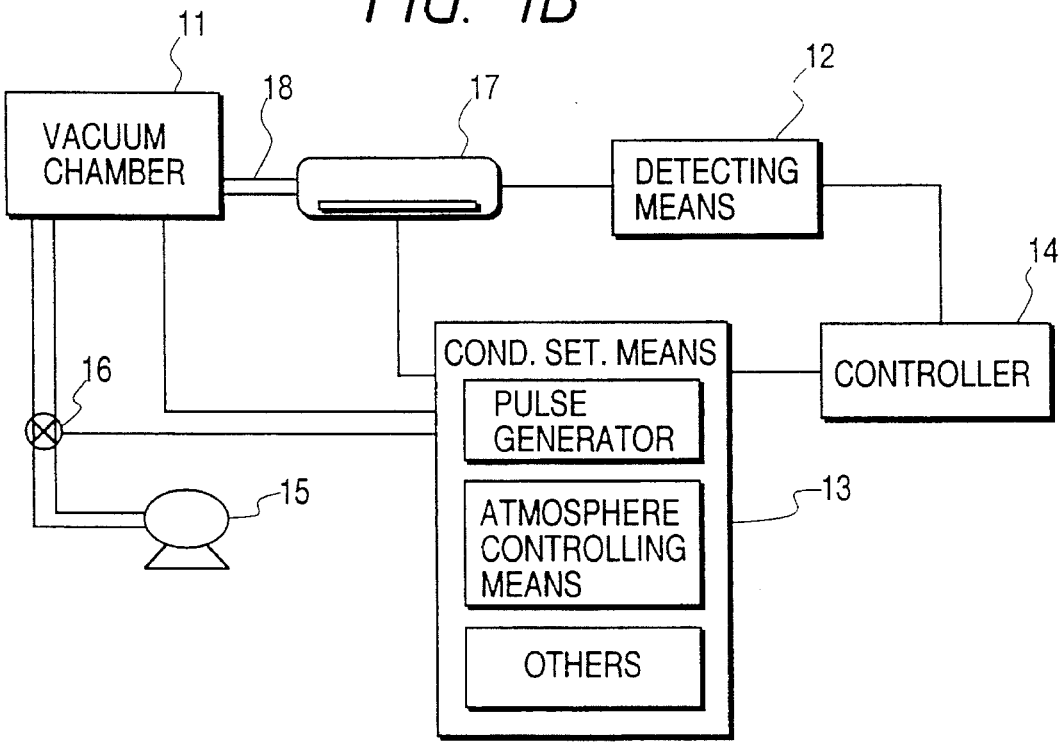
FIG. 1B is a block diagram of a manufacturing apparatus according to the invention, showing another possible configuration thereof.

FIG. 1B is a block diagram of an apparatus designed to carry out an activation process on an image forming apparatus comprising a vacuum container, an electron source and an image forming member such as a fluorescent body. An image forming apparatus 17 is connected to a vacuum chamber 11 by way of an exhaust pipe 18. The atmosphere in the apparatus is controlled by sensing the atmosphere in the vacuum chamber and regulating the means for introducing gas a member of the condition set-up means 13 and the gate valve 16 for evacuation.

Reference numeral 14 denote control means. If determines the conditions for the activation process and the timing for the process to be terminated on the basis of a given program and the data obtained by the test equipment 12 and drives the condition set-up means 13 to operate.

How the activation process is controlled will be described below by referring to the flow chart of FIG. 2.

A starting sequence is a series of operations designed to set up initial conditions required to start an activation process. For example, the inside of the vacuum chamber is evacuated to a pressure lower than a predetermined level and thereafter substances that are necessary for the activation process such as methane, acetone and/or other organic substances are introduced into the activation process in this step. If necessary, the electron source folder of the apparatus will be heated before the sequence is completed.

Thereafter, the process proceeds to a regular sequence. This is a series of operations, during which the atmosphere and the pulse voltage may be maintained to respective constant levels, while the pulse wave height and the pulse width may be varied as a function of time according to a given program, or the atmosphere may also be varied by gradually modifying the partial pressures of the organic substances or by intermittently introducing an etching gas such as hydrogen gas for etching carbon with a predetermined cycle.

In a sensing step, the electric performance of the electron-emitting device is tested in a number of aspects to better control the process. This step may be conducted by periodically interrupting the regular sequence and inserting a pulse voltage specifically designed for measurement or by constantly using the pulse voltage of the regular sequence also for this step.

If a rectangular pulse is used for the regular sequence of the activation process, a triangular pulse voltage may be intermittently and additionally applied to the object of measurement and If and/or Ie of the object may be monitored to see its performance. The form of the pulse voltage is not limited to triangle and a rectangular pulse voltage having a wave height different from that of the pulse voltage of the regular sequence may alternatively be used.

On the other hand, if a triangular, trapezoidal or step-like pulse is used for the regular sequence of the activation process, the sensing step can be carried out concurrently.

When a plurality of electron-emitting devices are simultaneously treated for activation or an electron source comprising a plurality of electron-emitting devices arranged in a number of lines is subjected to an activation process on a line by line basis, the sensing step may be carried out on each device or on each line of devices. Alternatively, it may be carried out by selecting more than one devices or lines of devices as specimens for observation.

In a deciding step, the data obtained in the sensing sequence are checked against given data to decide how to control the condition set-up means. More specifically, it is decided here (1) to continue the regular sequence, (2) to move to a processing sequence or (3) to move to a closing sequence.

A processing sequence is a sequence of operations for modifying the regular sequence. As a result of this sequence, some or all of the conditions for conducting the regular sequence may be modified or the regular sequence may be resumed after predetermined operational steps.

A closing sequence is a series of operations for terminating an activation process. In this sequence, for example, the application of the pulse voltage and the supply of the organic substances and the etching gas are stopped and the inside of the vacuum container is further evacuated to ensure that the inner pressure falls under a given level.

5) An electron-emitting device that has been treated in an energization forming process and an activation process is then preferably subjected to a stabilization process. This is a process for removing any organic substances remaining in the vacuum chamber. The vacuuming and exhausting equipment to be used for this process preferably does not involve the use of oil so that it may not produce any evaporated oil that can adversely affect the performance of the treated device during the process. Thus, the use of a sorption pump or an ion pump may be a preferable choice.

If an oil diffusion pump or a rotary pump is used for the activation process and the organic gas produced by the oil is also utilized, the partial pressure of the organic gas has to be minimized by any means. The partial pressure of the organic gas in the vacuum chamber is preferably lower than $1\times10^{-6}$ Pa and more preferably lower than $1\times10^{-8}$ Pa if no carbon or carbon compound is additionally deposited. The vacuum chamber is preferably evacuated after heating the entire chamber so that organic molecules adsorbed by the inner walls of the vacuum chamber and the electron-emitting device(s) in the chamber may also be easily eliminated. While the vacuum chamber is preferably heated to 80° to 250° C. for more than 5 hours in most cases, other heating conditions may alternatively be selected depending on the size and the profile of the vacuum chamber and the configuration of the electron-emitting device(s) in the chamber as well as other considerations. The pressure in the vacuum chamber needs to be made as low as possible and it is preferably lower than 1 to $4\times10^{-5}$ Pa and more preferably lower than $1\times10^{-6}$ Pa.

After the stabilization process, the atmosphere for driving the electron-emitting device or the electron source is preferably same as the one when the stabilization process is completed, although a lower pressure may alternatively be used without damaging the stability of operation of the electron-emitting device or the electron source if the organic substances in the chamber are sufficiently removed.

By using such an atmosphere, the formation of any additional deposit of carbon or a carbon compound can be effectively suppressed to consequently stabilize the device current If and the emission current Ie.

The performance of a electron-emitting device prepared by way of the above processes, to which the present invention is applicable, will be described by referring to FIGS. 8 and 9.

Figure 8:
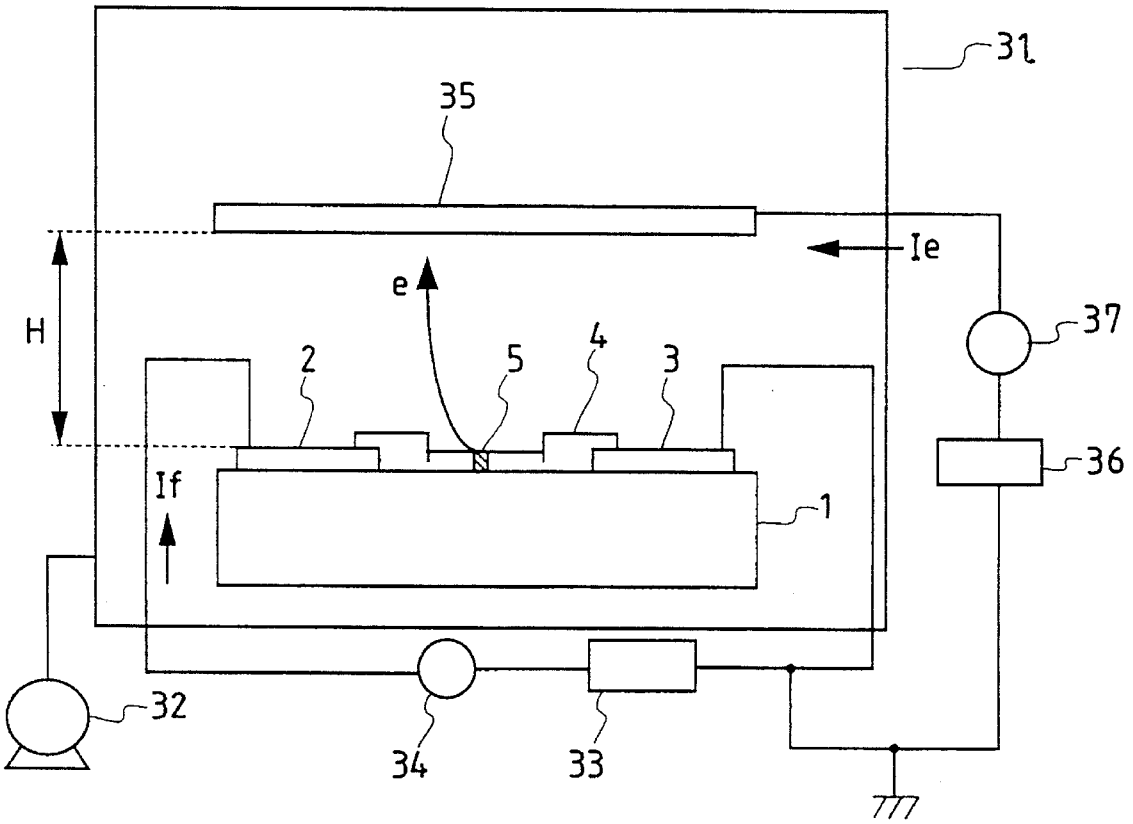
FIG. 8 is a block diagram of a gauging system for determining the electron emitting performance of a surface conduction electron-emitting device or an electron source.

FIG. 8 is a schematic block diagram of an arrangement comprising a vacuum chamber that can be used for the above processes. It can also be used as a gauging system for determining the performance of an electron emitting device of the type under consideration. Referring to FIG. 8, the gauging system includes a vacuum chamber 31 and a vacuum pump 32. An electron-emitting device is placed in the vacuum chamber 31. The device comprises a substrate 1, a pair of device electrodes 2 and 3, a thin film 4 and an electron-emitting region 5. Otherwise, the gauging system has a power source 33 for applying a device voltage Vf to the device, an ammeter 34 for metering the device current If running through the thin film 4 between the device electrodes 2 and 3, an anode 35 for capturing the emission current Ie produced by electrons emitted from the electron-emitting region of the device, a high voltage source 36 for applying a voltage to the anode 35 of the gauging system and another ammeter 37 for metering the emission current Ie produced by electrons emitted from the electron-emitting region 5 of the device.

For determining the performance of the electron-emitting device, a voltage between 1 and 10 KV may be applied to the anode, which is spaced apart from the electron-emitting device by distance H which is between 2 and 8 mm.

Instruments including a vacuum gauge and other pieces of equipment necessary for the gauging system are arranged in the vacuum chamber 31 so that the performance of the electron-emitting device or the electron source in the chamber may be properly tested. The vacuum pump 32 may be provided with an ordinary high vacuum system comprising a turbo pump or a rotary pump or an oil-free high vacuum system comprising an oil-free pump such as a magnetic levitation turbo pump or a dry pump and an ultra-high vacuum system comprising an ion pump. The vacuum chamber containing an electron source therein can be heated to 250° C. by means of a heater (not shown).

Figure 9:
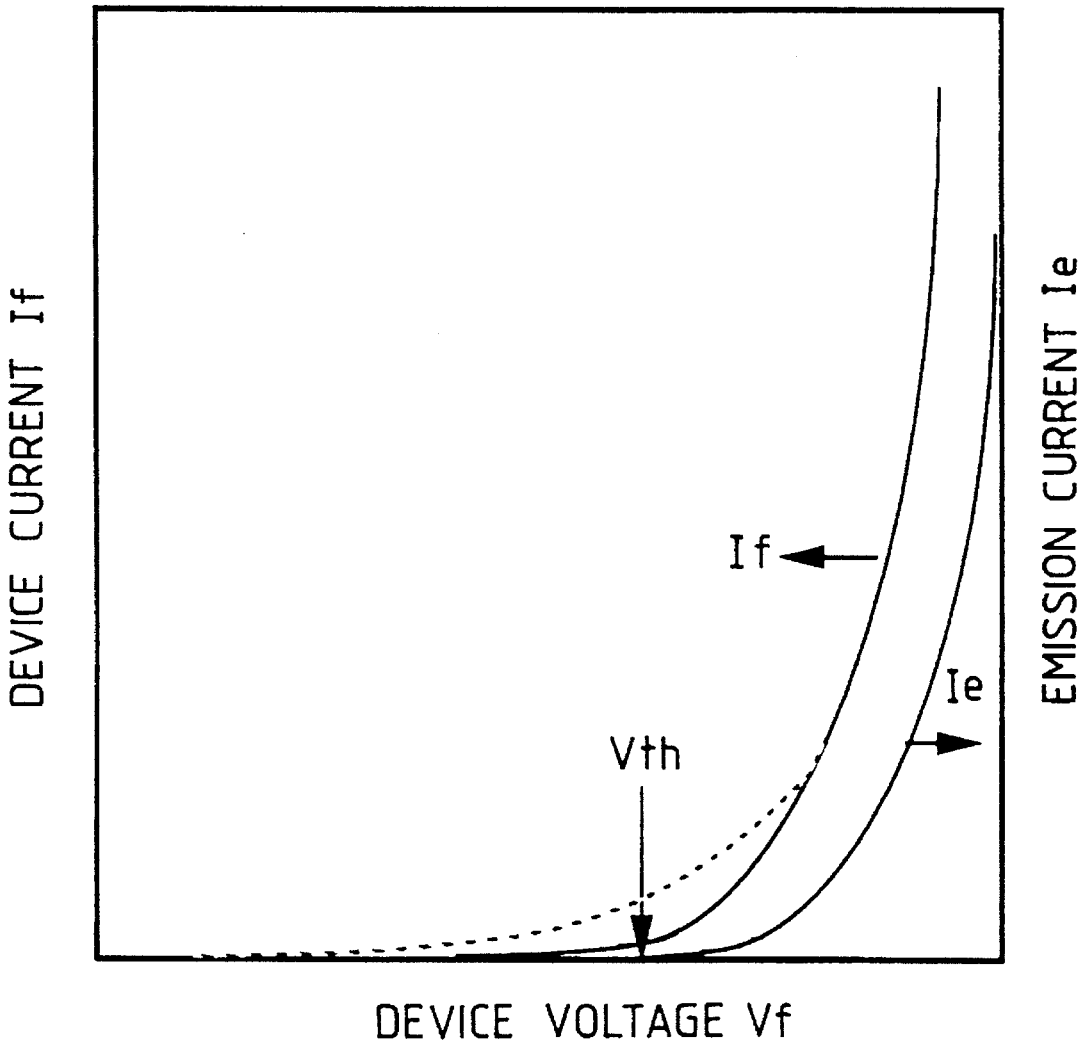
FIG. 9 is a graph showing the relationship between the device voltage and the device current as well as the relationship between the device voltage and the emission current of a surface conduction electron-emitting device or an electron source.

FIG. 9 shows a graph schematically illustrating the relationship between the device voltage Vf and the emission current Ie and the device current If typically observed by the gauging system of FIG. 8. Note that different units are arbitrarily selected for Ie and If in FIG. 9 in view of the fact that Ie has a magnitude by far smaller than that of If. Note that both the vertical and transversal axes of the graph represent a linear scale.

As seen in FIG. 9, an electron-emitting device according to the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 9), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is highly dependent on the device voltage Vf, the former can be effectively controlled by way of the latter.

(iii) Thirdly, the emitted electric charge captured by the anode 35 is a function of the duration of time of application of the device voltage Vf. In other words, the amount of electric charge captured by the anode 35 can be effectively controlled by way of the time during which the device voltage Vf is applied.

Because of the above remarkable features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

On the other hand, the device current If either monotonically increases relative to the device voltage Vf (as shown by a solid line in FIG. 9, a characteristic referred to as "MI characteristic" hereinafter) or changes to show a curve (not shown) specific to a voltage-controlled-negative-resistance characteristic (a characteristic referred to as "VCNR characteristic" hereinafter). These characteristics of the device current are dependent on a number of factors including the manufacturing method, the conditions where it is gauged and the environment for operating the device.

While a threshold voltage exists for If as in the case of Ie, If lingers for a long low Vf range as schematically shown by a broken line in FIG. 9 if the leak current is not negligible so that the threshold voltage will inevitably be very low.

Now, some examples of the usage of electron-emitting devices, to which the present invention is applicable, will be described. An electron source and hence an image-forming apparatus can be realized by arranging a plurality of electron-emitting devices according to the invention on a substrate.

Electron-emitting devices may be arranged on a substrate in a number of different modes.

For instance, a number of electron-emitting devices may be arranged in parallel rows along a direction (hereinafter referred to row-direction), each device being connected by wirings at opposite ends thereof, and driven to operate by control electrodes (hereinafter referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along an X-direction and columns along an Y-direction to form a matrix, the X- and Y-directions being perpendicular to each other, and the electron-emitting devices on a same row are connected to a common X-directional wiring by way of one of the electrodes of each device while the electron-emitting devices on a same column are connected to a common Y-directional wiring by way of the other electrode of each device. The latter arrangement is referred to as a simple matrix arrangement. Now, the simple matrix arrangement will be described in detail.

In view of the above described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

FIG. 8 is a schematic plan view of the substrate of an electron source realized by arranging a plurality of electron-emitting devices, to which the present invention is applicable, in order to exploit the above characteristic features. In FIG. 8, the electron source comprises a substrate 71, X-directional wirings 72, Y-directional wirings 73, surface conduction electron-emitting devices 74 and connecting wires 75. The surface conduction electron-emitting devices may be either of the flat type or of the step type described earlier.

There are provided a total of m X-directional wirings 72, which are donated by Dx1, Dx2, . . . , Dxm and made of an electroconductive metal produced by vacuum deposition, printing or sputtering. These wirings are so designed in terms of material, thickness and width that, if necessary, a substantially equal voltage may be applied to the surface conduction electron-emitting devices. A total of n Y-directional wirings are arranged and donated by Dy1, Dy2, . . . , Dyn, which are similar to the X-directional wirings in terms of material, thickness and width. An interlayer insulation layer (not shown) is disposed between the m X-directional wirings and the n Y-directional wirings to a electrically isolate them from each other. (Both m and n are integers).

The interlayer insulation layer (not shown) is typically made of $SiO_2$ and formed on the entire surface or part of the surface of the insulating substrate 71 to show a desired contour by means of vacuum deposition, printing or sputtering. The thickness, material and manufacturing method of the interlayer insulation layer are so selected as to make it withstand the potential difference between any of the X-directional wirings 72 and any of the Y-directional wiring 73 observable at the crossing thereof. Each of the X-directional wirings 72 and the Y-directional wirings 73 is drawn out to form an external terminal.

The oppositely arranged electrodes (not shown) of each of the surface conduction electron-emitting devices 74 are connected to related one of the m X-directional wirings 72 and related one of the n Y-directional wirings 73 by respective connecting wires 75 which are made of an electroconductive metal.

The electroconductive metal material of the device electrodes and that of the connecting wires 75 extending from the m X-directional wirings 72 and the n Y-directional wirings 73 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires.

The X-directional wirings 72 are electrically connected to a scan signal application means (not shown) for applying a scan signal to a selected row of surface conduction electron-emitting devices 74. On the other hand, the Y-directional wirings 73 are electrically connected to a modulation signal generation means (not shown) for applying a modulation signal to a selected column of surface conduction electron-emitting devices 74 and modulating the selected column according to an input signal. Note that the drive signal to be applied to each surface conduction electron-emitting device is expressed as the voltage difference of the scan signal and the modulation signal applied to the device.

With the above arrangement, each of the devices can be selected and driven to operate independently by means of a simple matrix wiring arrangement.

Figure 11:
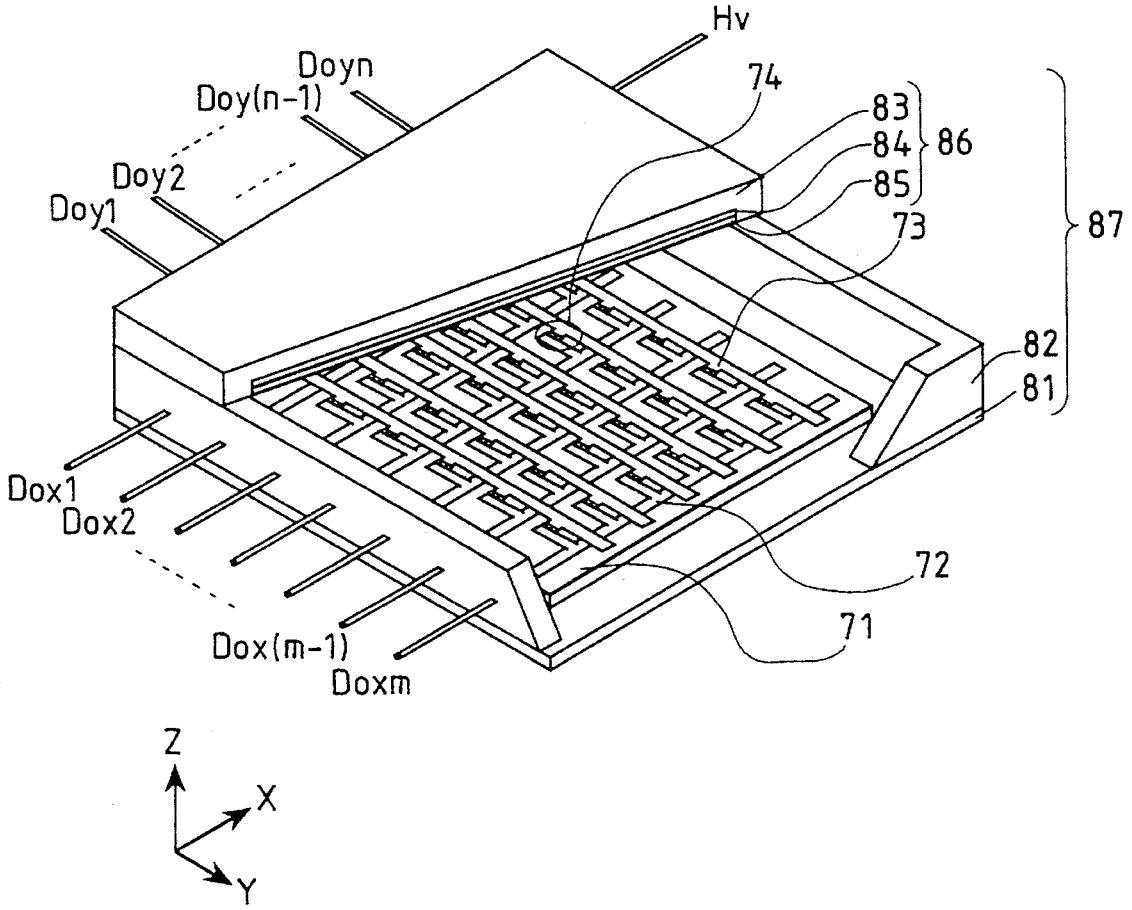
FIG. 11 is a partial cut away schematic perspective view of an image forming apparatus comprising an electron source of matrix arrangement.
Figure 12A:
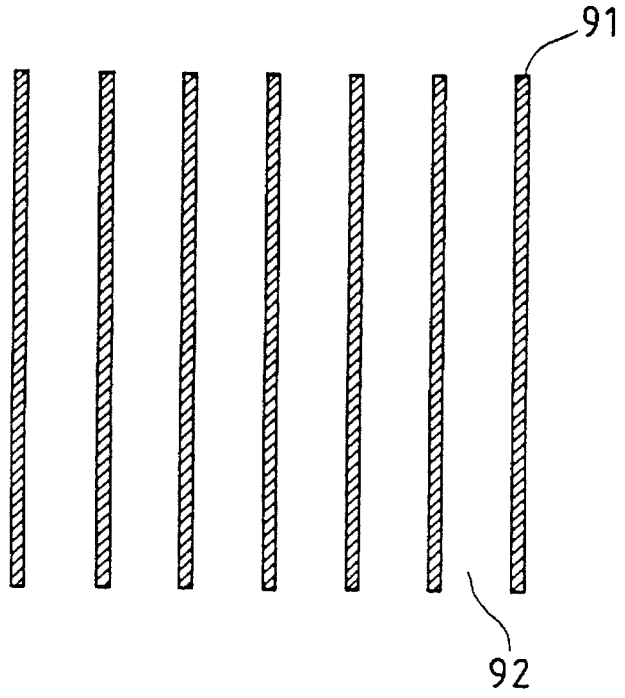
FIGS. 12A and 12B are schematic views, illustrating two possible configurations of fluorescent film that can be used for the purpose of the present invention.
Figure 12B:
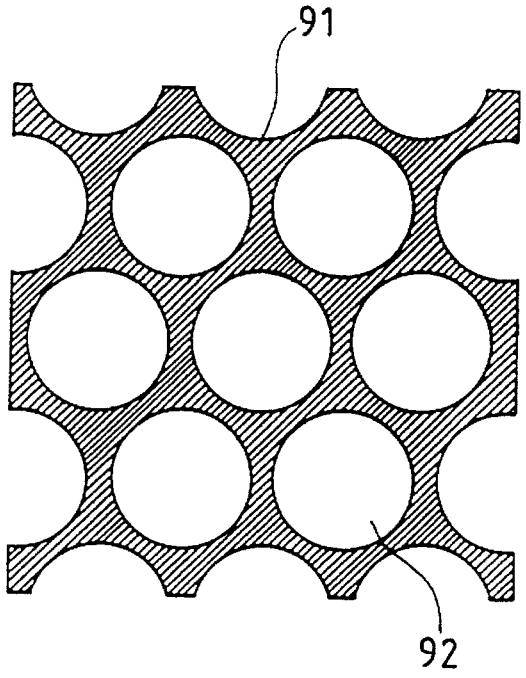
Figure 13:
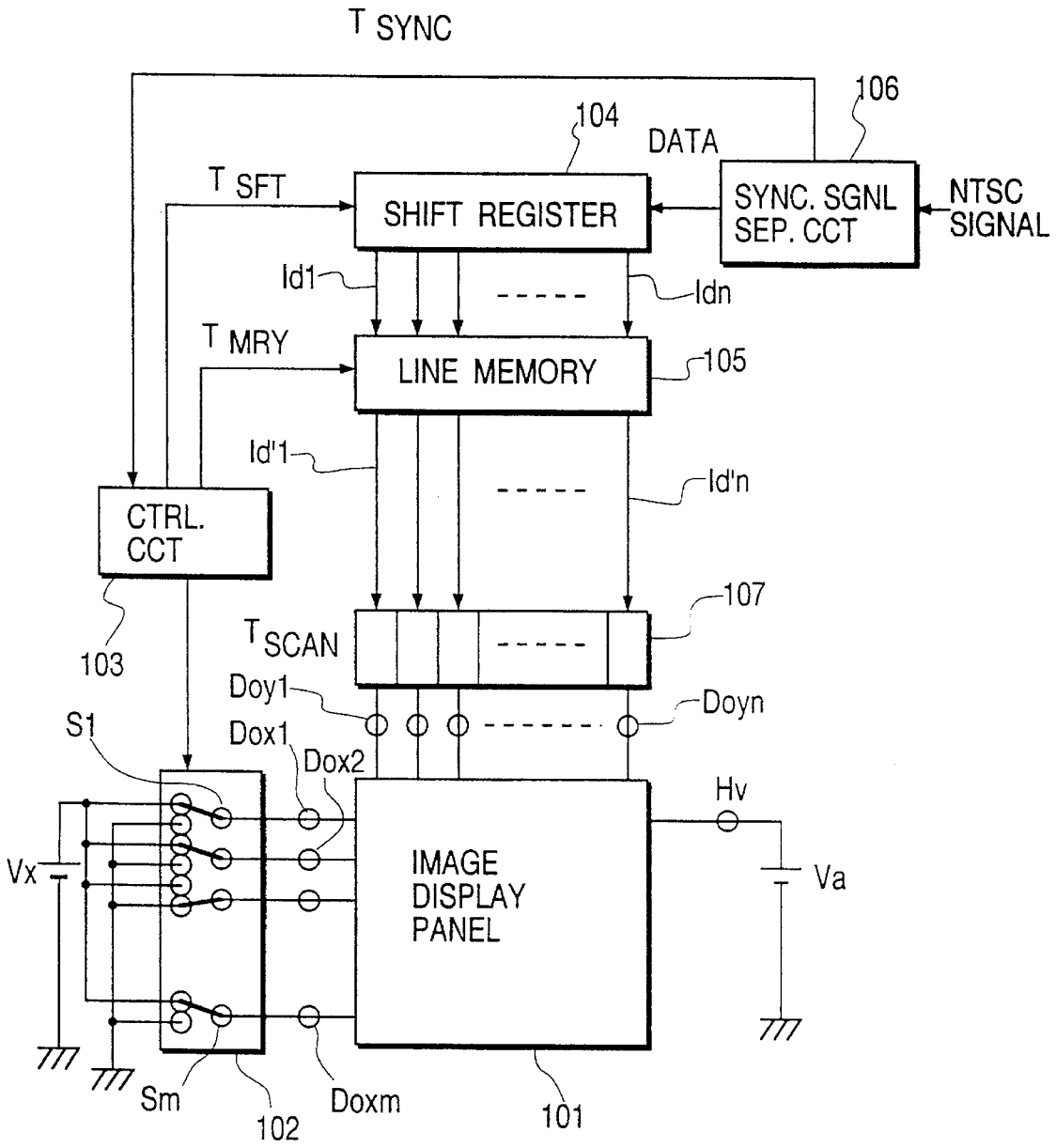
FIG. 13 is a block diagram of a drive circuit of an image forming apparatus, to which the present invention is applicable.

Now, an image-forming apparatus comprising an electron source having a simple matrix arrangement as described above will be described by referring to FIGS. 11, 12A, 12B and 13. FIG. 11 is a partially cut away schematic perspective view of the image forming apparatus and FIGS. 12A and 12B are schematic views, illustrating two possible configurations of a fluorescent film that can be used for the image forming apparatus of FIG. 11, whereas FIG. 13 is a block diagram of a drive circuit for the image forming apparatus of FIG. 11 that operates for NTSC television signals.

Referring firstly to FIG. 11 illustrating the basic configuration of the display panel of the image-forming apparatus, it comprises an electron source substrate 71 of the above described type carrying thereon a plurality of electron-emitting devices, a rear plate 81 rigidly holding the electron source substrate 71, a face plate 86 prepared by laying a fluorescent film 84 and a metal back 85 on the inner surface of a glass substrate 83 and a support frame 82, to which the rear plate 81 and the face plate 86 are bonded by means of frit glass. Reference numeral 87 denote an envelope, which is baked to 400° to 500° C. for more than 10 minutes in the atmosphere or in nitrogen and hermetically and airtightly sealed.

In FIG. 11, reference numeral 74 denotes the electron-emitting region of each electron-emitting device as shown in FIG. 3 and reference numerals 72 and 73 respectively denotes the X-directional wiring and the Y-directional wiring connected to the respective device electrodes of each electron-emitting device.

While the envelope 87 is formed of the face plate 86, the support frame 82 and the rear plate 81 in the above described embodiment, the rear plate 81 may be omitted if the substrate 71 is strong enough by itself because the rear plate 81 is provided mainly for reinforcing the substrate 71. If such is the case, an independent rear plate 81 may not be required and the substrate 71 may be directly bonded to the support frame 82 so that the envelope 87 is constituted of a face plate 86, a support frame 82 and a substrate 71. The overall strength of the envelope 87 may be increased by arranging a number of support members called spacers (not shown) between the face plate 86 and the rear plate 81.

FIGS. 12A and 12B schematically illustrate two possible arrangements of fluorescent film. While the fluorescent film 84 comprises only a single fluorescent body if the display panel is used for showing black and white pictures, it needs to comprise for displaying color pictures black conductive members 91 and fluorescent bodies 92, of which the former are referred to as black stripes or members of a black matrix depending on the arrangement of the fluorescent bodies. Black stripes or members of a black matrix are arranged for a color display panel so that the fluorescent bodies 92 of three different primary colors are made less discriminable and the adverse effect of reducing the contrast of displayed images of external light is weakened by blackening the surrounding areas. While graphite is normally used as a principal ingredient of the black stripes, other conductive material having low light transmissivity and reflectivity may alternatively be used.

A precipitation or printing technique is suitably be used for applying a fluorescent material on the glass substrate regardless of black and white or color display. An ordinary metal back 85 is arranged on the inner surface of the fluorescent film 84. The metal back 85 is provided in order to enhance the luminance of the display panel by causing the rays of light emitted from the fluorescent bodies and directed to the inside of the envelope to turn back toward the face plate 86, to use it as an electrode for applying an accelerating voltage to electron beams and to protect the fluorescent bodies against damages that may be caused when negative ions generated inside the envelope collide with them. It is prepared by smoothing the inner surface of the fluorescent film 75 (in an operation normally called "filming") and forming an Al film thereon by vacuum deposition after forming the fluorescent film 84.

A transparent electrode (not shown) may be formed on the face plate 86 facing the outer surface of the fluorescent film 84 in order to raise the conductivity of the fluorescent film 84.

Care should be taken to accurately align each set of color fluorescent bodies and an electron-emitting device, if a color display is involved, before the above listed components of the envelope are bonded together.

A forming process is carried out for the surface conduction electron-emitting devices in a manner as will be described hereinafter.

Then an activation process is carried out as follows. FIG. 1B illustrates an arrangement that can suitably be used for this process.

The image forming apparatus that has been hermetically and airtightly sealed as described above is connected to a vacuum chamber by way of an exhaust pipe. The vacuum chamber is evacuated by means of a vacuum pump until the inner pressure of the chamber gets to a predetermined level.

The arrangement comprises test equipment, condition setup means and control means similar to those of the arrangement for activating a surface conduction electron-emitting device or an electron source comprising a plurality of such devices that is described earlier. However, since it is difficult to directly monitor the atmosphere in the inside of the envelope of the image forming apparatus during the activation process, the atmosphere in the inside of the vacuum chamber is normally monitored and controlled to control that of the apparatus.

For controlling the atmosphere in the inside of the vacuum chamber, the procedure as illustrated in the flow chart of FIG. 2 is used as in the case of activating a surface conduction electron-emitting device or an electron source comprising a plurality of such devices.

The envelope 87 is evacuated by means of an appropriate vacuum pump such as an ion pump or a sorption pump that does not involve the use of oil, while it is being heated as in the case of the stabilization process, until the atmosphere in the inside is reduced to a degree of vacuum of $10^{-5}$ Pa containing organic substances to a sufficiently low level and then it is hermetically and airtightly sealed. A getter process may be conducted in order to maintain the achieved degree of vacuum in the inside of the envelope 87 after it is sealed. In a getter process, a getter arranged at a predetermined position in the envelope 87 is heated by means of a resistance heater or a high frequency heater to form a film by vapor deposition immediately before or after the envelope 87 is sealed. A getter typically contains Ba as a principal ingredient and can maintain a degree of vacuum between $1\times10^{-4}$ and $1\times10^{-5}$ by the adsorption effect of the vapor deposition film.

Now, a drive circuit for driving a display panel comprising an electron source with a simple matrix arrangement for displaying television images according to NTSC television signals will be described by referring to FIG. 13. In FIG. 13, reference numeral 101 denotes a display panel. Otherwise, the circuit comprises a scan circuit 102, a control circuit 103, a shift register 104, a line memory 105, a synchronizing signal separation circuit 106 and a modulation signal generator 107. Vx and Va in FIG. 13 denote DC voltage sources.

The display panel 101 is connected to external circuits via terminals Dox1 through Doxm, Doy1 through Doyn and high voltage terminal Hv, of which terminals Dox1 through Doxm are designed to receive scan signals for sequentially driving on a one-by-one basis the rows (of N devices) of an electron source in the apparatus comprising a number of surface-conduction type electron-emitting devices arranged in the form of a matrix having M rows and N columns.

On the other hand, terminals Doy1 through Doyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 KV, which is sufficiently high to energize the fluorescent bodies of the selected surface-conduction type electron-emitting devices.

The scan circuit 102 operates in a manner as follows. The circuit comprises M switching devices (of which only devices S1 and Sm are specifically indicated in FIG. 13), each of which takes either the output voltage of the DC voltage source Vx or 0[V] (the ground potential level) and comes to be connected with one of the terminals Dox1 through Doxm of the display panel 101. Each of the switching devices S1 through Sm operates in accordance with control signal Tscan fed from the control circuit 103 and can be prepared by combining transistors such as FETs.

The DC voltage source Vx of this circuit is designed to output a constant voltage such that any drive voltage applied to devices that are not being scanned due to the performance of the surface conduction electron-emitting devices (or the threshold voltage for electron emission) is reduced to less than threshold voltage.

The control circuit 103 coordinates the operations of related components so that images may be appropriately displayed in accordance with externally fed video signals. It generates control signals Tscan, Tsft and Tmry in response to synchronizing signal Tsync fed from the synchronizing signal separation circuit 106, which will be described below.

The synchronizing signal separation circuit 106 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 106 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 104, is designed as DATA signal.

The shift register 104 carries out for each line a serial/parallel conversion on DATA signals that are serially fed on a time series basis in accordance with control signal Tsft fed from the control circuit 103. (In other words, a control signal Tsft operates as a shift clock for the shift register 104.) A set of data for a line that have undergone a serial/parallel conversion (and correspond to a set of drive data for N electron-emitting devices) are sent out of the shift register 104 as n parallel signals Id1 through Idn.

The line memory 105 is a memory for storing a set of data for a line, which are signals Id1 through Idn, for a required period of time according to control signal Tmry coming from the control circuit 103. The stored data are sent out as I'd1 through I'dn and fed to modulation signal generator 107.

Said modulation signal generator 107 is in fact a signal source that appropriately drives and modulates the operation of each of the surface-conduction type electron-emitting devices and output signals of this device are fed to the surface-conduction type electron-emitting devices in the display panel 101 via terminals Doy1 through Doyn.

As described above, an electron-emitting device, to which the present invention is applicable, is characterized by the following features in terms of emission current Ie. Firstly, there exists a clear threshold voltage Vth and the device emit electrons only a voltage exceeding Vth is applied thereto. Secondly, the level of emission current Ie changes as a function of the change in the applied voltage above the threshold level Vth, although the value of Vth and the relationship between the applied voltage and the emission current may vary depending on the materials, the configuration and the manufacturing method of the electron-emitting device. More specifically, when a pulse-shaped voltage is applied to an electron-emitting device according to the invention, particularly no emission current is generated so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either modulation method or pulse width modulation may be used for modulating an electron-emitting device in response to an input signal. With voltage modulation, a voltage modulation type circuit is used for the modulation signal generator 107 so that the peak level of the pulse shaped voltage is modulated according to input data, while the pulse width is held constant.

With pulse width modulation, on the other hand, a pulse width modulation type circuit is used for the modulation signal generator 107 so that the pulse width of the applied voltage may be modulated according to input data, while the peak level of the applied voltage is held constant.

Although it is not particularly mentioned above, the shift register 104 and the line memory 105 may be either of digital or of analog signal type so long as serial/parallel conversions and storage of video signals are conducted at a given rate.

If digital signal type devices are used, output signal DATA of the synchronizing signal separation circuit 106 needs to be digitized. However, such conversion can be easily carried out by arranging an A/D converter at the output of the synchronizing signal separation circuit 106. It may be needless to say that different circuits may be used for the modulation signal generator 107 depending on if output signals of the line memory 105 are digital signals or analog signals. If digital signals are used, a D/A converter circuit of a known type may be used for the modulation signal generator 107 and an amplifier circuit may additionally be used, if necessary. As for pulse width modulation, the modulation signal generator 107 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 107 and a level shift circuit may be added thereto if necessary. As for pulse width modulation, a known voltage control type oscillation circuit (VCO) may be used with, if necessary, an additional amplifier to be used for voltage amplification up to the drive voltage of surface-conduction type electron-emitting device.

With an image forming apparatus having a configuration as described above, to which the present invention is applicable, the electron-emitting devices emit electrons as a voltage is applied thereto by way of the external terminals Dox1 through Doxm and Doy1 through Doyn. Then, the generated electron beams are accelerated by applying a high voltage to the metal back 85 or a transparent electrode (not shown) by way of the high voltage terminal Hv. The accelerated electrons eventually collide with the fluorescent film 84, which by turn glows to produce images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 14 and 15.

Figure 14:
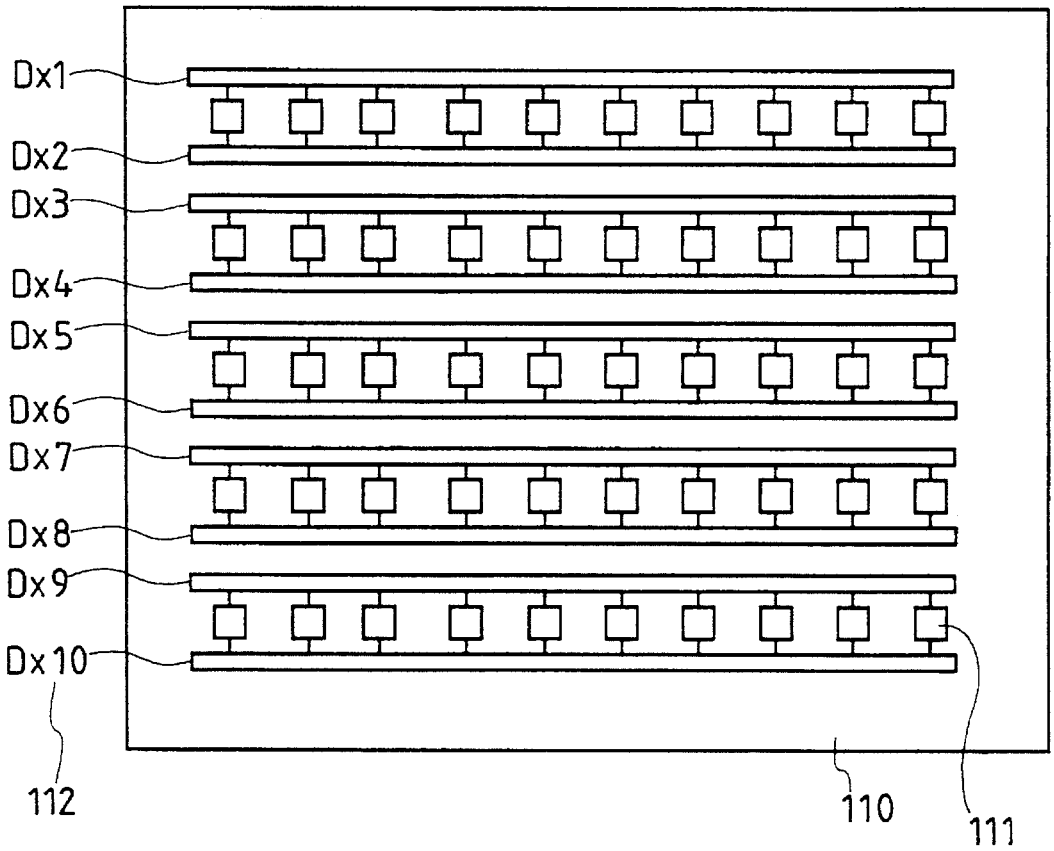
FIG. 14 is a schematic plan view of an electron source of ladder arrangement.

Firstly referring to FIG. 14, reference numeral 110 denotes an electron source substrate and reference numeral 111 denotes a surface conduction electron-emitting device arranged on the substrate, whereas reference numeral 112 denotes common wirings Dx1 through Dx10 for connecting the surface conduction electron-emitting devices. The electron-emitting devices 111 are arranged in rows (to be referred to as device rows hereinafter) to form an electron source comprising a plurality of device rows, each row having a plurality of devices. The surface conduction electron-emitting devices of each device row are electrically connected in parallel with each other by a pair of common wirings so that they can be driven independently by applying an appropriate drive voltage to the pair of common wirings. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wiring. Thus, of the common wirings Dx2 through Dx9, Dx2 and Dx3 can share a single common wiring instead of two wirings.

Figure 15:
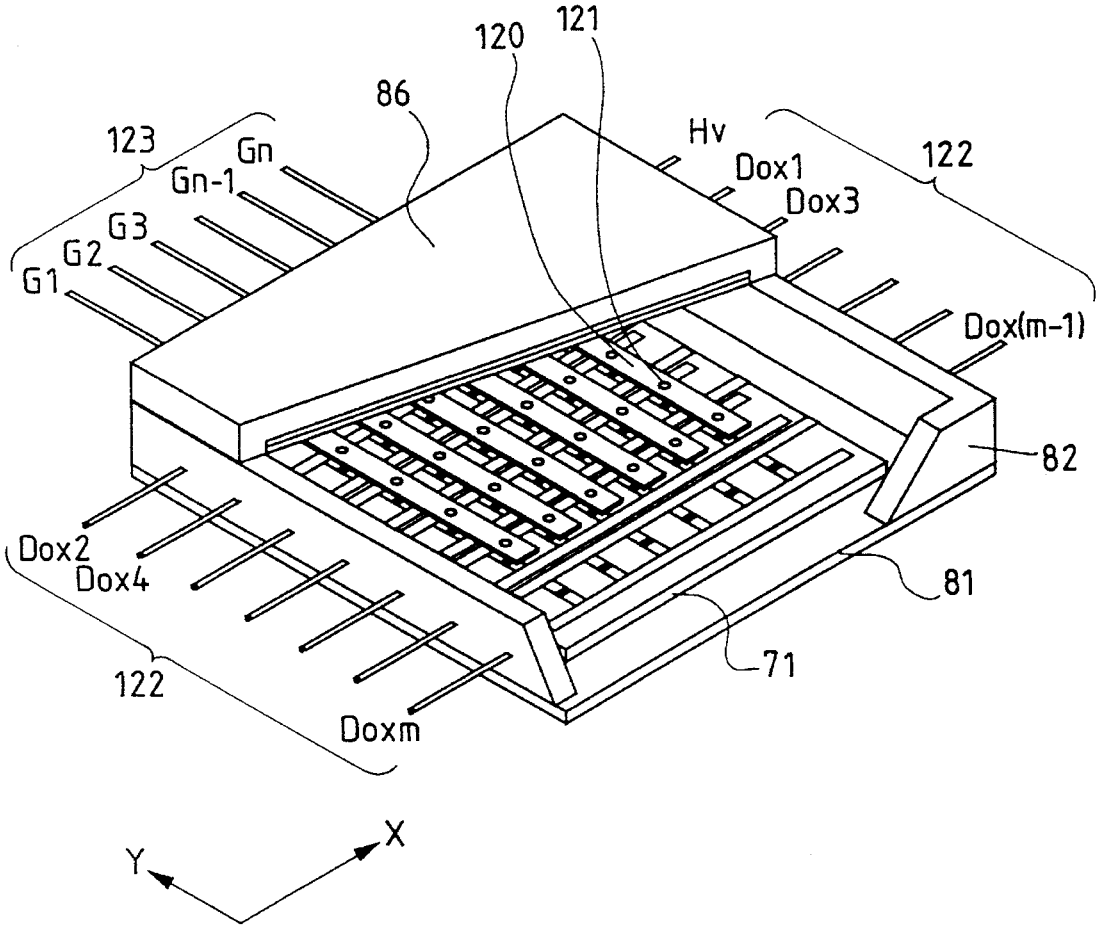
FIG. 15 is a partially cut away schematic perspective view of an image forming apparatus comprising an electron source of ladder arrangement.

FIG. 15 is a schematic perspective view of the display panel of an image-forming apparatus incorporating an electron source having a ladder-like arrangement of electron-emitting devices. In FIG. 15, the display panel comprises grid electrodes 120, each provided with a number of bores for allowing electrons to pass therethrough and a set of external terminals Dox1, Dox2, . . . , Doxm along with another set of external terminals G1, G2, . . . , Gn connected to the respective grid electrodes 120 and an electron source substrate 71. The image forming apparatus differs from the image forming apparatus with a simple matrix arrangement of FIG. 11 mainly in that the apparatus of FIG. 15 has grid electrodes 120 arranged between the electron source substrate 71 and the face plate 86.

In FIG. 15, the stripe-shaped grid electrodes 120 are arranged between the substrate 71 and the face plate 86 perpendicularly relative to the ladder-like device rows for modulating electron beams emitted from the surface conduction electron-emitting devices, each provided with through bores 121 in correspondence to respective electron-emitting devices for allowing electron beams to pass therethrough. Note that, however, while stripe-shaped grid electrodes are shown in FIG. 15, the profile and the locations of the electrodes are not limited thereto. For example, they may alternatively be provided with mesh-like openings and arranged around or close to the surface conduction electron-emitting devices.

The external terminals D1 through Dm and the external terminals for the grids G1 through Gn are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

Now, the present invention will be described by way of examples.

[EXAMPLE 1]

FIGS. 3A and 3B schematically illustrate an electron-emitting device prepared in this example. While only a single device is shown for the purpose of simplification, five devices are arranged in parallel on a substrate of an electron source prepared in this example. The process employed for manufacturing the electron source will be described by referring to FIGS. 5A through 5C.

Step-a:

After thoroughly cleansing a soda lime glass plate, a silicon oxide film was formed thereon to a thickness of 0.5 μm by sputtering to produce a substrate 1, on which a pattern of photoresist (RD-2000N-41: available from Hitachi Chemical Co., Ltd.) corresponding to the pattern of a pair of electrodes having openings was formed. Then, a Ti film and an Ni film were sequentially formed to respective thicknesses of 5 nm and 100 nm by vacuum deposition. Thereafter, the photoresist was dissolved by an organic solvent and the Ni/Ti film was lifted off to produce a pair of device electrodes 2 and 3. The device electrodes was separated by distance L of 3 μm and had a width W of 300 μm. (FIG. 5A)

Step-b:

A Cr film was formed on the device to a thickness of 100 nm by vacuum deposition and then an opening corresponding the pattern of an electroconductive thin film was formed by photolithography. Thereafter, a Cr mask was formed for forming an electroconductive thin film.

Thereafter, a solution of Pd-amine complex (ccp4230: available from Okuno Pharmaceutical Co., Ltd.) was applied to the Cr film by means of a spinner and baked at 300° C. for 10 minutes to produce a fine particle film containing PdO as a principal ingredient. The film had a film thickness of 10 nm.

Step-c:

The Cr mask was removed by wet-etching and the PdO fine particle film was lifted off to obtain an electroconductive thin film 4 having a desired profile. The electroconductive thin film showed an electric resistance of $Rs=2\times10^4$ Ω/□ and had a thickness of 10 nm. (FIG. 5B)

Figure 16A:
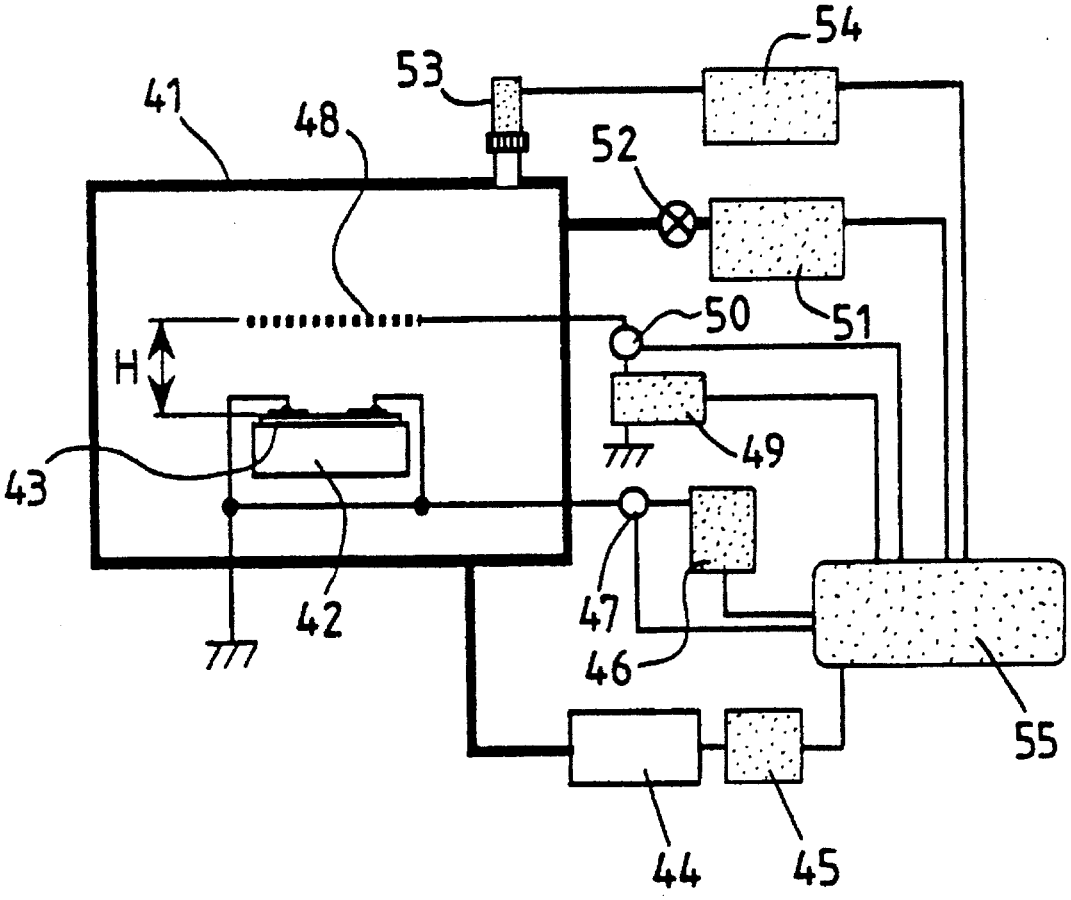
FIG. 16A is a block diagram of a manufacturing apparatus according to the invention, showing still another possible configuration thereof.

Step-d:

The electron source 43 was placed on a sample holder 42 in the vacuum chamber 41 of a gauging system as illustrated in FIG. 16A and the vacuum chamber 41 was evacuated by means of a vacuum pump unit 44 to a pressure of $1.3\times10^{-3}$ Pa. The vacuum pump unit 44 was a high vacuum pump unit comprising a turbo pump and a rotary pump. The vacuum pump unit 44 additionally comprises an ion pump for producing an ultra-high vacuum condition and these pumps could be selectively used. The unit further comprises a driver 45 for switching the pumps, opening the valve of a vacuum gauge and turning on and off the pumps. Subsequently, a pulse voltage was applied to each of the devices by way of a drive circuit 46 to carry out an electric forming process and produce an electron emitting region. The pulse voltage was a triangular pulse voltage whose peak value gradually increased with time as shown in FIG. 6B. The pulse width of T1=1 msec and the pulse interval of T2=10 msec were used. During the electric forming process, an extra pulse voltage of 0.1 V was inserted into intervals of the forming pulse voltage in order to determine the resistance of the electron emitting region and the electric forming process was terminated when the resistance exceeded 1 MΩ.

The peak value of the pulse voltage was 5.0 to 5.1 V when the forming process was terminated.

Step-e:

Subsequently, the electron source was subjected to an activation process, maintaining the inside pressure of the vacuum chamber to about $1.3\times10^{-3}$ Pa.

A rectangular pulse voltage with a height of 14 V was applied to each of the devices by way of the drive circuit 46. While the system of FIG. 6B comprised an ammeter 47, it was not used in this process. The system further comprised an anode 48 for capturing electrons emitted from the electron source 43, to which a voltage that was higher than the voltage applied to the electron source 43 by +1 KV was applied from a high voltage source 49. The devices and the anode were separated by a distance of H=4 mm. The emission current Ie of each device was detected by another ammeter 50.

The Ie detected by the ammeter 50 is fed to a control unit 55.

In this example, the control unit 55 was so designed that, once the emission current Ie of each device reached 0.9 μA, it caused the drive circuit 46 to suspend the pulse voltage being applied to the device.

Step-f:

Thereafter, a stabilization process was carried out. In this step, the ultra-high vacuum ion pump of the vacuum pump unit 44 was used and the electron source was heated to 120° C. by means of a heater (not shown) contained in the sample holder 42 for 10 hours. It was detected by atmosphere sensing means 53 (comprising an ionization vacuum gauge and a Q-mass spectrometer in this example) that the inner pressure of the vacuum chamber 41 was about $6.3\times10^{-5}$ Pa (the partial pressure of the organic substances having the origin in the oil of the high vacuum pump used in Steps-d and e being less than $6.3\times10^{-6}$ Pa). Reference numeral 54 denotes a drive circuit for the atmosphere sensing means.

A pulse voltage of 14 V (with a pulse width of 100 μsec.) was applied to the electron source for some time under this condition until Ie was found to have reached a saturated state.

The electron source was tested for its performance by applying a triangular pulse voltage (with a pulse width of 100 μsec) of 14 V. All the devices performed similarly in terms of MI.

[EXAMPLE 2]

Steps-a through d of Example 1 were also followed in this example and then an activation process was started as in the case of Step-e. Ie of device #5 rose a little slower than those of devices #1 through #4. The control unit 55 continuously calculated the rate of increase of Ie detected by the ammeter 50 and determined the average over a given period of time. If the rate at a selected moment differed beyond a given limit on any of the devices, the pulse height of the pulse voltage being applied to the device was modified as a function of the difference. As a result, only the pulse height for device #5 rose to 15 V in the course of the activation process. A requirement of Ie≧0.9 μA as given for terminating the process. Thus, the application of a pulse voltage was terminated for each device as soon as Ie got to 0.9 μA for the device.

Subsequently, an activation process was carried out as in the case of Step-f of Example 1 and then the performance of each devices was tested.

All the devices performed similarly in terms of MI.

[EXAMPLE 3]

Steps-a through d of Example 1 were also followed for all the devices in this example and then an activation process was started as in the case of Step-e. Ie of device #5 rose a little slower than those of devices #1 through #4. The programmed standard process was so designed that a pulse voltage with a pulse height of 14 V and a rectangular pulse width of 30 msec. was applied for activation and, after a certain duration of activation, the pulse width was changed to 20 msec. before terminating the activation process. The control unit 55 continuously calculated the rate of increase of Ie detected by the ammeter 50 and determined the average over a given period of time. If the rate at a selected moment differed beyond a given limit on any of the devices, the pulse width of the pulse voltage being applied to the device was modified as a function of the difference after the change of the pulse width. The standard process was carried out for devices #1 through #4 and the pulse width was changed to 20 msec. On the other hand, for a device #5, a pulse voltage with a pulse width of 30 msec. was applied all the way until the end of the activation process. The application of the pulse voltage was terminated for each device as soon as Ie got to 0.9 μA for the device.

Subsequently, an activation process was carried out as in the case of Step-f of Example 1 and then the performance of each devices was tested. All the devices performed similarly in terms of MI.

[COMPARATIVE EXAMPLE 1]

Steps-a through d of Example 1 were also followed and then an activation process was carried out for all the devices in this example by applying a rectangular pulse voltage of 14 V. Thereafter, Step-f was also followed as in the case of Example 1 and a triangular pulse voltage of 14 V was applied to test the performance of each device. While all the device performed similarly in terms of MI, devices #1 through #4 showed slight deviations in the performance when compared with Example 1 through 3 described above. If and Ie of device #5 were respectively about ⅔ and ½ of those of the other devices.

The devices of Examples 1 through 3 and Comparative Example 1 were prepared by following Steps-a through d and device #5 revealed the tendency of performing poorly in each case. While it may be reasonable to assume that this fact was attributable to something in Steps-a through d, no exact reason could not be found. However, it was found that this problem can be solved by carrying out an activation process by means of an apparatus according to the invention.

While the deviations in the performance of devices #1 through #4 were minute and might be attributable to an accident, such deviations could be removed by a method according to the invention.

[EXAMPLE 4, COMPARATIVE EXAMPLE 2]

Figure 17:
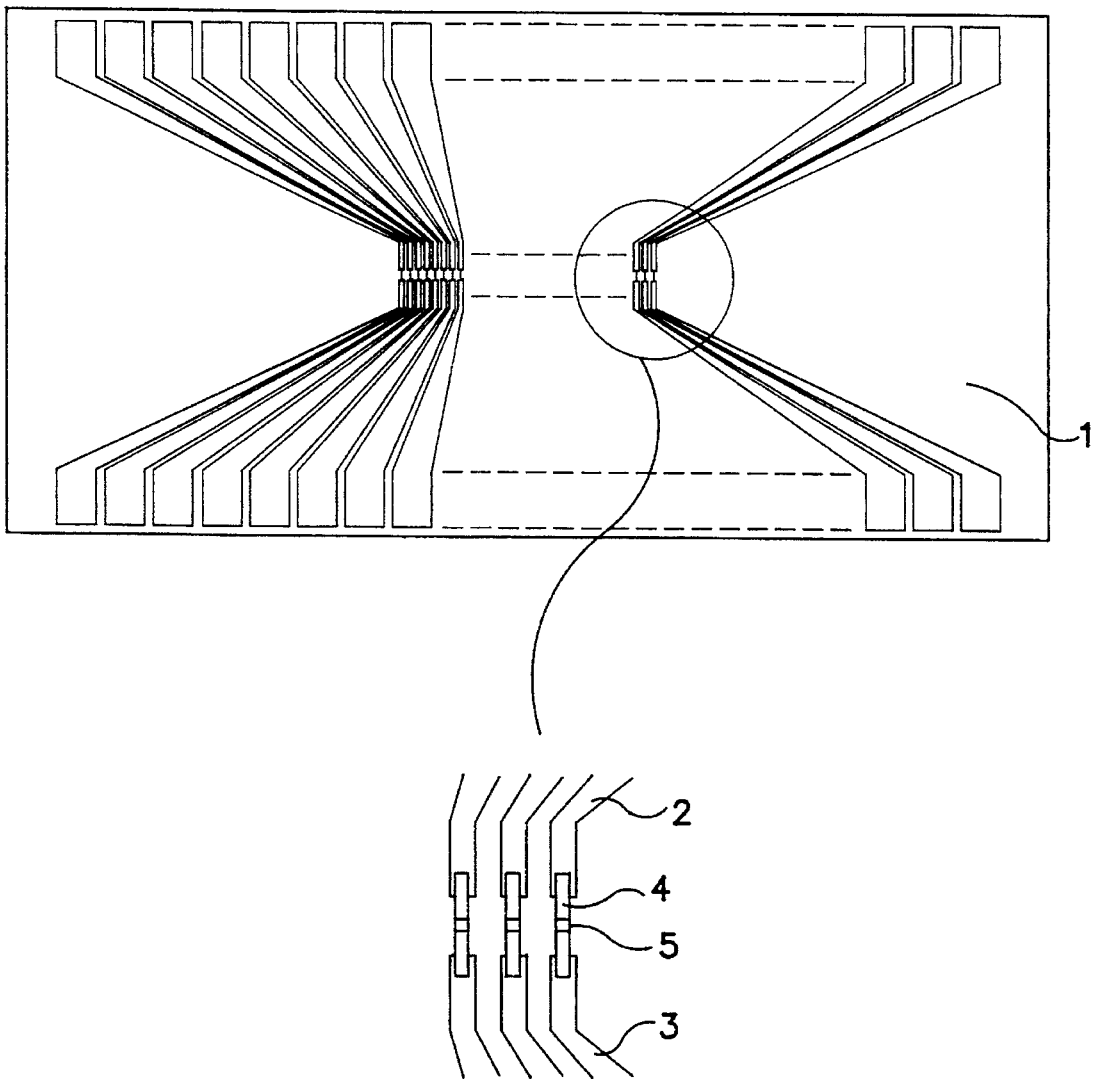
FIG. 17 is a schematic plan view of serially arranged surface conduction electron-emitting devices, to which the present invention is applicable.

The devices used in these Example and Comparative Example had a profile as shown in FIG. 3 and a total of 48 devices were arranged in a single row on a substrate for each example as schematically shown in FIG. 17.

Steps-a through c were followed and an electroconductive thin film of fine PdO particles was formed as in the case of Example 1. Thereafter, a forming process was carried out by following Step-d of Example 1. The inner pressure of the vacuum chamber was $2.7\times10^{-4}$ Pa.

Step-e:

Subsequently, an activation process was carried out.

The vacuum chamber was so operated by the control unit 55 that, after evacuating the vacuum chamber by means of an ion pump to about $10^{-6}$ Pa, acetone was introduced into the chamber by regulating a gas supply unit 51 and a solenoid valve 52 until the inner pressure of the vacuum chamber rose to $2.7\times10^{-1}$ Pa. At the same time, the drive circuit of the vacuum pump unit was also operated by the control unit 55 to regulate the evacuation rate by means of a gate valve.

The devices were numbered serially from No. 1 through No. 48 and the devices with even numbers were processed in a manner as follows.

Figure 18A:
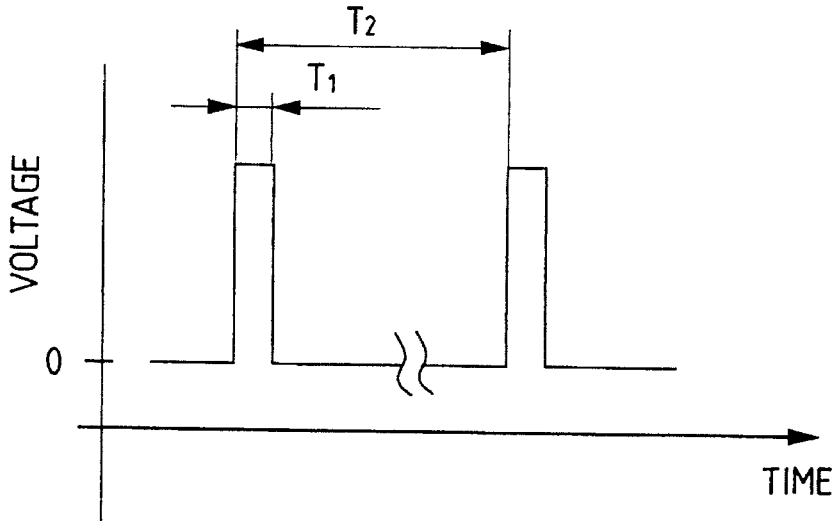
FIGS. 18A and 18B are graphs, illustrating pulse voltage waveforms that can be used for the activation process of a manufacturing apparatus and a manufacturing method according to the invention.
Figure 18B:
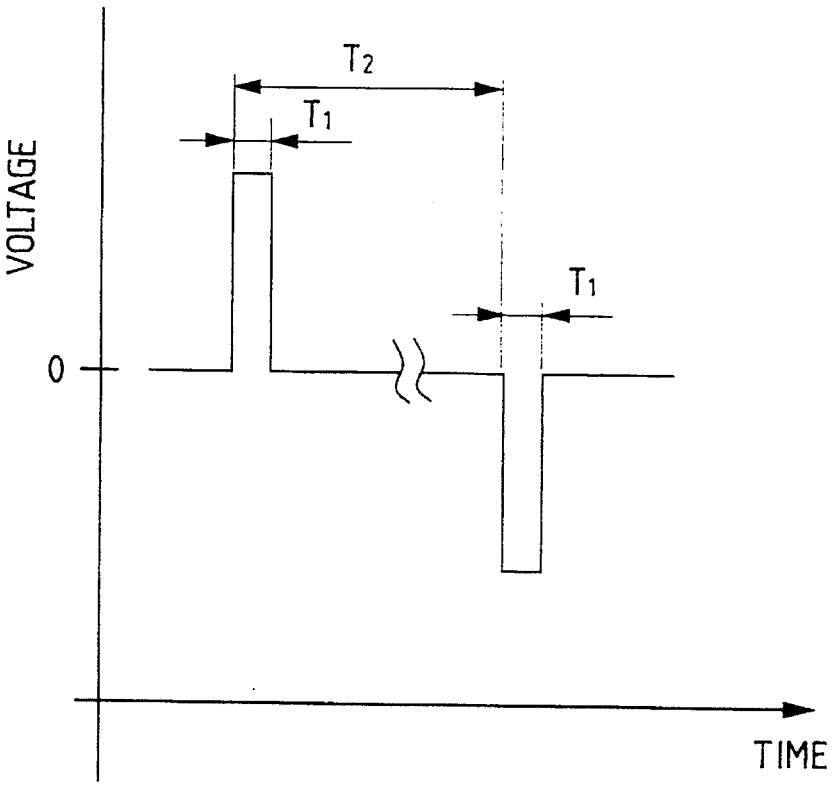

The pulse voltage applied to the devices had a rectangular pulse wave whose polarity was alternately inverted as shown in FIG. 18B. The pulse width was equal to T1=1 msec. for both polarities and the pulse interval was equal to T2=10 msec. In other words, the pulse had a period of 20 msec. and a frequency of 50 Hz.

The pulse height was initially 10 V and increased at a rate of 0.2 V/min. until it got to 18 V.

Using this for a regular sequence and a triangle pulse voltage having the same pulse height was additionally applied for every 30 seconds to detect the relationship between If and Vf.

In these examples, If was so controlled that it would not exceed a predetermined level for Vf2 that was lower than Vact. Specifically, the relationship Vf2=0.8×Vact was used and the regular sequence was continued as long as a requirement of If(Vf2)<0.05 mA was satisfied.

If, to the contrary, the above requirement was not met, or If(Vf2)≧0.05 mA was observed, Vact was increased by 0.2 V and the regular sequence was resumed.

Under this condition, the If-Vf relationship was such that If lingers for along low Vf range as schematically shown by a broken line in FIG. 9 to push up the value of If(Vf2). The inventors of the present invention assumes that this was caused by a small route for a leak current formed by carbon or a carbon compound in the electroconductive thin film between the anode and the cathode that were oppositely disposed with an electron emitting region arranged therebetween. This lingering phenomenon on the If-Vf relationship was dissolved by raising Vact probably because the carbon or the carbon compound forming the route for a leak current was evaporated by Joule's heat.

If If(Vf2) raised again after returning to the regular sequence, the above operation was repeated to obtain a electron-emitting device that showed a desired performance.

When Vact reached 18 V, the operation proceeded to a closing sequence if If≧2 mA was observed to terminate the activation process. If the above requirement was not met, Vact=10 V was resumed and the regular sequence was repeated.

For the purpose of comparison, a rectangular pulse voltage whose polarity alternately inverted as in the case of the above regular sequence was applied to the odd-numbered devices and Vact was raised from Vact=10 V to Vact=18 V at a rate of 0.2 V/min. so that the sequence was terminated in 40 minutes. These devices are referred to as those of Comparative Example 2.

Thereafter, the vacuum chamber and the electron-emitting devices in there were heated to 180° C. for 2 hours and a stabilization process was carried out on the devices, while evacuating the vacuum chamber by means of an ion pump. If of a device normally differs after the end of an activation process and after the end of a stabilization process.

Then, a triangular pulse voltage of 16 V was applied to the devices to see their performance. The inner pressure of the vacuum chamber was held to $1.3\times10^{-7}$ Pa and the anode and the electron-emitting devices were separated from each other by 4 mm, while the potential difference was held to 1 KV.

The value of If for V=8 V was expressed by Ifmid. This value corresponds to the so-called "half selection current" when an electron source comprising a plurality of electron-emitting devices arranged for simple matrix wiring is drive to operate and should preferably be as small as possible. The table below shows the average values and the deviation of Ie for the 24 devices of Example 4 and those of Comparative Example 2.

| | If (mA) | Ie (μA) | η (%) | Ifmid (mA) | ΔIe (%) |
|---|---|---|---|---|---|
| Example 4 | 1.1 | 1.1 | 0.10 | 0.005 | ±7 |
| Comparative Example 2 | 1.0 | 0.6 | 0.06 | 0.01 | ±12 |

[EXAMPLE 5, COMPARATIVE EXAMPLE 3]

Devices were prepared as in the case of Example 4 and a forming process was carried out on them. Thereafter, in Step-e:

The vacuum chamber was evacuated by means of an ion pump and then n-hexane was introduced into the chamber by controlling the gas supply unit 51 and the solenoid valve 52 so that the inner pressure of the chamber was maintained to $2.7\times10^{-3}$ Pa.

Figure 7A:
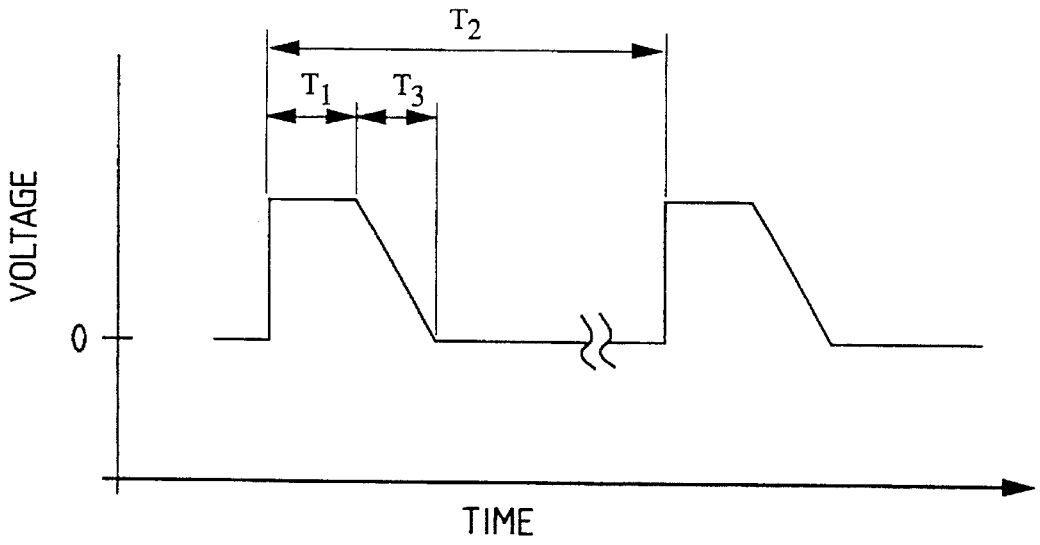
FIGS. 7A and 7B are graphs showing pulse voltage waveforms that can be used for the activation process of manufacturing a surface conduction electron-emitting device.

A trapezoidal pulse voltage of with a pulse height of 16 V as shown in FIG. 7A was applied to the devices. The rising edge of the pulse was inclined and this inclination was used to determine the If-Vf and Ie-Vf relationships. Otherwise, the pulse was defined by T2=10 msec., T3=10 μsec and the pulse width T1 that was gradually increased from 10 μsec. at a rate to become twice as large in 5 minutes for a regular sequence. The anode and the devices were separated from each other by 4 mm and the potential difference was 1 KV.

From the observed performance, threshold voltages Vtf and Vte were defined as the respective voltage values for 1/100 of the If and Ie values for Vact=16 V. As in the case of Example 4, the regular sequence was continued on the even-numbered devices as long as the requirement of Vte−Vtf<1 V was met, whereas, whenever it was found that the requirement was not met, T2 was doubled at that moment and then the regular sequence was resumed. When T1≧1 msec. was observed, the operation proceeds to a closing sequence if Ie≧2 μA. If otherwise, T1=10 μsec. was established and then the regular sequence was resumed.

If n-hexane was used as an organic substance, an activation process could be carried out with a partial pressure lower than that of acetone. If the acetone shows a partial pressure of $10^{-1}$ as in the case of Example 4, an electric discharge can occur to destroy the electron-emitting devices being treated for an activation process when a high voltage is applied to the anode in order to observe Ie. To the contrary, n-hexane having a relatively low partial pressure was used in these examples and, therefore, the activation process could be carried out smoothly, while observing Ie without any danger.

For the purpose of comparison, a similar pulse voltage was applied to the odd-numbered devices for about 30 minutes to an activation process, during which T1 was increased from 10 μsec. to 1 msec. These devices are referred to as those of Comparative Example 3.

Thereafter, a stabilization process was carried out as in the case of Example 4. The results are shown in the table below. Note that both If and Ie of a device normally differ after the end of an activation process and after the end of a stabilization process.

| | If (mA) | Ie (μA) | η (%) | Ifmid (mA) | ΔIe (%) |
|---|---|---|---|---|---|
| Example 5 | 1.0 | 1.1 | 0.11 | 0.007 | ±10 |
| Comparative Example 3 | 0.9 | 0.9 | 0.10 | 0.010 | ±12 |

[EXAMPLE 6, COMPARATIVE EXAMPLE 4]

Figure 7B:
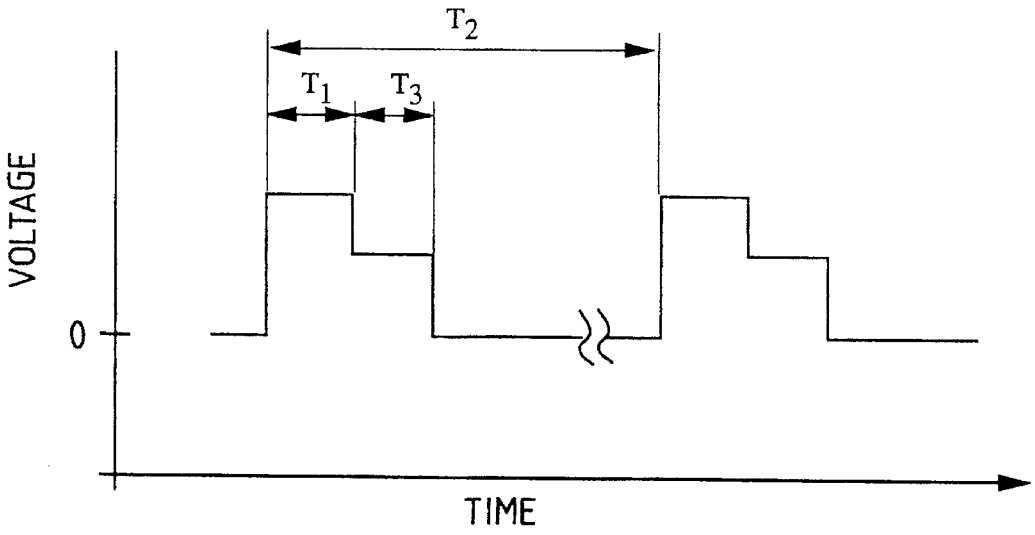

Devices were prepared as in the case of Example 4 and a forming process was carried out on them. Thereafter, in Step-e:

The vacuum chamber was evacuated by means of an ion pump and then dodecane was introduced into the chamber by controlling the vacuum pump drive circuit 45, the gas supply unit 51 and the solenoid valve 52 so that the inner pressure of the chamber was maintained to $2.7\times10^{-3}$ Pa. A step-shaped pulse voltage with a pulse of T1=1 msec., a pulse interval of T2=10 msec., a pulse height of 16 V and a reduced pulse height of 12 V as shown in FIG. 7B was applied. The width of the portion of the reduce height was equal to T3=100 μsec.

The pulse voltage was continued for a regular sequence.

As in the case of Examples 4 and 5, the even-numbered devices were treated in a following manner.

While monitoring both If and Ie, the pulse height was raised to 18 V for only 5 seconds when If(Vf=12 V)≧0.05 mA was observed and then the regular sequence was resumed.

The activation process was terminated and a closing sequence was started when Ie(Vf=16 V)≧2 μA was observed.

The above 16 V pulse voltage was applied for 30 minutes to the odd-numbered devices to terminate an activation process. These devices are referred to as those of Comparative Example 4.

Thereafter, a stabilization process was carried out as in the case of Examples 4 and 5. The results are shown in the table below.

| | If (mA) | Ie (μA) | η (%) | Ifmid (mA) | ΔIe (%) |
|---|---|---|---|---|---|
| Example 6 | 1.0 | 1.2 | 0.12 | 0.006 | ±9 |
| Comparative Example 4 | 1.5 | 0.9 | 0.06 | 0.011 | ±14 |

[EXAMPLE 7]

Devices were activated by a regular sequence like the one of Example 6. The high voltage power source for applying a high voltage to the anode for monitoring Ie was turned off when If (Vf=12 V)≧0.05 mA was observed and then hydrogen gas was introduced into the vacuum chamber by controlling the gas supply unit 51 and the solenoid valve 52. The gas flow rate was so regulated that the partial pressure of the hydrogen gas reached about 0.13 Pa. 20 seconds thereafter, the solenoid valve was closed to stop the gas supply and the high voltage power source was turned on to resume the regular sequence.

The activation process was terminated as in the case of Example 6.

Thereafter, a stabilization process was carried out. The results are shown in the table below.

| | If (mA) | Ie (μA) | η (%) | Ifmid (mA) | ΔIe (%) |
|---|---|---|---|---|---|
| Example 7 | 0.8 | 1.2 | 0.13 | 0.005 | ±9 |

[EXAMPLE 8, COMPARATIVE EXAMPLE 5]

Devices were prepared as in the case of Example 4 and a forming process was carried out on them. Thereafter, in Step-e:

The vacuum chamber was evacuated by means of an ion pump and then dodecane was introduced into the chamber by controlling the vacuum pump drive circuit 45, the gas supply unit 51 and the solenoid valve 52 so that the inner pressure of the chamber was maintained to $2.7\times10^{-1}$ Pa for initialization.

A pulse voltage like that of example 4 was applied, although the pulse height was constantly 16 V.

As in the case of Examples 4 through 6, the even-numbered devices are subjected to an activation process as described below.

When If>1.5 mA was obserbed, a quantity of introducing acetone was reduced until its partial pressure became to 1/10. This operation was repeated until a partial pressure of aetone became lower than $2.7\times10^{-5}$ Pa. Then the activation process was terminated to start a closing sequence.

A pulse voltage same as above was applied to the odd-numbered devices for 30 minutes in an atmosphere having a partial pressure of acetone equal to $2.7\times10^{-2}$ Pa. The devices are referred to as those of Comparative Example 5.

Thereafter, a stabilization process was carried out as in the case of Examples 4 through 7. The results are shown in the table below.

| | If (mA) | Ie (μA) | η (%) | Ifmid (mA) | ΔIe (%) |
|---|---|---|---|---|---|
| Example 8 | 1.2 | 1.5 | 0.13 | 0.011 | ±7 |
| Comparative Example 5 | 1.0 | 0.9 | 0.09 | 0.010 | ±13 |

[EXAMPLE 9, COMPARATIVE EXAMPLE 6]

In this example 4, devices were prepared on a substrate.

Steps-a through d of Example 1 were also followed in this example and thereafter in Step-e:

An activation process was carried out. The inner pressure of the vacuum chamber was $2.7\times10^{-3}$ Pa. The vacuum pump used here was a high vacuum type pump.

A rectangular pulse voltage as shown in FIG. 18A was applied to the devices. The pulse voltage had a pulse height of 14 V, a pulse width of 100 μsec. and a pulse interval of 10 msec.

The activation process was carried out, monitoring the device current If and the emission current Ie. The electron-emitting devices were separated from the anode by 4 mm and the anode had a potential of 1 KV.

The control unit used for this example read the data of the Ie detecting ammeter and calculated the increasing ratio of Ie with time, or dIe/dt to determine a maximum for Ie, or dIe/dt=0. In practice, since the observed value of Ie could contain noise, the value was integrated with a time constant of 1 second to find out the time when dIe/dr remained almost equal to 0 for 1 minute and the activation process was terminated at that time.

The activation process was in reality carried out on two of the four devices. The process was terminated in about 60 minutes for both of the devices.

For comparison, an activation process was also carried out for the remaining two devices for 40 minutes, using the same pulse voltage.

Thereafter, the vacuum pump was switched to an ion pump to carry out a stabilization process under the condition of Step-f of Example 1. While both Ie and If decreased temporarily during the process, they eventually converged to respective constant values.

The results are shown in the table below.

| | If (mA) | Ie (μA) | η (%) |
|---|---|---|---|
| Example 9 | 1.5 | 1.5 | 0.1 |
| Comparative Example 6 | 1.2 | 1.2 | 0.1 |

[EXAMPLE 10]

A dry pump (scroll pump) and a magnetic floating type turbo pump were used for the vacuum pump unit of this Example. With this arrangement, the organic substance involved could be effectively suppressed from diffusion into the vacuum chamber so that a satisfactory vacuum condition can be established for the following processes.

Steps-a through d were also followed in this example as in the case of Example 9 and thereafter in Step-e:

Acetone was introduced into the vacuum chamber by controlling the gas supply unit 51 and the solenoid valve 52. The partial pressure of acetone was regulated to $2.7\times10^{-3}$ Pa. The vacuum pump used here was a high vacuum type pump.

A rectangular pulse voltage similar to that of Example 9 was applied. An activation process was carried out for 50 minutes, monitoring the device current If and the emission current Ie.

Then, the supply of acetone was suspended and the inner pressure of the vacuum chamber was reduced further to about $1.3\times10^{-5}$ Pa. Thereafter, a stabilization process was carried out as in the case of Example 1.

| | If (mA) | Ie (μA) | η (%) |
|---|---|---|---|
| Example 10 | 1.3 | 1.3 | 0.1 |

[EXAMPLE 11]

Steps-a through d were also followed in this example as in the case of Example 9 and thereafter in Step-e:

The inner pressure of the vacuum chamber was reduced to about $2.0\times10^{-3}$ Pa by means of a high vacuum pump unit comprising a turbo pump and a rotary pump.

Like Example 9, an activation process was carried out, monitoring the device current If and the emission current Ie. The control unit calculated $\eta$=Ie/If from the monitored value of If and Ie and then further calculated $d\eta/dt$. The activation process was terminated when a maximum value of $\eta$ or $d\eta/dt=0$ was obtained.

The activation process continued for about 2 minutes.

Then, the vacuum pump was switched to an ion pump to further evacuate the vacuum chamber and a stabilization process as performed as in the case of Example 1.

The results are shown in Table below.

| | If (mA) | Ie (μA) | η (%) |
|---|---|---|---|
| Example 11 | 0.17 | 0.50 | 0.3 |

[EXAMPLE 12]

In this example, the present invention was applied to an electron source prepared by arranging plurality of surface conduction electron-emitting devices on a substrate and wiring them to form a matrix. The electron source had 100 devices in both the X- and Y-directions.

Figure 19A:
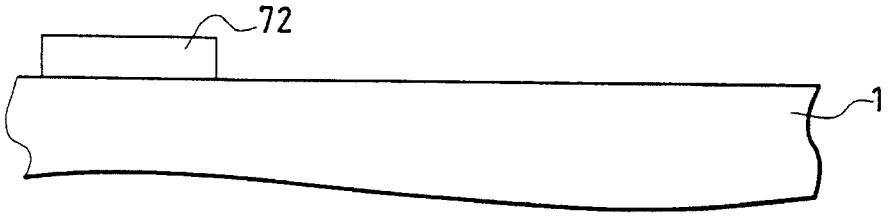
FIGS. 19A through 19H are schematic partial views of an electron source, illustrating a method of manufacturing the same, to which the present invention is applicable.

Step-A:

After thoroughly cleansing a soda lime glass plate a silicon oxide film was formed thereon to a thickness of 0.5 μm by sputtering to produce a substrate 1, on which Cr and Au were sequentially laid to thicknesses of 5 nm and 600 nm respectively and then a photoresist (AZ1370: available from Hoechst Corporation) was formed thereon by means of a spinner, while rotating the film, and baked. Thereafter, a photo-mask image was exposed to light and developed to produce a resist pattern for a lower wiring 72 and then the deposited Au/Cr film was wet-etched to produce a lower wiring 72 (FIG. 19A).

Figure 19B:
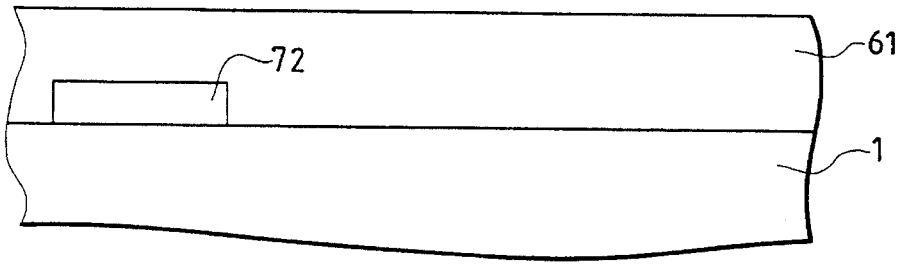

Step-B:

A silicon oxide film was formed as an interlayer insulation layer 61 to a thickness of 1.0 μm by RF sputtering (FIG. 19B).

Figure 19C:
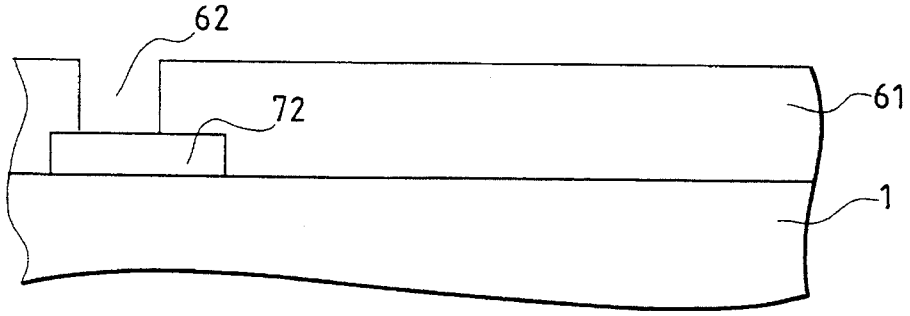

Step-C:

A photoresist pattern was prepared for producing a contact hole 62 in the silicon oxide film deposited in Step-B, which contact hole 62 was then actually formed by etching the interlayer insulation layer 61, using the photoresist pattern for a mask (FIG. 19C). A technique of RIE (Reactive Ion Etching) using $CF_4$ and $H_2$ gas was employed for the etching operation.

Figure 19D:
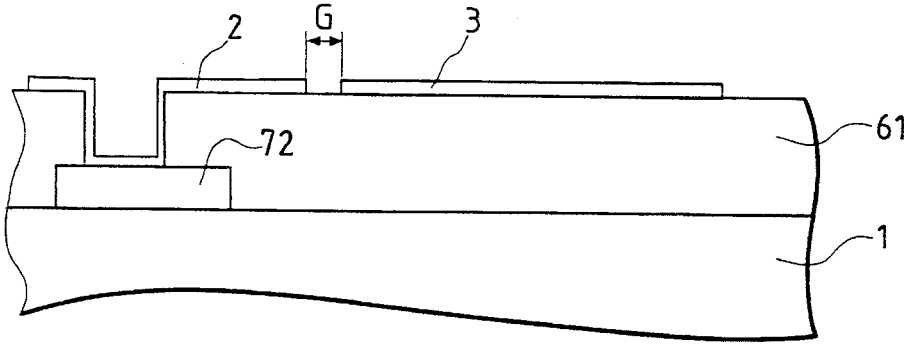

Step-D:

Thereafter, a pattern of photoresist (RD-2000N-41: available from Hitachi Chemical Co., Ltd.) was formed for a pair of device electrodes 2 and 3 and a gap G separating the electrodes and then Ti and Ni were sequentially deposited thereon respectively to thicknesses of 5 nm and 100 nm by vacuum deposition. The photoresist pattern was dissolved by an organic solvent and the Ni/Ti deposit film was treated by using a lift-off technique to produce a pair of device electrodes 2 and 3 having a width of 300 μm and separated from each other by a distance G of 3 μm (FIG. 19D).

Figure 19E:
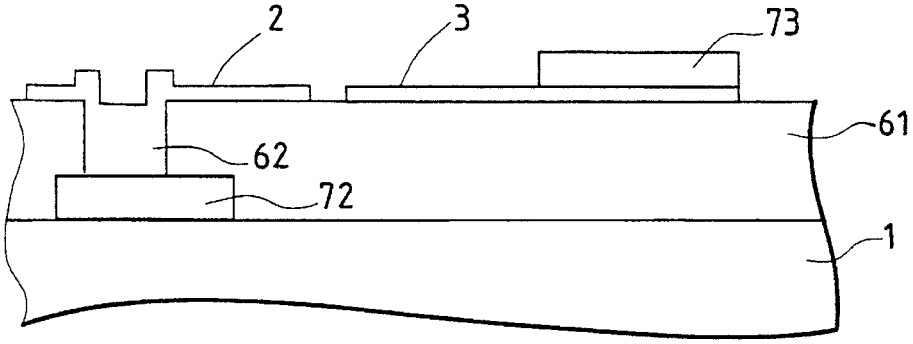

Step-E:

After forming a photoresist pattern on the device electrodes 2, 3 for an upper wiring 73, Ti and Au were sequentially deposited by vacuum deposition to respective thicknesses of 5 nm and 500 nm and then unnecessary areas were removed by means of a lift-off technique to produce an upper wirings 73 having a desired profile (FIG. 19E).

Figure 19F:
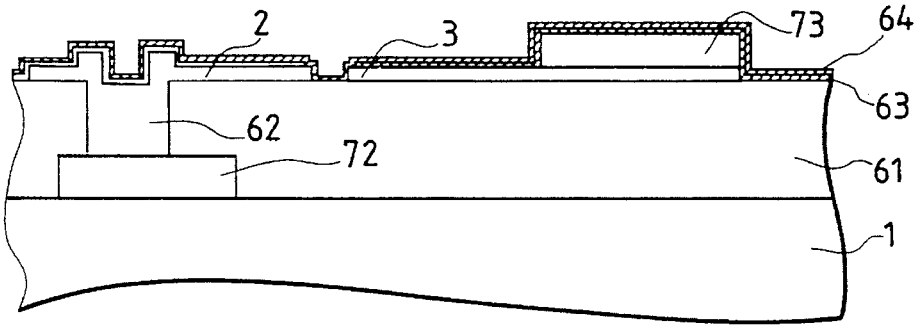

Step-F:

Then a Cr film 63 was formed to a film thickness of 30 nm by vacuum deposition, which was then subjected to a patterning operation to show a pattern of an electroconductive thin film 4 having an opening. Thereafter, an organic Pd compound (ccp4230: available from Okuno Pharmaceutical Co., Ltd.) was applied to the Cr film by means of a spinner, while rotating the film, and baked at 300° C. for 120 minutes. The formed electroconductive thin film 64 was made to fine particles containing PdO as a principal ingredient and had a film thickness of 70 nm (FIG. 19F).

Figure 19G:
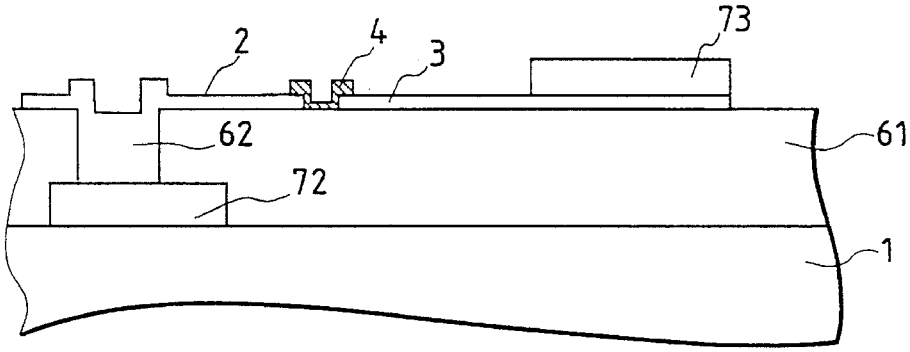

Step-G:

The Cr film 63 was wet-etched by using an etchant and removed with any unnecessary areas of the electroconductive thin film 4 to produce a desired pattern (FIG. 19G). The electric resistance per unit area was $4\times10^4$ Ω/□.

Figure 19H:
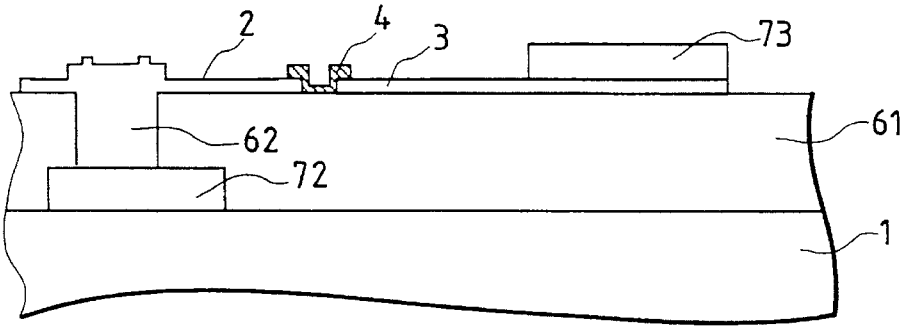

Step-H:

Then, a pattern for applying photoresist to the entire surface area except the contact hole 62 was prepared and Ti and Au were sequentially deposited by vacuum deposition to respective thicknesses of 5 nm and 500 nm. Any unnecessary areas were removed by means of a lift-off technique to consequently bury the contact hole (FIG. 19H).

By using an electric source prepared in a manner as described above, an image forming apparatus was prepared. This will be described by referring to FIGS. 10 and 11.

Figure 10:
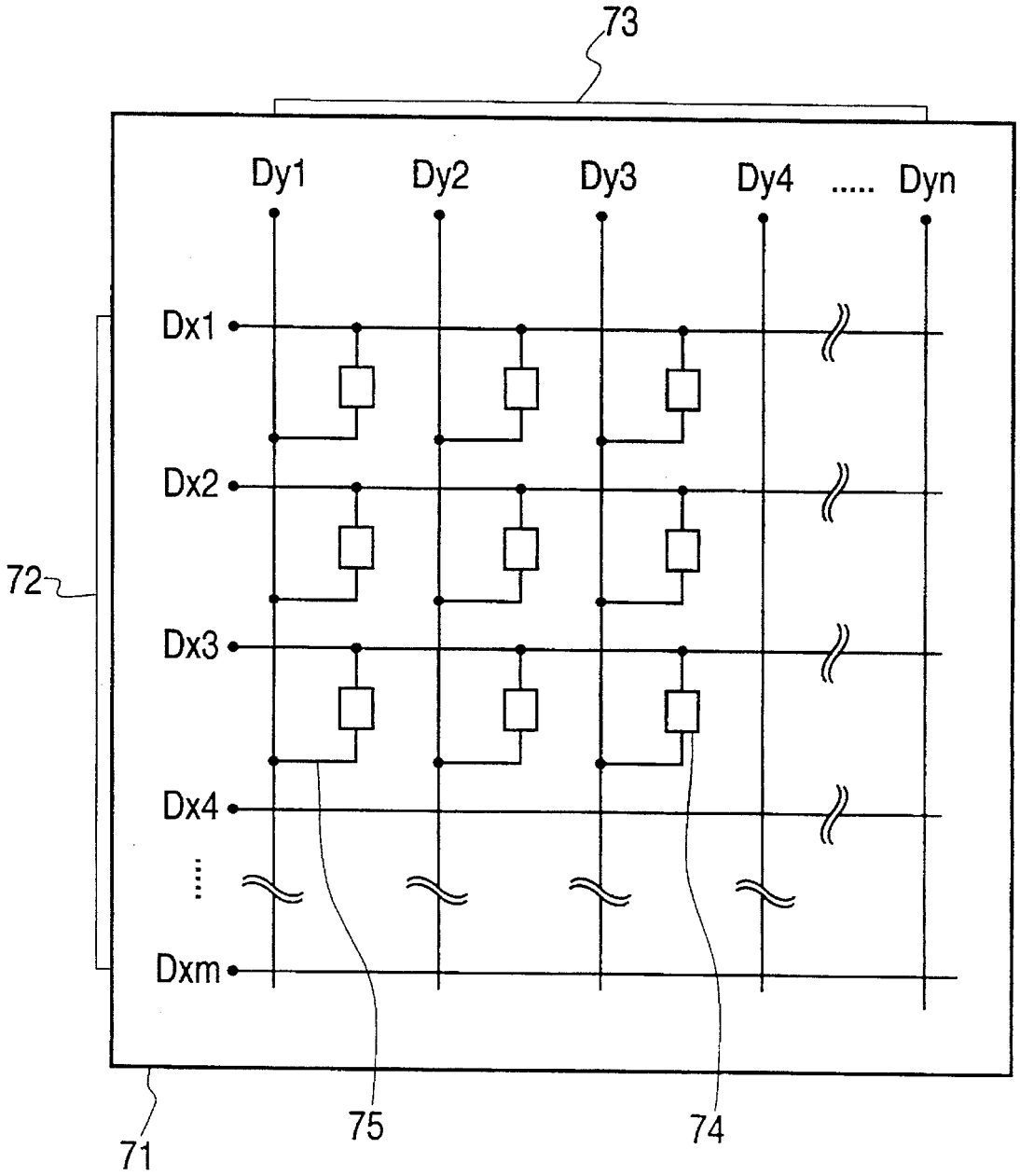
FIG. 10 is a schematic partial plan view of an electron source of matrix arrangement.

Step-I:

After securing an electron source substrate 71 onto a rear plate 81, a face plate 86 (carrying a fluorescent film 84 and a metal back 85 on the inner surface of a glass substrate 83) was arranged 5 mm above the substrate 71 with a support frame 82 disposed therebetween and, subsequently, frit glass was applied to the contact areas of the face plate 86, the support frame 82 and rear plate 81 and baked at 400° to 500° C. in the ambient air or in a nitrogen atmosphere for more than 10 minutes to hermetically seal the container. The substrate 71 was also secured to the rear plate 81 by means of frit glass. In FIGS. 10 and 11, reference numeral 74 denotes a electron-emitting device and numerals 72 and 73 respectively denote x- and Y-directional wirings for the devices.

While the fluorescent film 84 is consisted only of a fluorescent body if the apparatus is for black and white images, the fluorescent film 84 of this example was prepared by forming black stripes and filling the gaps with stripe-shaped fluorescent members of red, green and blue. The black stripes were made of a popular material containing graphite as a principal ingredient. A slurry technique was used for applying fluorescent materials onto the glass substrate 83.

A metal back 85 is arranged on the inner surface of the fluorescent film 84. After preparing the fluorescent film, the metal back was prepared by carrying out a smoothing operation (normally referred to as "filming") on the inner surface of the fluorescent film and thereafter forming thereon an aluminum layer by vacuum deposition.

While a transparent electrode (not shown) might be arranged on the outer surface of the fluorescent film 84 in order to enhance its electroconductivity, it was not used in this example because the fluorescent film showed a sufficient degree of electroconductivity by using only a metal back.

For the above bonding operation, the rear plate 15, the face plate 17 and the spacers 20 were carefully aligned in order to ensure an accurate positional correspondence between the color fluorescent members and the electron-emitting devices.

Figure 20:
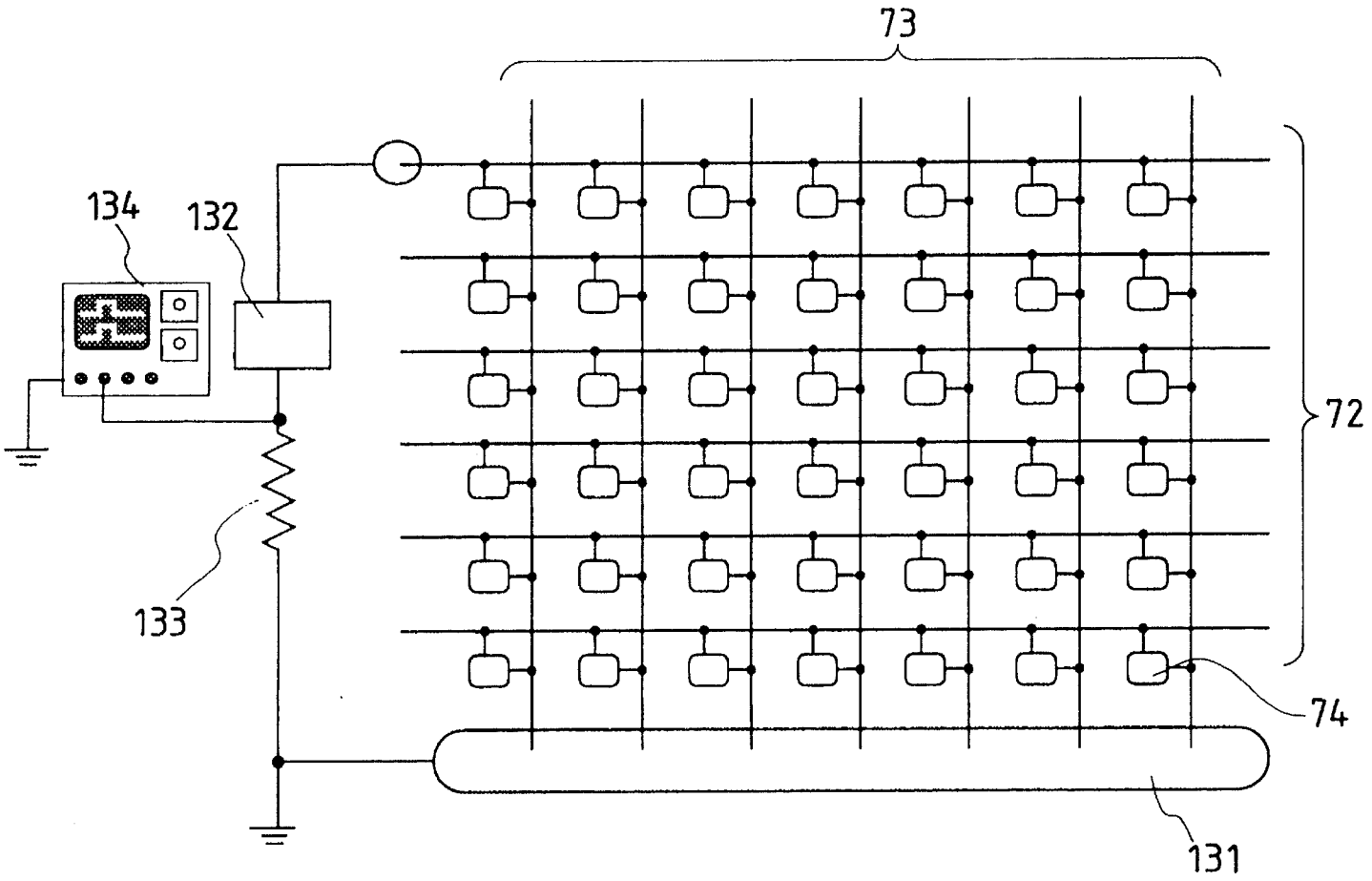
FIG. 20 is a schematic plan view of an electron source of matrix arrangement, illustrating the wiring for conducting an energization forming process.

Step-J:

The inside of the prepared glass container was then evacuated by way of an exhaust pipe and a vacuum pump to a degree of vacuum of $10^{-4}$ Pa. Thereafter, the Y-directional wirings were commonly connected and a forming process was carried out on a line by line basis as shown in FIG. 20. In FIG. 20, reference 131 denotes a common electrode that commonly connects the Y-directional wirings 73 and numeral 132 denotes a power source, while numerals 133 and 134 respectively denote a resistance to be used for measuring the electric current and an oscilloscope for monitoring the electric current.

Figure 16B:
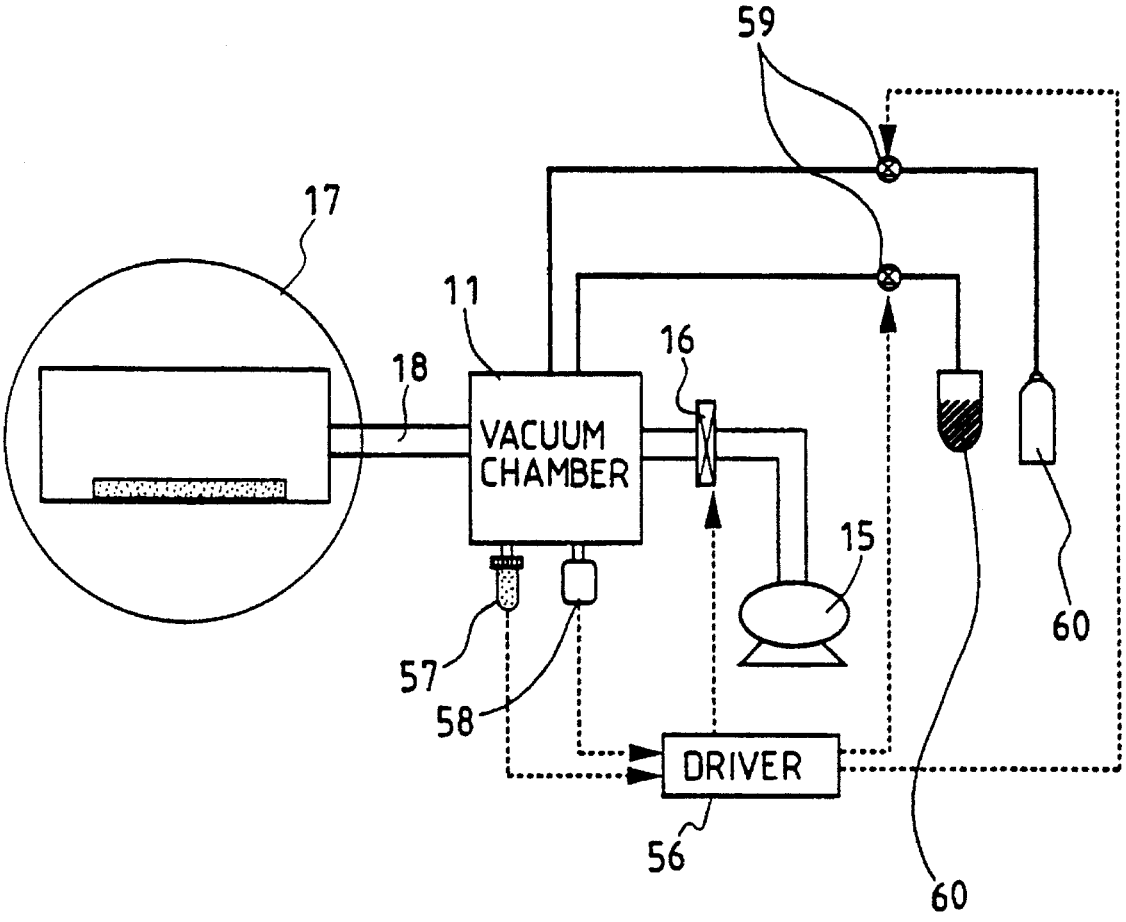
FIG. 16B is a block diagram of a manufacturing apparatus according to the invention, showing a further possible configuration thereof.

Step-K:

Subsequently, an activation process was carried out. FIG. 16B illustrates the means for setting-up the atmosphere used for this example. The image forming apparatus (panel) 17 was connected to a vacuum chamber 11 by way of an exhaust pipe 18. The vacuum chamber 11 was evacuated by means of a vacuum pump unit 15 by way of a gate valve 16 and the atmosphere in the inside was monitored by a pressure gauge 58 and a Q-mass spectrometer 57. The vacuum chamber 11 was also provided with two gas supply system, one of which was used to introduce an activator into the vacuum chamber while the other was designed to feed a material for etching the activator (etching gas), although the etching gas feeding system was not used for this example. The above components were controlled to operate by means of a driver 56.

The activator supply system was connected to an activator source 60. In this example, it was an ampule containing acetone. Note that a gas cylinder is used if the activator is a gas under the atmospheric pressure at room temperature.

The gas supply system 59 so controlled that the acetone introduced into the panel showed a partial pressure of $1.3\times10^{-1}$ Pa and a rectangular pulse voltage of 18 V was applied. The pulse width was 100 μsec. and the pulse interval was 20 msec.

The activation process was carried out on a row by row basis. A rectangular pulse voltage with a pulse height of Vact=18 V was applied to only an X-directional wiring connected to a row of devices, while the Y-directional wirings were commonly connected to a common electrode as in the case of Step-J above. The pulse was switched to a triangular pulse for every minute to determine the performance of the devices in terms of the relationship of If-Vf. If the value of If was If(Vf2)≧If(Vact)/220 for Vf2=Vact/2=9 V, the height of the rectangular pulse voltage was raised to 19 V for 30 seconds and then returned to 18 V to continue the activation process.

When the device current for each device of a row became equal to If(18 V)≧2 mA, the operation of activation for that row was terminated and a next row was subjected to a similar operation.

Step-L:

When the activation process was over on all the rows, the valve of the gas supply system was closed to shut off acetone and the entire glass panel was evacuated for 5 hours, while it was being heated to about 200° C. At the end of the 5 hours, the apparatus was made to operate for electron emission by driving the simple matrix wirings and to make the fluorescent film glow. After ensuring that the glass panel operated properly, the exhaust pipe was heated and sealed. Thereafter, the getter arranged in the panel was heated by high frequency heating until it flashed.

[COMPARATIVE EXAMPLE 7]

Steps-A through J of Example 12 were followed and, thereafter, a rectangular pulse voltage with a pulse height of Vact=18 V was applied to each row of the panel for 30 minutes on a row by row basis in an atmosphere same as that of Step-K of the above example.

Then, the operation of Step-L of the above example was also carried out for this example.

A rectangular pulse voltage of 16 V was applied to the image forming apparatus of Example 12 and that of Comparative Example 7 to determine their Ie and If. This measuring operation was conducted also on a row by row basis as in the case of the activation process to collectively determine If and Ie of the 100 devices of each row. If(mid) was also determined for the applied rectangular pulse voltage of 8 V. The potential difference between the metal back and the electron source was 1 KV.

The averages of If and Ie and the average deviation (ΔIe(%) for each row (100 devices) are listed below.

| | If (mA) | Ie (μA) | Ifmid (mA) | ΔIe (%) |
|---|---|---|---|---|
| Example 12 | 125 | 145 | 0.6 | 5.0 |
| Comparative Example 7 | 115 | 92 | 5.8 | 9.0 |

[EXAMPLE 13]

Figure 21:
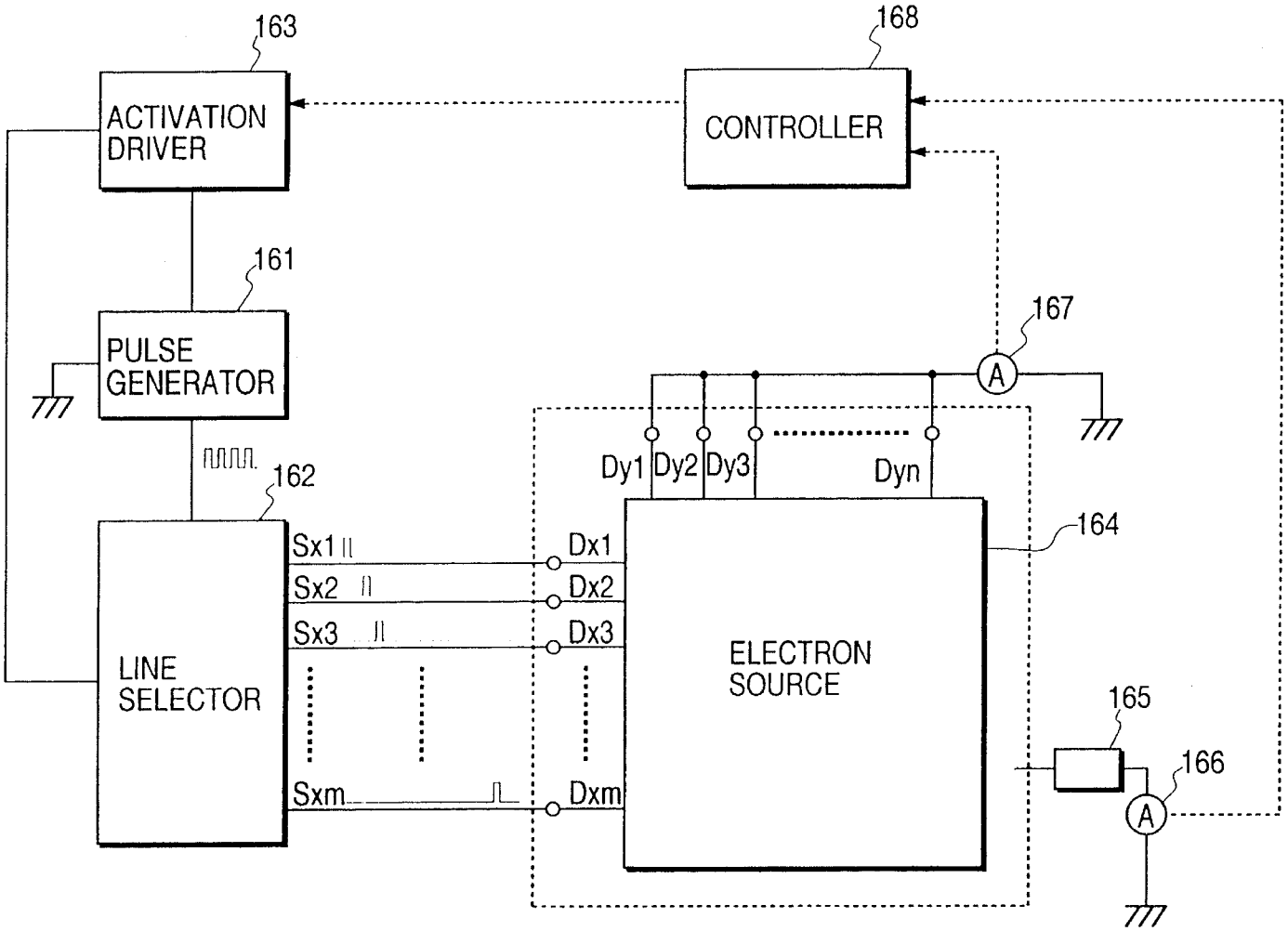
FIG. 21 is a schematic block diagram of the means for applying an activation pulse voltage in Example 13.

A glass panel was prepared by following Steps-A through J of Example 12. Thereafter, in Step-K:

As in the case of Example 12, acetone was introduced into the panel by controlling a gas supply system until it showed a partial pressure of $1.3\times10^{-1}$ Pa and a rectangular pulse voltage to Vact=18 V was applied to each row on a row by row basis by way of an X-directional wiring connected thereto. FIG. 21 schematically illustrates the pulse voltage application system used for this example and connected to the electron source. Referring to FIG. 21, said system comprises a pulse voltage generator 161 and a line selector section 162. The operation of the pulse voltage generator 161 and that of the line selector section 162 were switched for pulse voltage generation and line selection respectively in synchronism by means of an activation driver 163.

The pulse voltage generated by the pulse voltage generator was applied to one of the output terminals Sx1 through Sxm of the line sensor section. The output terminals Sx1 through Sxm were connected to the respective X-directional wirings Dx1 through Dxm, while the Y-directional wirings Dy1 through Dyn were commonly connected to the ground potential level.

Reference numeral 165 in FIG. 21 denotes a high voltage source for applying a high voltage to the metal back and numeral 166 denotes an ammeter for measuring Ie, although this was not used in order to avoid damaging the devices by electric discharges that might take place inside the panel in view of the high partial pressure of acetone in the activation process.

Reference numeral 164 denotes an ammeter for measuring If. The readings of Ie and If (only the readings of If in this example) were stored in the control unit 168, which by turn controlled the operation of the activation driver 163 on the basis of the readings in a manner as described below.

Figure 22:
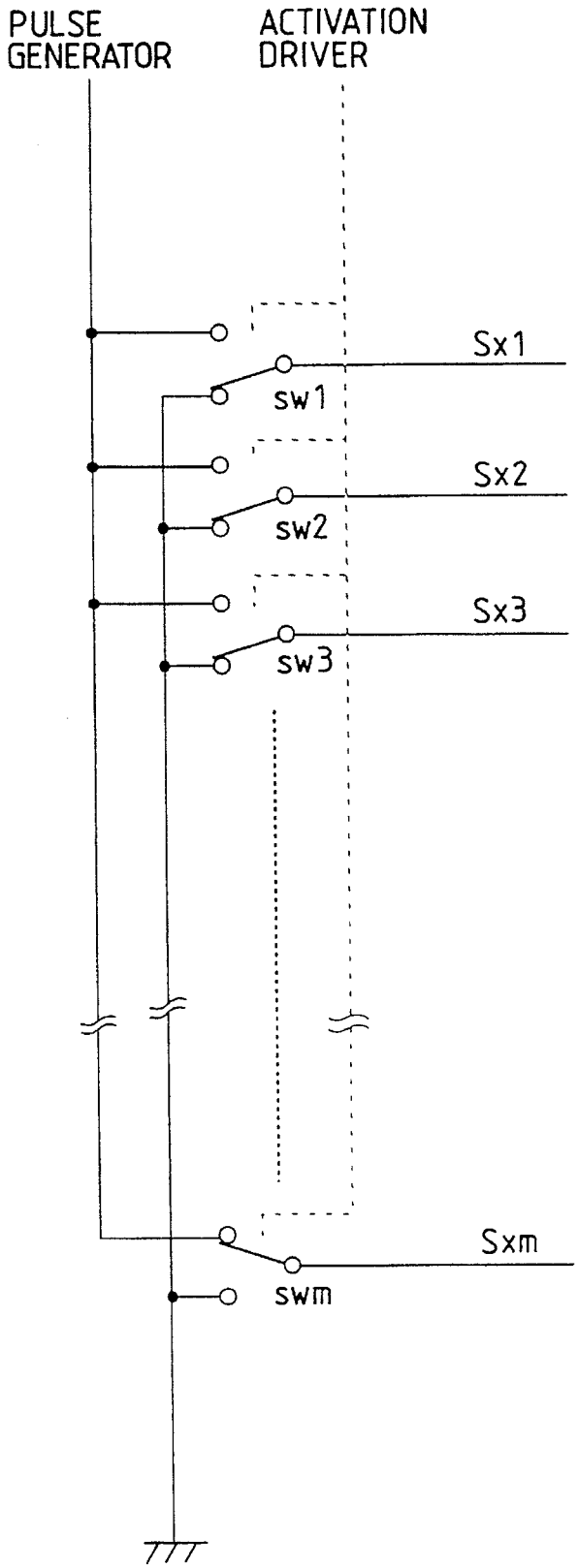
FIG. 22 is a schematic diagram for illustrating the operation of a line selecting section in Example 13.

FIG. 22 is a schematic circuit diagram illustrating the operation of the line selector section 162. The output terminals Sx1 through Sxm are connected to respective swithes sw1 through swm, each of which is by turn connected to an input line leading to the pulse voltage generator or the ground potential level and controlled by the activation driver.

Figure 23:
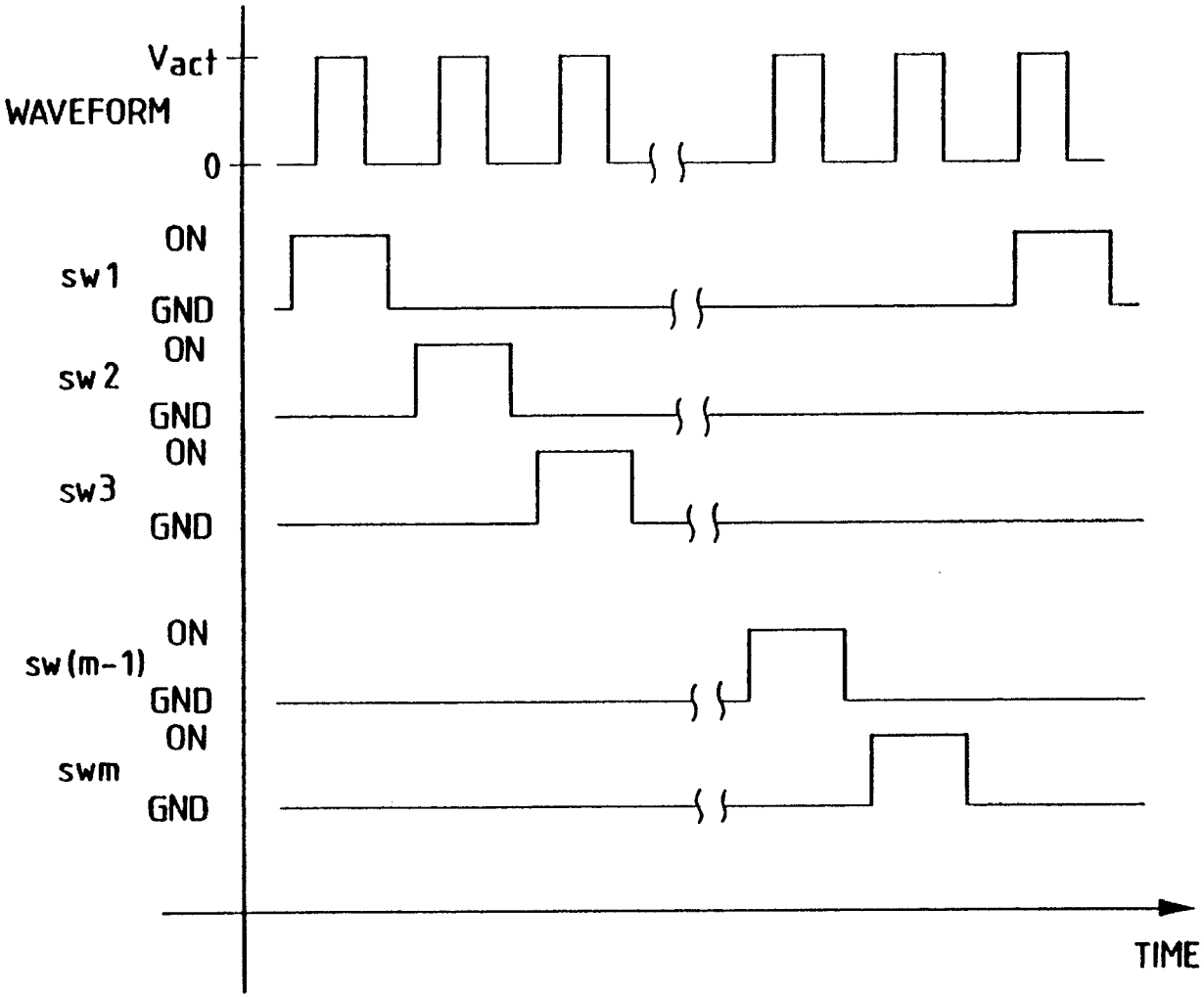
FIG. 23 is a timing chart for illustrating the relationship between pulse generation and the operation of a line selecting section in Example 13.

FIG. 23 is a timing chart of the pulse voltage generated by the pulse voltage generator and the operation of the switches of the line selector section. When any of the switches sw1 through swm is connected to the input side, it is expressed by ON, whereas the state where it is connected to the ground potential level is expressed by GND. The switches were so driven that only a single switch was connected to the input side at a time and the connection to the input side was switched to the next switch periodically in a pulse interval.

Figure 24:
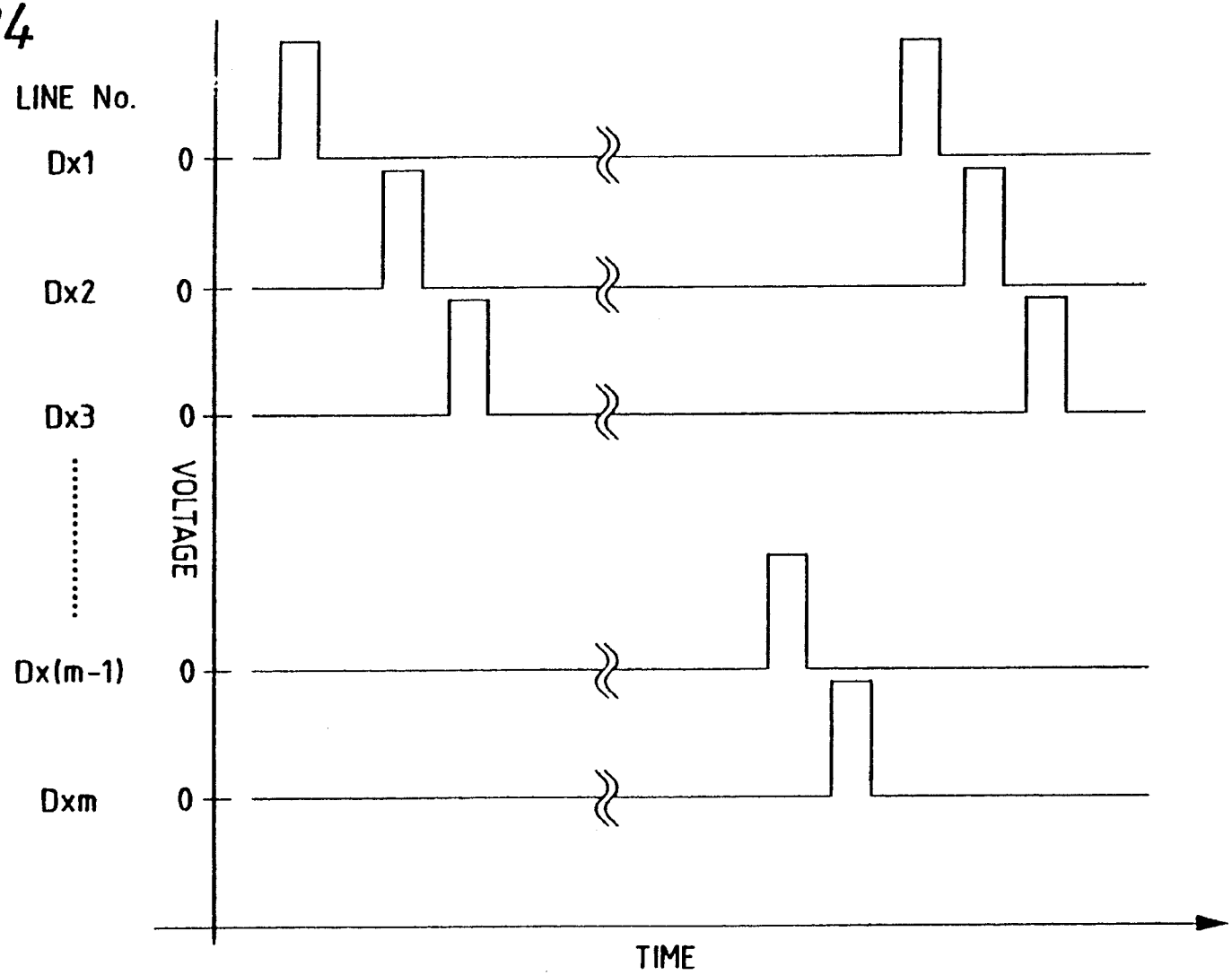
FIG. 24 is a timing chart for illustrating the relationship among the pulse voltages applied to wirings in different directions.

Thus, pulses were applied to the X-directional lines on a line by line basis, a single pulse being applied to a line at a time as shown in FIG. 24.

The pulse voltage generated by the pulse voltage generator had a pulse width of 100 μsec. and a pulse interval of 200 μsec. and the interval between two consecutive switching operations by the line selector section was equal to the pulse interval of 200 μsec. so that 20 msec. was required to apply a pulse to all the 100 rows. The pulse applied to each row had a pulse width of 100 μsec. and a pulse interval of 20 μsec. as in the case of Example 12.

As in the case of Example 12, a triangle pulse voltage was then applied for every 1 minute to find the relationship between If and Vf for each row and the pulse height of the applied rectangular pulse voltage was raised to 19 V for 30 seconds whenever $If(Vf2) \geqq If(Vact)/220$ was detected. Thereafter, the voltage was reduced to 18 V to continue the regular sequence of the activation process. Additionally, the operation of the control unit was programmed to drive the activation driver such that a pulse voltage of 19 V was applied only to those lines that required the voltage, whereas 18 V was applied to all the remaining lines and the pulse voltage generator operates in synchronism with the switching operation of the line selector section. When the device current for each device of a row became equal to $If(18\ V) \geqq 2$ mA, the operation of activation for that row was terminated and a next row was subjected to a similar operation. The application of the voltage was terminated in about 30 minutes for all the rows. With this driving operation, the overall time required for the activation process was significantly reduced if compared with an activation process conducted on a row by row basis because a voltage could be applied to some other row while the pulse was not applied to a selected row.

Thereafter, a stabilization process was carried out and the exhaust pipe was heated and sealed before the getter was made to flash as in the case of Example 12.

The image forming apparatus obtained in this Example was tested by a method same as that of Example 12 to obtain similar results.

The above described image forming apparatus can be used to display images by applying a scan signal and a modulation signal to each of the electron-emitting devices by way of the related ones of the external terminals Dx1 through Dxm and Dy1 through Dyn to make the device emit electrons and then by applying a high voltage of 5.0 KV to the metal back 85 by way of the high voltage terminal Hv to accelerate electron beams until they collide with the fluorescent film 85 and make it energized and glow.

Figure 25:
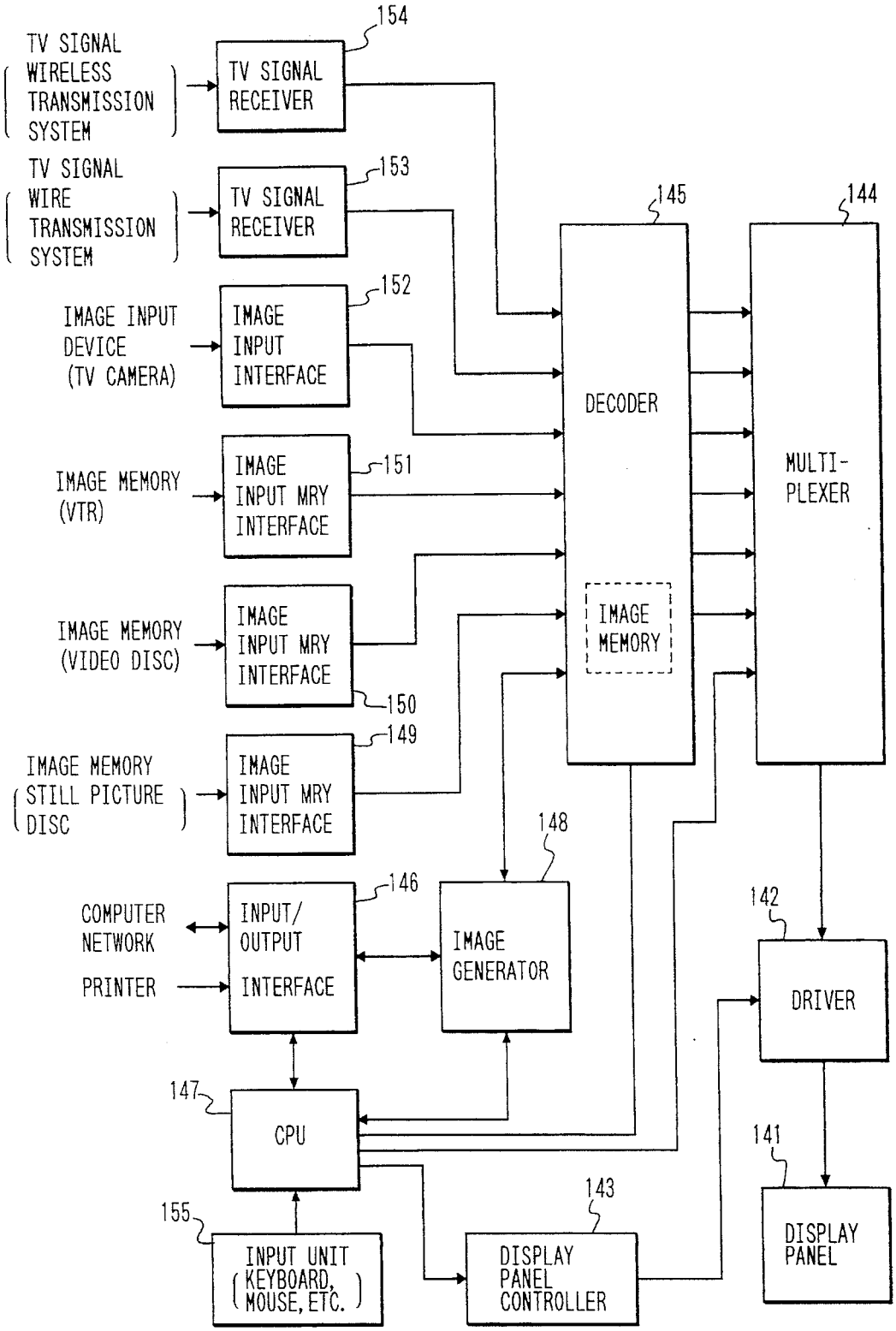
FIG. 25 is a block diagram of an image forming apparatus, to which the present invention is applicable.
Figure 26:
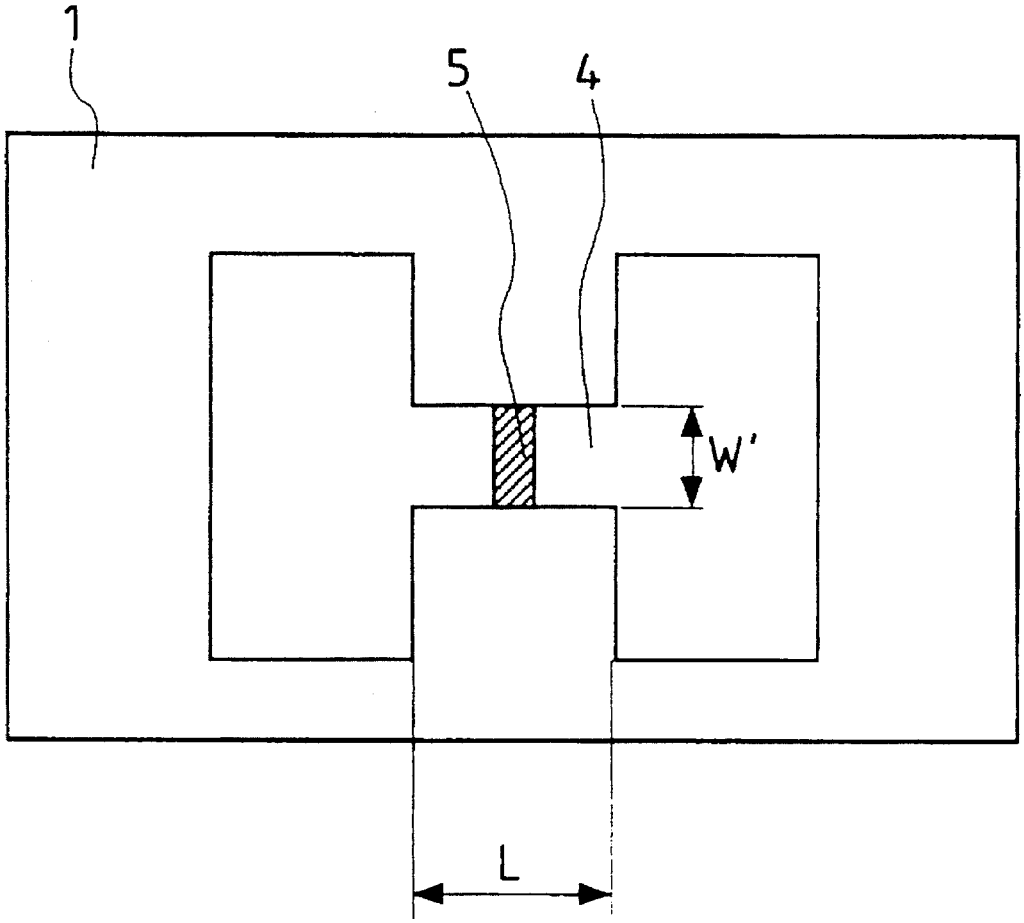
FIG. 26 PRIOR ART
FIG. 26 is a schematic plan view of a conventional surface conduction electron-emitting device proposed by Hartwell et al.

FIG. 25 is a block diagram of a display apparatus comprising an electron source realized by arranging a number of surface conduction electron-emitting devices and a display panel and designed to display a variety of visual data as well as pictures of television transmission in accordance with input signals coming from different signal sources. Referring to FIG. 25, it comprises a display panel 141, a display panel drive circuit 142, a display controller 143, a multiplexer 144, a decoder 145, an input/output interface circuit 146, a CPU 147, an image generation circuit 148, image memory interface circuits 149, 150 and 151, an image input interface circuit 152, TV signal receiving circuits 153 and 154 and an input section 155. (If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.)

Now, the components of the apparatus will be described, following the flow of image signals therethrough.

Firstly, the TV signal reception circuit 154 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels. The TV signals received by the TV signal reception circuit 155 are forwarded to the decoder 145.

Secondly, the TV signal reception circuit 153 is a circuit for receiving TV image signals transmitted via a wired transmission system using coaxial cables and/or optical fibers. Like the TV signal reception circuit 154, the TV signal system to be used is not limited to a particular one and the TV signals received by the circuit are forwarded to the decoder 145.

The image input interface circuit 152 is a circuit for receiving image signals forwarded from an image input device such as a TV camera or an image pick-up scanner. It also forwards the received image signals to be decoder 145.

The image memory interface circuit 152 is a circuit for retrieving image signals stored in a video tape recorder (hereinafter referred to as VTR) and the retrieved image signals are also forwarded to the decoder 145.

The image memory interface circuit 151 is a circuit for retrieving image signals stored in a video disc and the retrieved image signals are also forwarded to the decoder 145.

The image memory interface circuit 150 is a circuit for retrieving image signals stored in a device for storing still image data such as so-called still disc and the retrieved image signals are also forwarded to the decoder 145.

The input/output interface circuit 149 is a circuit for connecting the display apparatus and an external output signal source such as a computer, a computer network or a printer. It carries out input/output operations for image data and data on characters and graphics and, if appropriate, for control signals and numerical data between the CPU 147 of the display apparatus and an external output signal source.

The image generation circuit 148 is a circuit for generating image data to be displayed on the display screen on the basis of the image data and the data on characters and graphics input from an external output signal source via the input/output interface circuit 146 or those coming from the CPU 146. The circuit comprises reloadable memories for storing image data and data on characters and graphics, read-only memories for storing image patterns corresponding given character codes, a processor for processing image data and other circuit components necessary for the generation of screen images.

Image data generated by the image generation circuit 507 for display are sent to the decoder 145 and, if appropriate, they may also be sent to an external circuit such as a computer network or a printer via the input/output interface circuit 146.

The CPU 147 controls the display apparatus and carries out the operation of generating, selecting and editing images to be displayed on the display screen.

For example, the CPU 147 sends control signals to the multiplexer 144 and appropriately selects or combines signals for images to be displayed on the display screen. At the same time it generates control signals for the display panel controller 143 and controls operation of the display apparatus in terms of image display frequency, scanning method (e.g., interlaced scanning or non-interlaced scanning), the number of scanning lines per frame and so on.

The CPU 147 also sends out image data and data on characters and graphic directly to the image generation circuit 148 and accesses external computers and memories via the input/output interface circuit 146 to obtain external image data and data on characters and graphics. The CPU 147 may additionally be so designed as to participate other operations of the display apparatus including the operation of generating and processing data like the CPU of a personal computer or a word processor. The CPU 147 may also be connected to an external computer network via the input/output interface circuit 146 to carry out computations and other operations, cooperating therewith.

The input section 155 is used for forwarding the instructions, programs and data given to it by the operator to the CPU 147. As a matter of fact, it may be selected from a variety of input devices such as keyboards, mice, joysticks, bar code readers and voice recognition devices as well as any combinations thereof.

The decoder 145 is a circuit for converting various image signals into via said circuits 148 through 154 back into signals for three primary colors, luminance signals and I and Q signals. Preferably, the decoder 145 comprises image memories as indicated by a dotted line in FIG. 25 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 145 in cooperation with the image generation circuit 148 and the CPU 147.

The multiplexer 144 is used to appropriately select images to be displayed on the display screen according to control signals given by the CPU 147. In other words, the multiplexer 144 selects certain converted image signals coming from the decoder 145 and sends them to the drive circuit 142. It can also divide the display screen in a plurality of frames to display different images simultaneously by switching from a set of image signals to a different set of image signals within the time period for displaying a single frame.

The display panel controller 143 is a circuit for controlling the operation of the drive circuit 142 according to control signals transmitted from the CPU 147.

Among others, it operates to transmit signals to the drive circuit 142 for controlling the sequence of operations of the power source (not shown) for driving the display panel in order to define the basic operation of the display panel. It also transmits signals to the drive circuit 142 for controlling the image display frequency and the scanning method (e.g., interlaced scanning or non-interlaced scanning) in order to define the mode of driving the display panel.

If appropriate, it also transmits signals to the drive circuit 142 for controlling the quality of the images to be displayed on the display screen in terms of luminance, contrast, color tone and sharpness.

The drive circuit 142 is a circuit for generating drive signals to be applied to the display panel. It operates according to image signals coming from said multiplexer 144 and control signals coming from the display panel controller 143.

A display apparatus according to the invention and having a configuration as described above and illustrated in FIG. 25 can display on the display panel various images given from a variety of image data sources. More specifically, image signals such as television image signals are converted back by the decoder 145 and then selected by the multiplexer 144 before sent to the drive circuit 142. On the other hand, the display controller 143 generates control signals for controlling the operation of the drive circuit 142 according to the image signals for the images to be displayed on the display panel. The drive circuit 142 then applies drive signals to the display panel according to the image signals and the control signals. Thus, images are displayed on the display panel. All the above described operations are controlled by the CPU 147 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 145, the image generation circuit 148 and the CPU 147 participate such operations. Although not described with respect to the above embodiment, it is possible to provide it with additional circuits exclusively dedicated to audio signal processing and editing operations.

The above described display apparatus can not only select and display particular pictures out of a number of images given to it but also carry out various image processing operations including those for enlarging, reducing rotation, emphasizing edges of, thinning out, interpolating, changing colors of and modifying the aspect ratio of images and editing operations including those for synthesizing, erasing, connecting, replacing and inserting images as the image memories incorporated in the decoder 145, the image generation circuit 148 and the CPU 147 participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 25 shows only an example of possible configuration of a display apparatus comprising a display panel provided with an electron source prepared by arranging a number of surface conduction electron-emitting devices and the present invention is not limited thereto. For example, some of the circuit components of FIG. 25 may be omitted or additional components may be arranged there depending on the application. For instance, if a display apparatus according to the invention is used for visual telephone, it may be appropriately made to comprise additional components such as a television camera, a microphone, lighting equipment and transmission/reception circuits including a modem.

[EXAMPLE 14]

(Ladder-like Electron Source, Image Display Apparatus)

In this example, an electron source having a ladder-like wiring pattern and an image forming apparatus such an electron source were prepared in a manner as described below.

Figure 27A:
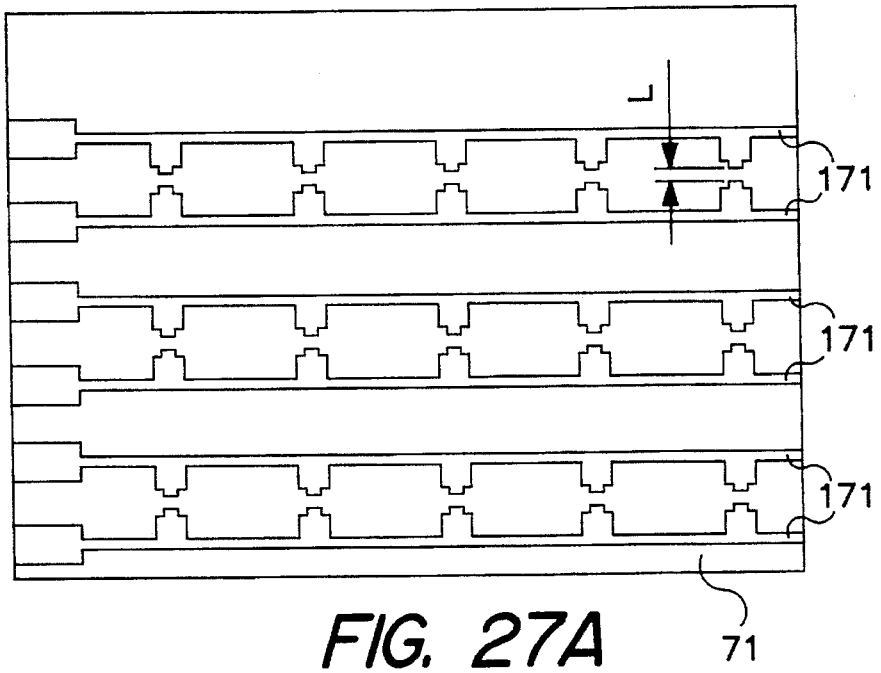
FIGS. 27A through 27C are schematic partial views of an electron source of ladder arrangement, illustrating some of the manufacturing steps thereof.

Step-A (FIG. 27A):

After thoroughly cleansing a soda lime glass plate, a silicon oxide film was formed thereon to a thickness of 0.5 μm by sputtering to produce a substrate 71, on which a pattern of photoresist (RD-2000N-41: available from Hitachi Chemical Co., Ltd.) corresponding to the pattern of a pair of electrodes having openings was formed. Then, a Ti film and an Ni film were sequentially formed to respective thicknesses of 5 nm and 100 nm by vacuum deposition. Thereafter, the photoresist was dissolved by an organic solvent and the Ni/Ti film was lifted off to produce wirings 171 that operated also as device electrodes. The device electrodes was separated by distance L of 3 μm.

Figure 27B:
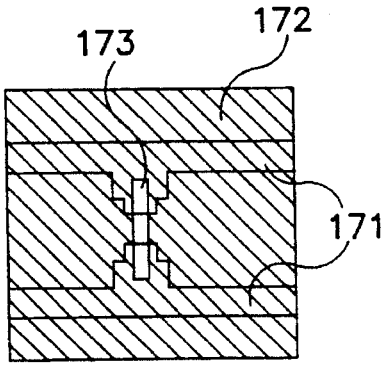

Step-B (FIG. 27B):

A Cr film was formed on the device to a thickness of 300 nm by vacuum deposition and then an opening 173 corresponding the pattern of an electroconductive thin film was formed by photolithography. Thereafter, a Cr mask 173 was formed for forming an electroconductive thin film.

Thereafter, a solution of Pd-amine-comples (ccp4230: available from Okuno Pharmaceutical Co., Ltd.) was applied to the Cr film by means of a spinner and baked at 300° C. for 12 minutes to produce a fine particle film containing Pd as a principal ingredient. The film had a film thickness of 7 nm.

Figure 27C:
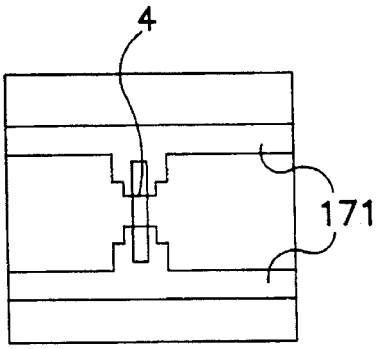

Step-C (FIG. 27C):

The Cr mask was removed by wet-etching and the PdO fine particle film was lifted off to obtain an electroconductive thin film 4 having a desired profile. The electroconductive thin film showed an electric resistance of $Rs=2\times10^4$ Ω/□.

Step-D:

A display panel was prepared as in the case of Example 12, although the panel of this examples slightly differed from that of Example 12 in that the former were provided with grid electrodes. As shown in FIG. 15, the electron source substrate 71, the rear plate 81, the face plate 86 and the grid electrodes 120 were put together and external terminals 122 and external grid electrode terminals 123 were arranged.

A forming process was carried out on the image forming apparatus as in the case of Example 12, connecting the anode side wiring and the cathode side wiring of each row to a power source.

Thereafter, an activation process was performed. The electric connection was similar to that of Example 13 and the cathode side wiring of each row was grounded while the anode side wiring of each row was connected to the output terminals Sx1 through Sx100 of the line selector section. A rectangular pulse voltage was applied and If was observed during the activation process as in the case of the Example 18 until the application of the voltage was suspended, when If exceeded 2 mA.

The atmosphere of the activation process was such that the partial pressure of acetone was $1.3\times10^{-1}$ Pa.

The activation process on each row was completed in about 30 minutes. Thereafter, the inside of the panel was evacuated for a stabilization process and, after the stabilization process, the exhaust pipe was sealed and a getter process was carried out.

Each of the rows was tested for its performance as in the case of Example 12. The grid electrode was grounded during the test. The results will be shown hereinafter.

[EXAMPLE 15]

Steps-A through K of Example 12 were followed and an activation process was carried out. As an activator, n-hexane was introduced until the partial pressure got to $2.7\times10^{-3}$ Pa. As in the case of Example 13, a rectangular pulse voltage of 18 V was applied for the activation process, while applying a voltage of 1 KV and observing If. The application of the pulse voltage was suspended whenever Ie exceeded 1 μA per device. The activation process was terminated in 30 minutes.

Thereafter, a stabilization process as performed and the exhaust pipe was sealed before a getter process was carried out.

Each of the rows of the electron emitting region of the apparatus was tested for its performance as in the case of Example 12. The test results will be shown hereinafter.

[EXAMPLE 16]

Steps-A through J of Example 12 were followed and an activation process was carried out. As an activator, acetone was introduced until the partial pressure got to $1.3\times10^{-1}$ Pa. As in the case of Example 13, a triangular pulse voltage was applied for the activation process with the same pulse width and pulse interval.

The pulse height Vact was initially 10 V and raised at a rate of 0.2 V/min. as a regular sequence.

The activation process was conducted, while observing If of each rh row. When the value of If for the device voltage of Vf2=Vact2 got to If(Vf2)≧If(Vact)/220, a voltage higher than the Vact of that moment by 1 V was applied and the voltage was kept for 30 seconds before the regular sequence was resumed. This operation was started 2 minutes after the beginning of the activation process and the gauge was observed for every minute.

When the pulse height got to 18 V, the activation process was terminated and the operation proceeded to a stabilization, after which the exhaust pipe was sealed and a getter process was carried out. The performance of the apparatus was thereafter tested.

The image forming apparatuses of Examples 14 through 16 were tested for performance by means of the technique used for the activation process, where a pulse voltage was applied to each row to see If and Ie. The pulse voltage was a rectangular pulse voltage of 16 V and the value of If for Vf=8 V was defined as Ifmid. The voltage applied to the metal back for measuring Ie was 1 KV.

| | If (mA) | Ie (μA) | Ifmid (mA) | ΔIe (%) |
|---|---|---|---|---|
| Example 14 | 125 | 90 | 5.6 | 9.5 |
| Example 15 | 165 | 145 | 7.5 | 4.5 |
| Example 16 | 115 | 135 | 0.8 | 12.0 |

While each row was tested for performance by using the regular sequence to each row in Examples 12 through 16, one or more than one rows may be selected as samples and subjected to a test. If the activation process is terminated immediately after measuring If or Ie as in the case of Examples 14 and 15, a uniform performance can be expected for all the rows because of the activator involved and the configuration of the apparatus. Therefore a sampling technique may satisfactorily used in such a case. Alternatively, a plurality of devices that are independently wired may be activated simultaneously.

As described above in detail, in the manufacture of a surface condition electron-emitting device and that of an electron source realized by arranging a plurality of such devices and an image forming apparatus comprising such an electron emitting region, an apparatus for carrying out an activation process according to the invention can effectively and advantageously be used to improve the uniformity in the quality of the devices, reduce the leak current and optimize the performance of the devices and the apparatus because it comprises means for setting up the conditions for the activation process and means for modifying the conditions and determining the timing of terminating the activation process on the basis of the data electrically detected by the apparatus.

What is claimed is:

1. A method of manufacturing an electron-emitting device having a pair of device electrodes and an electroconductive thin film including an electron emitting region arranged between the electrodes, characterized in that it comprises an activation process for increasing the emission current of the device and said activation process includes steps of a) applying a voltage (Vact) to the electroconductive thin film having a gap section under initial conditions, b) detecting the electric performance of said electroconductive thin film and c) modifying, if necessary, said initial conditions as a function of the detected electric performance of the electroconductive thin film.

2. A method of manufacturing an electron-emitting device according to claim 1, wherein said step of detecting the electric performance of said electroconductive thin film comprises a step of detecting the electric running through the electroconductive thin film.

3. A method of manufacturing an electron-emitting device according to claim 2, wherein said step of detecting the electric performance of said electroconductive thin film comprises a step of detecting an electric current (If2) running through the electroconductive thin film for a voltage (Vf2) lower than said Vact.

4. A method of manufacturing an electron-emitting device according to claim 3, wherein said Vf2 is equal to Vact/2.

5. A method of manufacturing an electron-emitting device according to claim 1, wherein said step of detecting the electric performance of said electroconductive thin film comprises a step of detecting the electric current running through the electroconductive thin film and the electric current formed by electrons emitted from the electroconductive thin film.

6. A method of manufacturing an electron-emitting device according to claim 5, wherein said step of detecting the electric performance of said electroconductive thin film further comprises a step of detecting Ie/If(η) from the electric current running through the electroconductive thin film and the electric current formed by electrons emitted from the electroconductive thin film.

7. A method of manufacturing an electron-emitting device according to claim 6, wherein said step of detecting the electric performance of said electroconductive thin film further comprises a step of detecting the rate of change with time (dθ/dr) of said θ.

8. A method of manufacturing an electron-emitting device according to claim 5, wherein said step of detecting the electric performance of said electroconductive thin film further comprises a step of detecting the threshold voltage for the electric current running through the electroconductive thin film and the threshold voltage for the electric current formed by electrons emitted from the electroconductive thin film.

9. A method of manufacturing an electron-emitting device according to claim 8, wherein said step of detecting the electric performance of said electroconductive thin film further comprises a step of detecting the difference (Vthe–Vthf) of said Vthf and said Vthe.

10. A method of manufacturing an electron-emitting device according to claim 1, wherein said step of detecting the electric performance of said electroconductive thin film further comprises a step of detecting the electric current formed by electrons emitted from the electroconductive thin film.

11. A method of manufacturing an electron-emitting device according to claim 10, wherein said step of detecting the electric performance of said electroconductive thin film further comprises a step of detecting the rate of change with time (dIe/dt) of the electric current formed by electrons emitted from the electroconductive thin film.

12. A method of manufacturing an electron-emitting device according to any of claims 1 through 11, wherein said step of modifying said initial conditions comprises a step of modifying the voltage (Vact) applied to the electroconductive thin film.

13. A method of manufacturing an electron-emitting device according to claim 12, wherein said step of modifying the voltage (Vact) comprises a step of modifying the pulse height of the pulse voltage applied to the electroconductive thin film.

14. A method of manufacturing an electron-emitting device according to claim 12, wherein said step of modifying the voltage (Vact) comprises a step of modifying the pulse width of the pulse voltage applied to the electroconductive thin film.

15. A method of manufacturing an electron-emitting device according to claim 12, wherein said step of modifying the voltage (Vact) comprises a step of modifying the pulse interval of the pulse voltage applied to the electroconductive thin film.

16. A method of manufacturing an electron-emitting device according to any of claims 1 through 11, wherein said step of modifying said initial conditions comprises a step of changing the substance of the ambient gas.

17. A method of manufacturing an electron-emitting device according to claim 16, wherein said step of changing the substance of the ambient gas comprises a step of introducing an etching gas into the ambient gas.

18. A method of manufacturing an electron-emitting device according to claim 17, wherein said etching gas is hydrogen gas.

19. A method of manufacturing an electron-emitting device according to any of claims 1 through 11, wherein said step of modifying said initial conditions comprises a step of modifying the partial pressures of the components of the ambient gas.

20. A method of manufacturing an electron-emitting device according to claim 19, wherein said step of modifying the partial pressures of the components of the ambient gas comprises a step of regulating the partial pressure of an organic substance gas.

21. A method of manufacturing an electron-emitting device according to claim 19, wherein said step of modifying the partial pressures of the components of the ambient gas comprises a step of regulating the partial pressure of an etching gas.

22. A method of manufacturing an electron-emitting device according to claim 1, wherein said electron-emitting device is a surface conduction electron-emitting device.

23. A method of manufacturing an electron source comprising a plurality of electron-emitting devices arranged and connected in rows, characterized in that said electron-emitting devices are manufactured by a method according to claim 1.

24. A method of manufacturing an electron source comprising a plurality of electron-emitting devices arranged and connected to form a matrix, characterized in that said electron-emitting devices are manufactured by a method according to claim 1.

25. A method of manufacturing an image forming apparatus comprising electron-emitting devices and image forming members, characterized in that said electron-emitting devices are manufactured by a method according to claim 1.

26. An apparatus for carrying out an activation process on an electron-emitting device having a pair of device electrodes and an electroconductive thin film including an electron emitting region arranged between the electrodes in order to increase the emission current of the device, characterized in that it comprises a) means for applying a voltage (Vact) to the electroconductive thin film having a gap section under initial conditions, b) means for detecting the electric performance of said electroconductive thin film and c) means for modifying, if necessary, said initial conditions as a function of the detected electric performance of the electroconductive thin film.

27. An apparatus for carrying out an activation process on an electron-emitting device according to claim 26, wherein said means for detecting the electric performance of said electroconductive thin film comprises means for detecting the electric current running through the electroconductive thin film.

28. An apparatus for carrying out an activation process on an electron-emitting device according to claim 27, wherein said means for detecting the electric performance of said electroconductive thin film comprises means for detecting an electric current (If2) running through the electroconductive thin film for a voltage (Vf2) lower than said Vact.

29. An apparatus for carrying out an activation process on an electron-emitting device according to claim 28, wherein said Vf2 is equal to Vact/2.

30. An apparatus for carrying out an activation process on an electron-emitting device according to claim 26, wherein said means for detecting the electric performance of said electroconductive thin film comprises means for detecting the electric current running through the electroconductive thin film and the electric current formed by electrons emitted from the electroconductive thin film.

31. An apparatus for carrying out an activation process on an electron-emitting device according to claim 30, wherein said means for detecting the electric performance of said electroconductive thin film further comprises means for detecting Ie/If($\eta$) from the electric current running through the electroconductive thin film and the electric current formed by electrons emitted from the electroconductive thin film.

32. An apparatus for carrying out an activation process on an electron-emitting device according to claim 31, wherein said means for detecting the electric performance of said electroconductive thin film further comprises means for detecting the rate of change with time ($d\eta/dt$) of said $\eta$.

33. An apparatus for carrying out an activation process on an electron-emitting device according to claim 30, wherein said means for detecting the electric performance of said electroconductive thin film further comprises means for detecting the threshold voltage for the electric current running through the electroconductive thin film and the threshold voltage for the electric current formed by electrons emitted from the electroconductive thin film.

34. An apparatus for carrying out an activation process on an electron-emitting device according to claim 33, wherein said means for detecting the electric performance of said electroconductive thin film further comprises means for detecting the difference (Vthe–Vthf) of said Vthf and said Vthe.

35. An apparatus for carrying out an activation process on an electron-emitting device according to claim 26, wherein said means for detecting the electric performance of said electroconductive thin film further comprises means for detecting the electric current formed by electrons emitted from the electroconductive thin film.

36. An apparatus for carrying out an activation process on an electron-emitting device according to claim 35, wherein said step of detecting the electric performance of said electroconductive thin film further comprises means for detecting the rate of change with time (dIe/dr) of the electric current formed by electrons emitted from the electroconductive thin film.

37. An apparatus for carrying out an activation process on an electron-emitting device according to any of claims 26 through 36, wherein control means comprises means for modifying the voltage (Vact) applied to the electroconductive thin film.

38. An apparatus for carrying out an activation process on an electron-emitting device according to claim 37, wherein said means for modifying the voltage (Vact) comprises means for modifying the pulse height of the pulse voltage applied to the electroconductive thin film.

39. An apparatus for carrying out an activation process on an electron-emitting device according to claim 37, wherein said means for modifying the voltage (Vact) comprises means for modifying the pulse width of the pulse voltage applied to the electroconductive thin film.

40. An apparatus for carrying out an activation process on an electron-emitting device according to claim 37, wherein said means for modifying the voltage (Vact) comprises means for modifying the pulse interval of the pulse voltage applied to the electroconductive thin film.

41. An apparatus for carrying out an activation process on an electron-emitting device according to any of claims 26 through 36, wherein control means comprises means for changing the substance of the ambient gas.

42. An apparatus for carrying out an activation process on an electron-emitting device according to claim 41, wherein said means for changing the substance of the ambient gas comprises means for introducing an etching gas into the ambient gas.

43. An apparatus for carrying out an activation process on an electron-emitting device according to any of claims 26 through 36, wherein said control means comprises means for modifying the partial pressures of the components of the ambient gas.

44. An apparatus for carrying out an activation process on an electron-emitting device according to claim 43, wherein said means for modifying the partial pressures of the components of the ambient gas comprises means for regulating the partial pressure of an organic substance gas.

45. An apparatus for carrying out an activation process on an electron-emitting device according to claim 43, wherein said means for modifying the partial pressures of the components of the ambient gas comprises means for regulating the partial pressure of an etching gas.

* * * * *

UNITED STATES PATENT AND TRADEMARK OFFICE

CERTIFICATE OF CORRECTION

PATENT NO. : 5,591,061

DATED : January 7, 1997

INVENTORS : Sotomitsu Ikeda et al.

It is certified that error appears in the above-identified patent and that said Letters Patent is hereby corrected as shown below:

COLUMN 1

Line 18, "device" should read --devices--.
Line 25, "device" should read --devices--.
Line 28, "device" should read --devices--.
Line 36, "[G." should read --G.--.
Line 37, "(1972)]" should read --(1972),--.
Line 39, "[M." should read --M.--.
Line 40, "(1975)]" should read --(1975)-- and "[H." should read --H.--
Line 41, "(1983)]" should read --(1983)--.
Line 53 "[mm]" should read --mm-- and "[mm]." should read --mm.--.
Line 55, "a" should read --an--.

COLUMN 2

Line 24, "of" should read --of an--; and line 39, "to" should read --to as--.

COLUMN 3

Line 5, "one" should read --on--.
Line 10, "extends" should read --extents--.
Line 19, "an" should read --a--.
Line 43, Delete "then".

COLUMN 6

Line 47, "include" should read --includes--.
Line 66, "include" should read --includes--.

UNITED STATES PATENT AND TRADEMARK OFFICE

CERTIFICATE OF CORRECTION

PATENT NO. : 5,591,061

DATED : January 7, 1997

INVENTOR(S) : Sotomitsu Ikeda et al.

It is certified that error appears in the above-identified patent and that said Letters Patent is hereby corrected as shown below:

COLUMN 8

Line 11, "conducting" should read --conductive--.
Line 51, "a" should read --one--.

COLUMN 9

Line 10, "hundreds of several" should read --several hundreds of--.
Line 28, "referred" should read --refers--.
Line 30, "particles" should read --particle--.
Line 49, "11.1-4)" should read --11.1-4).--.
Line 64, "tens of several" should read --several tens of--.

COLUMN 10

Line 11, "are same" should read --are the same--.
Line 17, "materials same" should read --the same materials--.
Line 23, "tens of" should read--several--.
Line 24, "several" should read --tens of--.
Line 25, "tens of several" should read --several tens of--.

COLUMN 11

Line 28, "tens of several" should read --several tens of--.

COLUMN 12

Line 43 "whichever" should read --whichever is--.

UNITED STATES PATENT AND TRADEMARK OFFICE

CERTIFICATE OF CORRECTION

PATENT NO. : 5,591,061

DATED : January 7, 1997

INVENTORS : Sotomitsu Ikeda et al.

It is certified that error appears in the above-identified patent and that said Letters Patent is hereby corrected as shown below:

COLUMN 13

Line 2, after "gas" and "13" insert --,--.
Line 4, "denote" should read --denotes--.
Line 54, "devices or lines" should read --device or line--.

COLUMN 16

Line 18, "to" should read --to as--.
Line 26, "an" should read --a--.

COLUMN 17

Line 3, Delete "a".
Line 18, "to" should read --to a--.
Line 19, "and" should read --and a--.
Line 25, "be" should read --be the--.

COLUMN 18

Line 40, delete "be".

COLUMN 19

Line 12, "is" should read --was--.

COLUMN 20

Line 23 "form" should read --from--.
Line 33, "designed" should read --designated--.
Line 58, "emit" should read --emits--.
Line 59, "only a" should read --only when a--.

UNITED STATES PATENT AND TRADEMARK OFFICE

CERTIFICATE OF CORRECTION

PATENT NO. : 5,591,061

DATED : January 7, 1997

INVENTOR(S) : Sotomitsu Ikeda et al.

It is certified that error appears in the above-identified patent and that said Letters Patent is hereby corrected as shown below:

COLUMN 21
Line 1, "particularly" should read --practically--.
Line 67, "by" should read --in--.

COLUMN 23
Line 39, "was" should read --were--.

COLUMN 25
Line 10, "as" should read --was--.
Line 16, "devices" should read --device--.
Line 45, "devices" should read --device--.
Line 56, "device" should read --devices--.
Line 58, "Example" should read --Examples--.

COLUMN 26
Line 10, "these" should read --this--.
Line 43, 'sequence and" should read --sequence,--.
Line 57, "for along low" should read --along a low--.
Line 59, "assumes" should read --assume--.

COLUMN 27
Line 2, "a" should read --an--.
Line 32, "drive" should read --driven--.
Line 55, delete "of". (first occurrence).
Line 60, delete "that".

UNITED STATES PATENT AND TRADEMARK OFFICE

CERTIFICATE OF CORRECTION

PATENT NO. : 5,591,061

DATED : January 7, 1997

INVENTOR(S) : Sotomitsu Ikeda et al.

It is certified that error appears in the above-identified patent and that said Letters Patent is hereby corrected as shown below:

COLUMN 28
Line 6, "proceeds" should read --proceeded--.
Line 52, "was" should read --were--.
Line 53, "reduce" should read --reduced--.

COLUMN 29
Line 50, "example" should read --Example".
Line 55, "obserbed," should read --observed,--.
Line 56, delete "to"

COLUMN 30
Line 11, "this example 4," should read --these Examples,--.
Line 63, "example" should read --Example--.

COLUMN 31
Line 35 "as" should read --was--. (first occurrence)
Line 36, "in" should read --in the--.
Line 47, "arranging" should read --arranging a--.

COLUMN 32
Line 26, "wirings" should read --wiring--.
Line 41, "with" should read --from--.

COLUMN 33
Line 1, "x-" should read --X- --.
Line 3, "is consisted" should read --consists--.
Line 21, delete "by".

UNITED STATES PATENT AND TRADEMARK OFFICE

CERTIFICATE OF CORRECTION

PATENT NO. : 5,591,061

DATED : January 7, 1997

INVENTOR(S) : Sotomitsu Ikeda et al.

It is certified that error appears in the above-identified patent and that said Letters Patent is hereby corrected as shown below:

COLUMN 33

Line 49, "with" should read --with a--.
Line 60, "59 so" should read --59 was so--.

COLUMN 34

Line 47, "(ΔIe(%)" should read --(ΔIe(%))--.

COLUMN 35

Line 27, "swithes" should read --switches--.
Line 64, "operates" should read --operated--.

COLUMN 36

Line 67, "be" should read --the--.

COLUMN 37

Line 27, "ing given" should read --ing to given--.
Line 52, "participate" should read --participate in--.
Line 67, delete "into".

COLUMN 38

Line 47, "before" should read --before being--.
Line 66, "147 participate such opera-" should read --147--.
Line 67, delete "tions."

UNITED STATES PATENT AND TRADEMARK OFFICE

CERTIFICATE OF CORRECTION

PATENT NO. : 5,591,061

DATED : January 7, 1997

INVENTOR(S) : Sotomitsu Ikeda et al.

It is certified that error appears in the above-identified patent and that said Letters Patent is hereby corrected as shown below:

COLUMN 39

Line 13, "147 participate such opera-" should read --147.--.
Line 14, delete --tions.--
Line 46, "such an" should read --such as an--.
Line 61, "was" should read --were--.
Line 65, "sponding the" should read --sponding to the--.

COLUMN 40

Line 1, "Pd-amine-comples" should read --Pd-amine-complexes--.
Line 14, "examples" should read --Example--.
Line 15, "were" should read --was--.
Line 31, delete "the". (third occurrence).
Line 55, "as" should read --was--.

COLUMN 41

Line 40, "may" should read --may be--.

COLUMN 42

Line 8, "electric" should read --electric current--.
Line 35, "($d\theta/dr$)" should read --($d\theta/dt$)--.

UNITED STATES PATENT AND TRADEMARK OFFICE

CERTIFICATE OF CORRECTION

PATENT NO. : 5,591,061

DATED : January 7, 1997

INVENTOR(S) : Sotomitsu Ikeda et al.

It is certified that error appears in the above-identified patent and that said Letters Patent is hereby corrected as shown below:

COLUMN 45

Line 18, "36." should read --36,--.

Signed and Sealed this

Twenty-ninth Day of July, 1997

Bruce Lehman

*Attest:*

BRUCE LEHMAN

*Attesting Officer*

*Commissioner of Patents and Trademarks*